US009598217B2

(12) United States Patent
Giller

(10) Patent No.: US 9,598,217 B2
(45) Date of Patent: Mar. 21, 2017

(54) PACKAGING FOR EDGE-SENSITIVE CARGO

(71) Applicant: Thomas Giller, Lennestadt (DE)

(72) Inventor: Thomas Giller, Lennestadt (DE)

( * ) Notice: Subject to any disclaimer, the term of this patent is extended or adjusted under 35 U.S.C. 154(b) by 0 days.

(21) Appl. No.: 14/671,394

(22) Filed: Mar. 27, 2015

(65) Prior Publication Data

US 2015/0298885 A1 Oct. 22, 2015

Related U.S. Application Data

(63) Continuation-in-part of application No. PCT/EP2013/002697, filed on Sep. 9, 2013.

(30) Foreign Application Priority Data

| | | |
|---|---|---|
| Sep. 30, 2012 | (DE) | 10 2012 019 169 |
| Nov. 20, 2012 | (DE) | 10 2012 022 585 |
| Dec. 29, 2012 | (DE) | 10 2012 025 523 |
| Jan. 29, 2013 | (DE) | 10 2013 001 625 |

(51) Int. Cl.
*B65D 81/05* (2006.01)
*B65D 81/36* (2006.01)
(Continued)

(52) U.S. Cl.
CPC ..... *B65D 81/053* (2013.01); *B65D 19/0053* (2013.01); *B65D 19/42* (2013.01); *B65D 19/44* (2013.01); *B65D 81/055* (2013.01); *B65D 81/361* (2013.01); *B65D 85/48* (2013.01); *B65D 2519/00273* (2013.01); *B65D 2519/00562* (2013.01); *B65D 2519/00572* (2013.01); *B65D 2519/00781* (2013.01); *B65D 2519/00791* (2013.01); *B65D 2519/00796* (2013.01); *B65D 2581/052* (2013.01)

(58) Field of Classification Search
CPC ..... B65D 85/48; B65D 81/053–81/058; B65D 81/361; G09F 1/12; G09F 15/0012; A47G 1/06
USPC ..... 40/785, 780
See application file for complete search history.

(56) References Cited

U.S. PATENT DOCUMENTS 4,989,415 A 2/1991 Lombness

FOREIGN PATENT DOCUMENTS

| | | |
|---|---|---|
| DE | 1162064 | 1/1964 |
| DE | 19 53 181 | 1/1967 |

(Continued)

*Primary Examiner* — Anthony Stashick
*Assistant Examiner* — Mollie Impink
(74) *Attorney, Agent, or Firm* — Nils H. Ljungman & Associates

(57) ABSTRACT

A packaging for edge-sensitive cargo. The abstract of the disclosure is submitted herewith as required by 37 C.F.R. §1.72(b). As stated in 37 C.F.R. §1.72(b): A brief abstract of the technical disclosure in the specification must commence on a separate sheet, preferably following the claims, under the heading "Abstract of the Disclosure." The purpose of the abstract is to enable the Patent and Trademark Office and the public generally to determine quickly from a cursory inspection the nature and gist of the technical disclosure. The abstract shall not be used for interpreting the scope of the claims. Therefore, any statements made relating to the abstract are not intended to limit the claims in any manner and should not be interpreted as limiting the claims in any manner.

14 Claims, 26 Drawing Sheets

(51) Int. Cl.

| | |
|---|---|
| ***B65D 85/48*** | (2006.01) |
| ***B65D 19/00*** | (2006.01) |
| ***B65D 19/42*** | (2006.01) |
| ***B65D 19/44*** | (2006.01) |

(56) References Cited

FOREIGN PATENT DOCUMENTS

| | | |
|---|---|---|
| DE | 1953181 | 1/1967 |
| DE | 1292811 | 4/1969 |
| DE | 6903524 | 8/1969 |
| DE | 2032243 | 1/1972 |
| DE | 26 46 908 | 4/1978 |
| DE | 2741725 | 3/1979 |
| DE | 3022017 | 12/1981 |
| DE | 33 44 120 | 6/1985 |
| DE | 9110930 | 12/1991 |
| DE | 19607897 | 10/1996 |
| DE | 19539511 | 4/1997 |
| DE | 19607896 | 9/1997 |
| DE | 19726959 | 11/1998 |
| DE | 19726415 | 12/1998 |
| DE | 19803915 | 6/1999 |
| DE | 19849149 | 9/1999 |
| DE | 10003808 | 8/2001 |
| DE | 10106341 | 7/2002 |
| DE | 20204181 | 7/2002 |
| DE | 10124061 | 2/2003 |
| DE | 10226202 | 2/2003 |
| DE | 10151334 | 4/2003 |
| DE | 10247190 | 3/2004 |
| DE | 10245470 | 4/2004 |
| DE | 10251505 | 5/2004 |
| DE | 10315090 | 10/2004 |
| DE | 102004050867 | 5/2006 |
| DE | 202006017392 | 5/2007 |
| DE | 10 2006 02591 | 12/2007 |
| DE | 202007018064 | 3/2008 |
| DE | 202008004965 | 7/2008 |
| DE | 202008013755 | 3/2009 |
| DE | 202009000339 | 4/2009 |
| DE | 202009000692 | 4/2009 |
| DE | 602004013008 | 5/2009 |
| DE | 202008005847 | 8/2009 |
| DE | 202008012066 | 1/2010 |
| DE | 102009041574 | 5/2010 |
| DE | 202008017621 | 8/2010 |
| DE | 202010008929 | 3/2011 |
| DE | 102009046413 | 5/2011 |
| DE | 102010030310 | 12/2011 |
| DE | 202010008532 | 12/2011 |
| DE | 102010050874 | 5/2012 |
| DE | 102010053740 | 6/2012 |
| DE | 102011100025 | 10/2012 |
| DE | 102011119966 | 11/2012 |
| EP | 0 216 690 | 4/1987 |
| EP | 0 502 347 | 9/1992 |
| EP | 0 530 611 | 3/1993 |
| EP | 0 677 455 | 10/1995 |
| FR | 2 769 601 | 4/1999 |
| WO | WO 2008/087370 | 7/2008 |

280

298
299
266
248
265

268

290
291
267

108

FIG. 48B
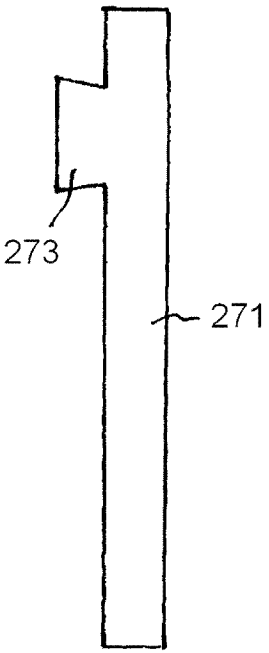
FIG. 48A
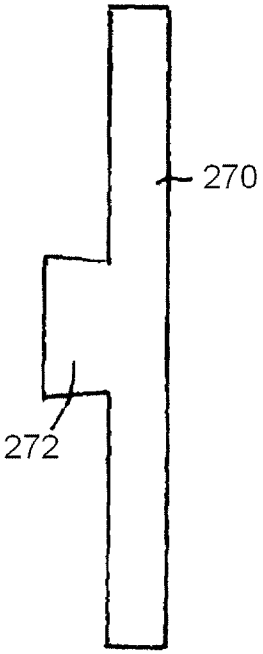
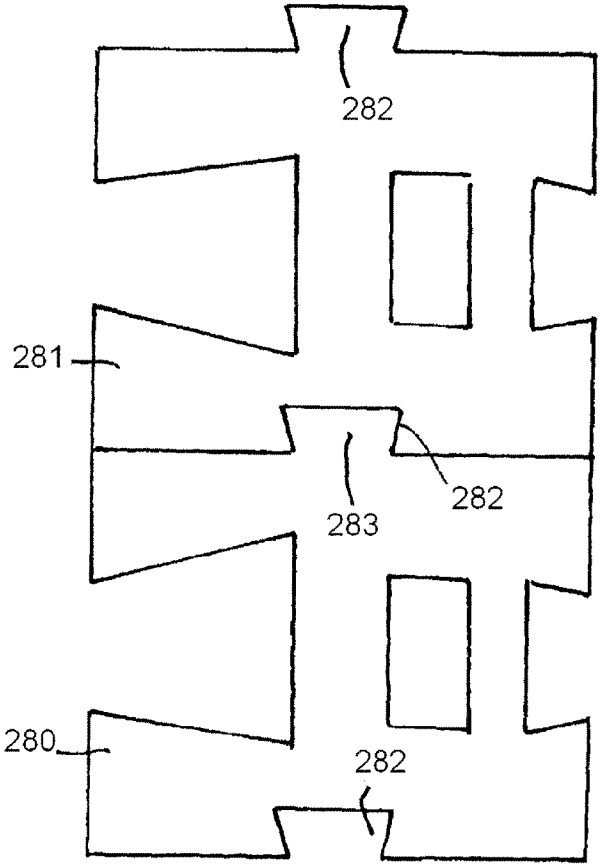
FIG. 19F

FIG. 31
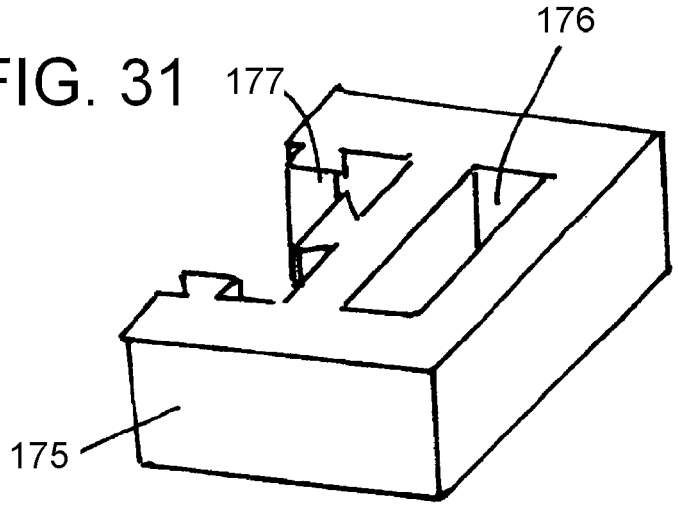
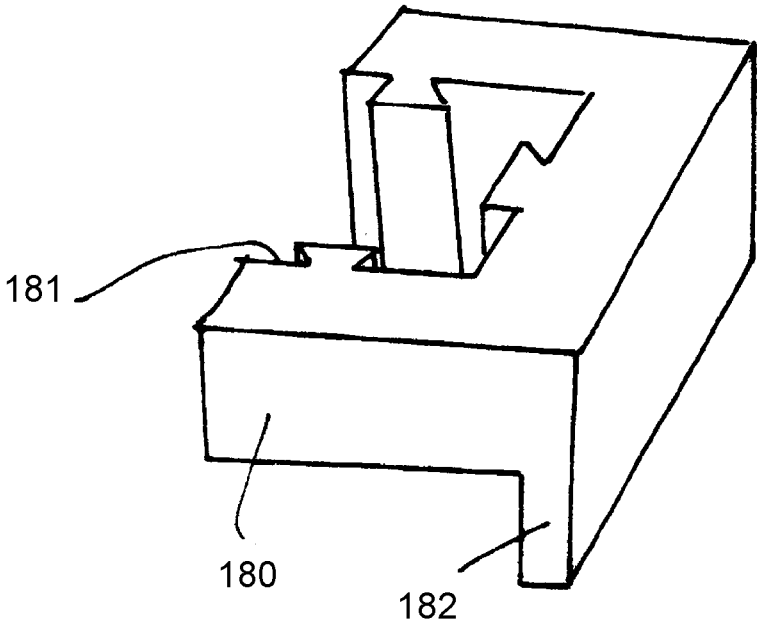
FIG. 32

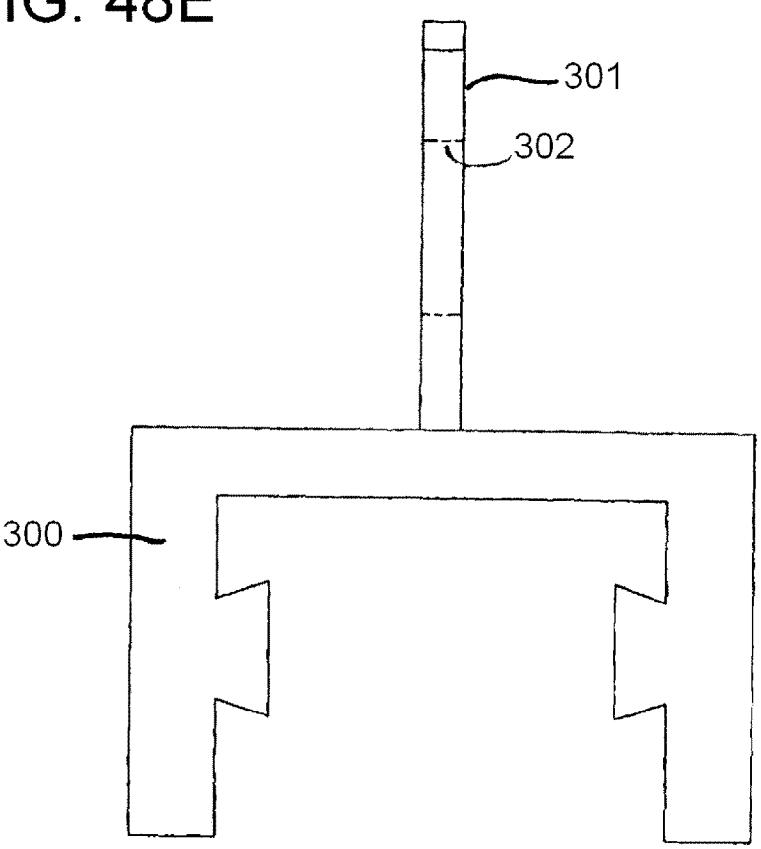
FIG. 48E
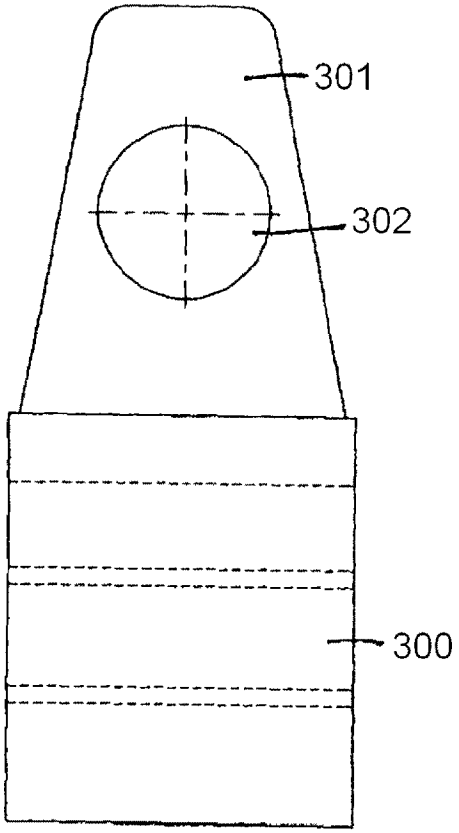

PACKAGING FOR EDGE-SENSITIVE CARGO

CONTINUING APPLICATION DATA

This application is a Continuation-In-Part application of International Patent Application No. PCT/2013/002697, filed on Sep. 9, 2013, which claims priority from Federal Republic of Germany Patent Application No. 10 2012 019 169.3, filed on Sep. 30, 2012; Federal Republic of Germany Patent Application No. 10 2012 022 585.7, filed on Nov. 20, 2012; Federal Republic of Germany Patent Application No. 10 2012 025 523.3, filed on Dec. 19, 2012; and Federal Republic of Germany Patent Application No. 10 2013 001 625.8, filed on Jan. 29, 2013. International Patent Application No. PCT/2013/002697 was pending as of the filing date of this application. The United States was an elected state in International Patent Application No. PCT/2013/002697.

BACKGROUND

1. Technical Field

The present application relates to packaging for edge-sensitive cargo.

2. Background Information

Background information is for informational purposes only and does not necessarily admit that subsequently mentioned information and publications are prior art.

The present application relates to the packaging of edge-sensitive cargo. Such cargo includes glass-sheets, for example flat glass-sheets; even more sensitive are natural stone slabs. Even bending-and impact resistant laminated glass-sheets have sensitive areas. These areas are located at the edges.

Flat glass is available in various types, for example as toughened single-pane safety glass, as laminated safety glass, as laminated glass, as multi-pane composite glass, as fire protection glass, as sun protection glass, as thermally or chemically toughened glass, as float glass, as heat protection glass, as wire glass, as window glass, as cast glass, as soundproof glass, as transparent greenhouse glass. The various types of glass are largely standardized. For example, DIN 12150, DIN EN ISO 12543, DIN 1259, DIN 4102, DIN 18631 DIN 11525, DIN 11526 and DIN 52290.

Window glass is nowadays mainly produced using a float glass process, through which it achieves a high surface quality.

The float glass process is a continuous production process. Purified/refined molten glass is directed to a bath of molten tin. In comparison to the tin the glass has a lower specific gravity and therefore floats upon the molten tin. This produces very uniform glass with a high surface quality.

Laminated glass typically comprises at least two transparent layers, of which at least one is a glass sheet. Usually the other transparent sheet is also a glass sheet. Both layers are bonded together by an organic interlayer. The organic interlayer is usually a type of foil. Such foils and the connection of the glass layers are for example described in DE1292811. For example, the foils used are highly tear-resistant, tough and elastic, thermoplastic foils. Such foils comprise, for example, ethylene vinyl acetate (EVA), polyacrylate (PA), polymethyl methacrylate (PM MA), polyurethane (PUR), etc. PVB, TPU or similar materials can be used as well.

Instead of foil, other adhesive layers such as liquid resins might be used. Laminated glass also includes glass-sheets that are bonded to other materials, such as a transparent polycarbonate.

Glass, with comparable properties like laminated glass, usually has a substantial thickness. To generate a stress-relieved state, such a glass is for example produced stress-free or heat-treated after production. In its stress-relieved state, the glass is highly rigid and impact resistant in comparison to other conventionally produced glass. If an edge-protection for laminated glass is addressed in the remainder of this document, the expression laminated glass also includes one-piece glass with similar properties.

Laminated glass-sheets have found manifold applications. Possibly known are the applications in construction and in automotive technology. In automotive technology, the laminated glass-sheets are also known as safety glass.

In construction, laminated glass-sheets are for example used for shop windows, large-surface windows, glass doors, large-surface glass doors, shower enclosures, balustrades, transparent partitioning walls, overhead glazing, glass roofing and glass porches or the like.

Laminated glass can fulfill multiple tasks. Of these, rigidness and impact resistance are two of the possible tasks. Other possible tasks include fire protection or sound insulation.

When compared to a single-sheet, laminated glass-sheets distinguish themselves through characteristics such as a very high rigidness and a high impact resistance. Rigidness and impact resistance are not defined as absolute values, but rather as values that are sufficient for the possible application for which the laminated glass is used.

It is also used in considerable volumes for other types of glass such as toughened safety glass, insulating-glass, mirror-glass and other types of glass.

Despite its strength, the edges of glass, including laminated glass, may be sensitive.

Therefore it is common, not only with a simple type of glass but also with laminated glass and other types of glass, to protect glass-sheets very well, for example for transport. Possibly in construction, one cannot expect that glass be handled with extreme caution. The harsh modus operandi of the construction business is not set up for such precaution. Up until now, substantial damage to glass is a regular phenomenon in construction. Up to ten percent damages is quite common and even twenty percent is not regarded as exceptional.

Laminated glass-sheets for motor vehicles are usually box- or crate-protected in multiples, i.e. placed in a protective box or crate. In this case, a soft, flexible bed is prevised in the boxes. The boxes are designed to transport the laminated glass from the manufacturer to a vehicle manufacturer or to a vehicle repair shop.

The dimensions of glass-sheets designated for use in construction often have much larger dimensions than the glass used for motor vehicles. Therefore, it is common to transport glass-sheets for constructional use to the construction site in an upright position in a so-called load carrier. A load-carrier is a frame in which the glass-sheets are transported in an upright position. There are vehicles with fixed load-carriers. Frequently, the glass is offloaded from the load-carrier at a construction site. Using a load-carrier has major drawbacks:

A vehicle that is equipped as a load-carrier is not suitable for other transports.

The vehicle must or should wait at the construction site until all or most the glass sheets are installed, or a safe interim storage for the glass-sheets must or should be created on site.

The load-carriers are rigid racks that are mountable i.e. lockable on vehicles, in which glass is secured in an upright position. The transport costs for such rack-systems are disproportionately high. In addition it must or should be taken into account that the racks must or should not only be transported to the construction site, but also need to be collected or should be collected from the construction site again. Furthermore it must or should be taken into account that trucks commonly used for glass transport, when loaded with racks and glass, are filled nowhere near to maximum capacity. It is not uncommon to see offers for glass transport, where the cost of transport is just as high as the cost of the glass itself.

A vehicle with an off loadable load-carrier is of course suitable for other tasks. However, the load-carriers consume a lot of cargo space and are a great hindrance for additional cargo. The load-carrier is offloaded at the construction site. After installing the glass-sheets, the carrier must or should be collected again. Both issues result in high transport costs. In addition, if a load-carrier is not immediately or substantially immediately released, this usually creates significant additional costs. If a delay in the installation of the glass-sheets occurs, a delayed release of the load-carrier is an automatic consequence. In that case, one wants to continue to store the glass on the load-carriers, because any other type of storage contains a much greater risk of damage to the glass.

Cargo that is partially made of glass encounters the same problems as described for glass sheets above. This is the case for example with photovoltaic elements/solar cells.

With natural stone slabs a similar situation as for glass-sheets exists. However, because of their inhomogeneity, natural stone slabs with the same thickness are even more sensitive than glass. Thin Natural stone slabs will break at the slightest bending load. Natural stone slabs are also transported to the customer placed upright in a load-carrier. In construction, natural stone slabs are often used as well, for example as floor panels and windowsills.

However, also other cargo is easily damaged. These include for example countertops that are otherwise able to withstand considerable loads, but are highly sensitive along their sharp edges.

For much cargo, edge-sensitivity is the most frequent cause of damages.

This applies not only to other sheet-like cargo, but also to cuboidal cargo.

OBJECT OR OBJECTS

An objective of the present application may be to simplify the transport of edge-sensitive cargo and/or to reduce its transportation costs, whilst at the same time preserving adequate transport protection.

SUMMARY

This may be achieved by the present application. Possible versions are also disclosed in the present application. Essential thereby is:

a) A protection enveloping the edges b) Made of yieldable material, in one possible embodiment a yieldable foam-plastic (yielding material), and c) comprising a reinforcing material d) Where the yieldable material is at least partially disposed between the reinforcing material and the edge requiring protection.

Any pressure, that would cause damage if an edge-protection were not used (edge damaging pressure), is absorbed by the edge-protection. To the extent that part of this pressure propagates in the direction of the edge that needs and/or desires protecting, the reinforcing material causes this pressure to spread wide towards the edges through the yielding material. The pressure acting on the edge requiring protection is thereby reduced to such an extent, that the edge can easily withstand the remaining pressure.

As such, an edge-protection with foam-plastic is known. The cargo is usually completely covered in plastic foam and then cased in cardboard. In this, the cardboard has a much lower resistance than the plastic foam. That is, in the packaging design the foam-plastic is the stronger material/reinforcing material and the cardboard is the more yieldable material/yielding material.

The edge-protection of the present application is substantially better than a conventional edge-protection. According to the present application, when compared with the reinforcement layer, the yielding layer is at least twenty percent, in one possible embodiment at least forty percent, in another possible embodiment at least sixty percent and in yet another possible embodiment at least eighty percent more yieldable than the reinforcing material. The yield-ability is to be understood as the measure of compression, as experienced by a cube of material with a one-centimeter long edge, placed on a flat and level supporting surface; the compression is measured when an object weighing one kilogram is dropped with its impacting surface parallel or substantially parallel to the impacting surface of the cube from a height of one centimeter.

A multi-layer construction with at least two layers of reinforcing material is possible, when a layer of yielding material is not only prevised between the reinforcing material and the edge of the cargo, but also between the two layers of reinforcing material. This positively affects the deformation characteristics of the edge-protection.

The yielding material protrudes laterally over the outer surfaces of the cargo. In one possible embodiment, the edge-protection wraps around the edges of the cargo. In another possible embodiment, the reinforcing material protrudes laterally over the exterior surface of the cargo and/or the reinforcing material protrudes into the part of the yielding material covering the cargo.

The reinforcing material may be made of a type of metal or plastic. As metals, aluminum and other metals with low specific gravity may be used.

Expanded plastics are in one possible embodiment used as yielding materials. In the packaging industry, expanded polystyrene and polyethylene plastics are already commonly used.

This is attributable to the low costs of such foams. Common packaging foams have a low density (weight per unit of volume). The same foams with a higher density can serve as a reinforcing material, which is possible. Adding a propellant sets the density. Adding more propellant means a lower density making the foam more yieldable. Adding less propellant means a higher density making the foam less yieldable.

The reinforcing material can also be of an organic or inorganic nature. Organic reinforcing material can be wood. Wooden profiles represent a cost-effective solution, possibly if they are straight shaped. A simple profile with a rectangular cross-section can already fulfill the required and/or desired reinforcement characteristics. As straight profiles, wooden laths, or even roof-battens represent a very cost-effective solution. Inorganic reinforcing materials are for example glass fibers. The glass fibers can enclose the yielding material as a mesh fabric, to create the reinforcing material as described above.

The roof-battens are standardized according to DIN 4047-1. The standardization essentially ensures and/or promotes specific dimensions of thirty by fifty millimeters or forty by sixty millimeters. However, most of the commercially available roof battens do not adhere to this norm. These roof-battens usually deviate one to two millimeters or more from the norm. The greater accuracy that is provided by the DIN standard is an advantage, because there will be much less play when the reinforcement profile is slid into the yielding material; or vice versa, the yielding material is slid over the reinforcement profile. The roof-battens are an extremely economical reinforcing material. Drop tests with a float glass sheet, packaged using a roof-batten as reinforcing material encompassed by a yielding material comprising an extruded polystyrene foam, have been performed without causing damage to the glass-sheet. The float glass-sheet used in the tests was six millimeters thick with a surface area of one square meter. The polystyrene foam was conventional, closed-cell construction foam, used for exterior insulation of buildings, with a density of thirty kilogram per cubic meter. Such foam comprises at least ninety-five percent closed-cells. The foam properties and in one possible embodiment the yieldability can be derived from the density.

The polystyrene foam had a thickness of one hundred millimeters. As prevised in the present application, the reinforced polystyrene foam was held in place by a strapping of ten millimeters wide and one-half millimeter thick, placed around the edges of the glass-sheet.

The height of two and one-half meters from which the drop-tests were performed, was unrealistically high. Therefore the results of the tests were surprising. The tests had to be stopped after the sixth consecutive drop, because the strapping had come loose. No damage whatsoever to the glass had occurred until then.

Using the same type of edge protection with a number of straps, repeated tests at a reduced drop-height of one meter and using a sandstone slab with a thickness of twenty millimeters were also successful.

Strapping is possible on the longitudinal sides.

Even better results can be achieved when hollow steel profiles or aluminum profiles are used instead of roof-battens. The advantage of aluminum profiles, in comparison to the steel profiles, is their lower weight. However, metal profiles cause significantly higher packaging costs, so that a return of the packaging to the supplier is recommended in order to make reuse possible. The packaging costs, using an edge-protection made of particle-foam and roof-battens, are so low that disposing of the packaging can be considered instead of a return.

With curved shapes and/or complicated cross-sections, using plastic reinforcing material, in one possible embodiment unexpanded plastic might be less expensive. To reduce costs, it is possible to add filling materials to the plastic and/or to use recycled material.

Wood may also be used as filling material. The wood is therefore reduced to a dimension, which makes it suitable for use in the processing equipment of the plastic. In the mix with plastic, the filling material represents a proportion of at least fifty wt %, in one possible embodiment at least sixty wt %, and in another possible embodiment a proportion of at least 70 wt %. As a plastic, a polyolefin such as polyethylene or polystyrene is possibly used.

Extrusion equipment may be suitable to process the plastic with filling material. The plastic is mixed, together with the filling material and other additive, in the extrusion equipment. The plastic is melted, so that the other mixture components can be easily mixed into the plastic. The mixture in the extruder is then cooled to the exit temperature and forced through a die, which brings the exiting material into its desired shape. The exiting material cools off and retains the desired shape. Alternatively, the melt can be injected into a mold. After the melt in the mold has cooled off, the melt maintains the shape of the mold cavity. One speaks of molded components or manufacturing by injection molding.

The yielding material is in one possible embodiment made of expanded plastic, in another possible embodiment polyolefin foam such as polystyrene foam. The foam can be a particle foam or extruded foam.

The particle foam (also known as bead foam) comprises multiple particles (also known as beads). The particles can be produced in an autoclave. Particles are produced by polymerization of monomers, after which they are loaded with a propellant, so that the particles start to foam (expand), directly after being heated and transferred from a pressurized container into a free state.

The expanded particles are filled into a mold cavity, which has the intended shape of the yielding material, as prevised for the edge-protection. Usually superheated steam is applied to the particles in the mold cavity, so that the particles melt on their outer surface and start to bond or weld to the adjacent particles. The glued or welded particles then take the shape of the mold cavity. The moldings can then be removed from the mold cavity.

The yielding material can also be manufactured as foam through extrusion. By heating plastic under considerable pressure, the plastic is brought into a molten liquid state. It is then mixed with additives and a propellant and, as explained above, cooled to the exit temperature, after which it is pressed through a die. When exiting the extruder, the melt goes from a high-pressure area into an ambient-pressure area. Due to the pressure drop, the propellant reacts. It expands and, simultaneously or substantially simultaneously with the cooling of the melt, it forms a multitude of cells in the melt. The expansion is limited with a calibrator, which is shaped in the desired cross-sectional dimensions of the foam strand.

The melt comprising the propellant can also be injected into a mold that gives the forming foam-plastic its desired shape.

Particle foam may also be used for the production of moldings for the yielding material. Particle foam comprises foam particles. The particles are filled under a certain pressure into a mold, which like the injection mold, has the desired shape of the plastic parts. In the mold, the particles are steamed with superheated steam so that the particles melt on their outer surfaces and bond together under the existing pressure.

At the same density, extruded foam has better strength properties than particle foam.

Conventional extruded polystyrene foam has a closed-cell proportion of ninety-five percent or more, in relation to the total number of cells. For yieldability reasons, it may also be possible to use foam, which has an open-cell proportion of more than the five percent often found in conventional construction-foam. In one possible embodiment, the open-cell proportion is then at least ten percent, in another possible embodiment at least twenty percent and in yet another possible embodiment at least thirty percent. That is, of the total number of cells in the foam, the percentage indicates the proportion of open cells; open cells are the cells through which entrapped gas is able to escape under stress/pressure.

A propellant is used to shape the cells. The propellant expands in molten/softened polystyrene, when the ambient pressure is reduced accordingly.

This takes place during extrusion when the melt, loaded with the propellant, exits the extruder in which a many times higher pressure exists than the ambient pressure.

During the production of particle foam this occurs, when the unexpanded or only slightly pre-expanded polystyrene particles, loaded with propellant, are softened under pressure and temperature in an autoclave and are then quickly released from the autoclave. The propellant dosage determines to what extent a common, substantially closed-cell construction foam is generated, or whether an open-celled foam is produced. In today's conventional carbon dioxide-containing propellants, the proportion of propellant in the mixture for the creation of construction foam is five to eight wt %. By gradually increasing the propellant proportion, the desired open-cell proportion can be approached. The propellant that is entrapped in the closed cells of the foam does not stay there. It diffuses outwards through the cell walls, whilst ambient air diffuses inwards through the cell walls. The diffusion processes take time. Usually, the utilization of such foam products is postponed, until the diffusion processes are largely completed. The open cells have holes in the cell walls through which the initially present propellant is very quickly replaced by ambient air.

However, the air that is locked-in afterwards is also pushed out of the cells by mechanical deformation of the foam when used as a yieldable layer. This better facilitates the deformation in comparison to closed-cell foam. There, the air remains locked-in and the cell walls must or should stretch in order to yield to the pressure.

In one possible embodiment, the open-cell proportion is limited to a maximum of fifty percent, in another possible embodiment sixty. This means that there are still so many closed cells in the foam, that the foam quickly returns to its original shape when released.

The yielding material and/or the reinforcing material can also be stacked in several layers. When doing so, the yielding material and/or the reinforcing material can vary from layer to layer, or remain the same.

A variation of the yielding material may be required and/or desired if a layer of yielding material is also designed to function as a damping layer. A damping layer differs from common foam-plastic, in that it does not rebound/recover promptly, but rebounds/recovers with a considerable delay after having been compressed. This damping characteristic for example, prevents and/or restricts and/or minimizes both the packaging and the packaged product, to start vibrating after a fall. The vibration can lead to bouncing, leading sensitive float glass to not only be impacted by the fall, but also by bouncing on and hitting the ground as a consequence. An open-celled foam layer as described above has these desired damping characteristics.

By choice, the reinforcing material can cover the yielding material, or vice versa. Alternatively, the reinforcing material can protrude into the yielding material, or vice versa.

If the packaging is produced in sections it may be possible, in the situation of two or more adjacent sections, to have one section hook into or connect to the other. This can also be used to connect the packaging sections in a longitudinal direction. Furthermore, it can be used to connect adjacent packaging units. The connection can be fixed or detachable.

The connection can be made using spigots or pins. The spigots or pins may be formed onto a packaging section and engage into corresponding openings of the adjacent packaging section that is to be joined. Separate spigots or pins can also be used, which engage into opposite openings of two adjacent packaging sections. Use of multiple pins also prevents, restricts, or minimizes the packaging sections from rotating against each other. Eccentric spigots or pins may also prevent, restrict, or minimize rotation of the packaging sections against each other. Moreover, spigots, whose cross-section differs from a circular cross-section (for example, a square cross-section), also prevent, restrict, or minimize the rotation of the packaging sections. By creating a rotation-proof connection, the characteristics of the interconnected packing sections resemble the characteristics of a one-piece packaging section with the same length as the interconnected packaging sections.

This can be further achieved if the spigots and pins are fixated in the corresponding packaging sections.

This can be achieved by using bulged spigots or pins, resulting in a pressure-fit in the corresponding packaging sections. Optionally, the bulged spigots or pins can engage in the undercuts of the recesses in the corresponding packaging sections.

In the above version, it is possible if the edge of the cargo that needs to be protected or should be protected is first covered with yielding material and is then combined with reinforcing material, placed at a distance from the edge that needs to be or should be protected. The reinforcing material and the yielding material can simultaneously or substantially simultaneously wrap around each other, or interlock with one another. The cross-section of the yielding material is possibly formed as a symmetric profile body, which comprises at least one reinforcing profile in an opening. Optionally, two reinforcing profiles fitting in two openings are prevised, positioned inside the edge-protection profile within a certain distance of each other.

In one possible embodiment, the reinforcing profiles allow packaging profile sections made from the yielding material to be threaded onto said reinforcing profiles and connect in this manner. Alternatively, the packaging profile sections may also be arranged behind one another and the reinforcing profiles pushed through the openings in the packaging profile sections.

It is also possible to use foam-plastic for the reinforcing profiles. The required and/or desired strength for the reinforcing profile is obtained by using foam-plastic that has a higher density, and/or by creating an outer skin or mantel on its surface. A skin or outer mantel is created when the outer surfaces are heated to such an extent that the foam cells closest to the surface collapse. To realize this, rapid heating is possible. It is also possible for this technique when the foam-plastic has a very low thermal conductivity. After the cooling, the outer skin or mantel results in considerable stiffening of the outer surface. Cooling can be accelerated using the right aiding equipment. Optionally and instead of creating an outer skin or mantel as above, the foam plastic reinforcing profile can also be stiffened through laminating or coating. Unexpanded foils or textiles are suitable to use as a coating. Foils and textiles made of plastic are favorable for use in laminating onto the reinforcing profiles. The present application considers both welding and gluing as a laminating process. However, metallic foils can also be laminated onto foam-plastic profiles. An adhesive may be used to bond the metal with the foam-plastic. Laminating processes may be known.

Plastic foam, with a strong outer layer and the same yieldability as the yielding material, can become a reinforcing material in itself.

Plastic foam, with a strong outer layer and the same yieldability as the yielding material, can become a reinforcing material in itself. The foam-plastic, as prevised for the yielding material, can for example be polystyrene foam with a density of twenty-five to forty kilogram per cubic meter. The polystyrene foam can be commonly used foam, with a closed-cell proportion of at least ninety-five percent, based upon the number of cells. To achieve a higher damping ratio, the foam could be more than ten percent, in one possible embodiment at least twenty percent and in another possible embodiment at least thirty percent open celled, based on the number of cells.

In at least one possible embodiment of the present application, the packaging covers the protected edge of the cargo in a U-shape, so that the edge-protection of the present application not only absorbs forces that occur in the plane of the disc-shaped or plate-shaped cargo (for example glass), but also absorbs forces exerted diagonally thereto.

To withstand the forces that occur diagonally to the plane of the disc shaped cargo, the reinforcing material may have the same or a similar shape as the packaging.

The present application has recognized that adequate protection is already achieved when the reinforcing material is positioned crosswise to the disc-shaped cargo and extends beyond the cargo, whilst staying connected to the cargo through the yielding material.

In this sense, wooden profiles that have a rectangular cross-section (roof battens with a cross-section of thirty by fifty millimeters or forty by sixty millimeters) may be sufficient for the edge-protection of the present application. At the same time, the desired connection between the yielding material/foam and the reinforcing material/wood is in one possible embodiment achieved by embedding the wood profiles/reinforcing material in the yielding material. In this, the yielding material can act as the part that encloses the edge that the packaging needs to or should protect.

The reinforcing material may be connected to the yielding material in a fixed manner. As with the above mentioned wooden profile, it, or a reinforcing profile made from an organic or inorganic or a plastic or metal material, can also be seated loosely inside the packaging.

Instead of the described reinforcing profiles or in addition to the described reinforcing profiles, it also lies within the scope of the present application to use a different kind of reinforcement. In one possible embodiment, the alternative reinforcement is realized through the already described process of creating an outer skin and/or lamination using foils and/or textiles. The scope of the present application also foresees that reinforcement is realized by wrapping the yielding material in foils or textiles.

Optionally, the yielding material and/or the reinforcing material can be composed of different parts. This has already been described for various materials that can be used to create the reinforcing material. However, the yielding material may be composed of separate parts as well.

A design with multiple parts can be used, regardless of the materials used. The design comprising multiple parts can be used to combine different kind of materials, or in order to gain economies of scale.

With large series, economies of scale will be achieved when the edge protection is manufactured in one piece.

With smaller series, economies of scale are realized when, for example, in creating the edge protection, profiles of a different widths/thicknesses/heights are connected together. In at least one possible embodiment, the same profiles are used in combination with adapter pieces that fill out the difference in width/thickness/height.

In at least one possible embodiment of the present application, the system can be applied using different cross-sections, such as round-, angular-, and rectangular-, square-, and other triangular-, angular, and polygonal cross-sections. Alternatively, the system is also applicable to individual profile-sections. Each profile cross-section can be put together using several profiles. In this case, the profiles of which the ends show a cross-section can be referred to as side-profiles and the profiles forming the fitting pieces between the side-profiles are referred to as center-profiles. The profiles may be identical or they may differ from one another.

This allows identical or different side-profiles (profiles that in the packaging constitute at least one outer side) to be used with identical or different center-profiles. The center-profiles can be identical too and still be combined with different side-profiles to create a complete profile.

The same applies to inner-profiles, outer-profiles and other center-profiles.

As required and/or desired, the different profiles are connected together in a permanent or detachable way. In one possible embodiment, welding or gluing is used to create the permanent or substantially permanent connection. In one possible embodiment, pushing the profiles into each other creates the detachable connection.

Applying this technique to foam profiles means that welding or gluing connects the initial starting profiles to form an overall final profile that serves as an edge-protection.

When welding, the welding surfaces must or should be melted. When melting of foam surfaces takes place, it has to or should be taken into account that, depending on the duration of the process, more or less cells will collapse at the welded surface and therefore a reduction in thickness must or should be taken into account.

The reduction in thickness is compensated by using thicker start profiles, so that the resulting overall profiles obtain the desired dimensions. The correct initial dimension can be determined with a few tries. The necessary and/or desired heating of the welding-surfaces is achieved through contact with heated welding tools, but can also be achieved using heat radiation or hot gas. When using hot gas for welding, even surfaces that are positioned awkwardly can be easily reached.

When gluing the start profiles, various adhesives can be used.

With adhesives, including hot melt adhesives, melting of the adhesive/connecting surfaces of the start profiles is prevented, restricted, or minimized, as long as the application temperature of the adhesive remains below the melting temperature of the yielding material. Large adhesive-strength may be achieved with reactive-adhesives. However, reactive-adhesives are often more expensive than other adhesives. Hot melt adhesives are inexpensive and have proven themselves time and again. In addition, gluing has the advantage that materials that are difficult or impossible to weld, can still be joined together.

This is for example the case when plastic needs to be or should be connected with metal. It increases the freedom of design.

Another example concerns the adaption of the edge-protection to accommodate different thicknesses of the disc-shaped cargo (for example glass). Optionally, a recess in the edge-protection is prevised for perceivably the largest thicknesses of cargo that requires and/or desires protection, so it can envelop the edge of the cargo that needs to be or should be protected. Optionally, an insert in the recess for the edge that needs to be or should be protected (for example, the glass edge) is prevised for thinner cargo. The insert fills out the recess in such a way that the edge-protection may be placed tightly over the edge of the disc-shaped cargo, or vice versa, the disc-shaped cargo can be inserted tightly into the recess of the edge-protection.

Optionally, the recess in the edge protection that holds the edge is created in a stepped manner. The opening in the edge-protection tapers, from its widest, by at least one additional step, so that the recess can at its widest accommodate, for example, glass-sheets with a thickness of eight millimeters, whereas the next step can accommodate a glass-sheet with a thickness of six millimeters.

The reinforcing material may also be made of foam-plastic. In that situation, the foam for the reinforcing material possibly has a greater density than the foam used for the yielding material, in one possible embodiment greater by at least twenty percent, and in another possible embodiment by at least forty percent.

Optionally, the reinforcing material can also be produced by creating an outer skin or mantel on the surface of the foam yielding material as described above.

The foam used as yielding material is melted along at least one side, so that the foam collapses. The resulting outer skin is largely unexpanded and gives the edge-protection its desired strength. When using extruded foam-plastic profiles for the edge- protection of the present application, it is possible to use an extrusion-die with a downstream calibrator, wherein the calibrator reproduces the shape of the desired profile in a way that part of the outer surfaces of the yielding material that form the profile strand, may remain untreated. In the finished packaging used for disc-shaped cargo, these should at least comprise the side-surfaces and the outer-surface. On these untreated surfaces, this resulting so-called extrusion skin may already be sufficient as a reinforcement of the yielding material. The propellant-laden melt, exiting the extrusion-die of the extruder, foams to form the plastic foam part.

The volume increase resulting from the foaming process is thereby limited to the point where the melt contacts the temperature-controlled surfaces of the downstream calibrator at which point an extrusion skin is formed. The foaming process stops there, even though the foaming process inside the exited melt-strand can still continue for a little while, thereby influencing the distribution of the cells and their sizes and shapes. Depending on the temperature control (meaning the temperature control inside the calibrator), this creates an extrusion skin with a much greater density than the inside of the finished profile strand and/or results in a unexpanded skin layer.

The possibilities of skin extrusion are known.

The type and thickness of the extrusion skin can be adjusted with just a few tries to match the desired reinforcement of the flexible layer. During the manufacturing of the foam-plastic, it is not necessary or desired to take into consideration that the side of the foam-plastic profile constituting the flexible layer, has the better yieldability and must or should therefore be free from extrusion skin. The extrusion skin can easily be removed afterwards. This is common in foam-plastic products. The extrusion skin is regularly milled and the resulting waste recycled. The present application uses or removes the material layer resulting from the extrusion as reinforcement, as required and/or desired.

As long as the quantities necessary or desired for extrusion of the profiles of the present application are not achieved, it might be appropriate to produce the profiles from commercially already available products, such as foam-plastic sheets. In that case, a desired reinforcement can be realized by applying a skin to the desired surfaces. To achieve this, the surfaces that need to be or should reinforced are melted by means of required or desired heating. This creates a reinforcing skin on the desired surfaces. The heating can be done using hot air or hot gas. Heating of the desired surfaces can also be achieved by bringing them into contact with a heated object. Suitable objects for heat transfer are for example heated rollers. To the extent that the resulting foam-plastic strand, comprising grooves as described hereunder, is covered by an extrusion or subsequently applied skin, the skin may be milled in the same way as in the space prevised for holding the cargo. Instead of milling, other mechanical shaping processes to remove the surface tension such as sawing might be considered as well.

As an alternative to machining, the calibrator can be prevised in such a way that a groove is shaped including a surface skin, which would contribute to the reinforcement. However, this requires or desires considerable rounding of the cross-section corners of the groove for manufacturing reasons. This rounding however, can be used as an extra possibility in that it increases the tear-resistance of the groove in the foam-plastic strand. If sharp corners are desired nevertheless, the corners can be machined. If machined shaping is limited to the corners, the extrusion skin in between the corners can remain, thereby positively contributing to the reinforcement.

Instead of or in addition to the extruded foam-plastic strands as described above, the foam-plastic strands/profiles can also be made of particle foam. Particle foam results when particles with a conventional particle-size of one-half to twelve millimeters, in one possible embodiment two to five millimeters, combine inside a molding machine. The foam particles are usually produced in large-scale autoclaves through polymerization of suspended plastic monomers by applying pressure and heat.

Thereby the particles agglomerate. At the same time or later, the particles are loaded with propellant so that the particles, upon exiting the autoclave, foam (expand) into foam-plastic particles. These particles are available in large quantities. One of the major suppliers, BASF, offers the particles in various grades and dimensions, amongst others under the well-known brand Styropor.

In one variation, the finished particles connect together in high-volume molding machines, to form blocks. This is done through steaming, using superheated steam.

The heated steam causes the particle-surface to melt. Simultaneously or substantially simultaneously applied pressure welds the particles into blocks. If the applied pressure and/or temperature in the welding process is too low, it usually still makes the particles stick to one another. Customarily the resulting blocks are cut into sheets, which are used for insulation purposes in construction. Generally, the blocks are cut into sheets using saws.

As long as the quantities are such that special production is required or desired, the desired foam-plastic strands/profiles can be cut from the commercially available particle foam panels. For larger quantities the purchase of molds, with a mold cavity reflecting the desired shape of the profiles, is justified. As an option, in such molds an outer skin can also be created, by heating the desired surface areas of the mold. The heating in one possible embodiment takes place after applying superheated steam onto the particles, in order to weld them together.

Other than that, the subsequent creation of an outer skin can be realized in the same way as with the profiles made of extruded material. That is, an outer skin can be created in the same way as described above by melting the desired surface areas.

In at least one possible embodiment according to the present application, cutting of at least the extruded sheets, in another possible embodiment also of the particle foam sheets and in yet another possible embodiment also of blocks of foam-plastic, is achieved by using a heating-wire. The heating-wire is in one possible embodiment electrically heated to a level where the foam-plastic will melt upon contact. This process can be used for cutting foam-plastic.

This cutting technology can also be used for the cutting of blocks into sheets and/or to cut strands from the sheets as described above. However, the cutting technique is relatively slow compared to cutting through sawing.

The present application uses this cutting technique for the creation of an outer skin, when the temperature of the heating-wire is increased and/or a thicker wire is used. A hotter and/or thicker filament will melt much more material in comparison to a conventional wire-cut, so that within a few tries a skin or outer skin is created, corresponding to the strength described below or corresponding to the strength of the reference foils.

Optionally, foam-plastic strands made of particle foam, which according to the present application are to serve as the yielding material, can also be produced in a molding machine, also with an outer skin. Relatively simple molds already suffice for the foam-plastic strands. That is, the molding machine produces molded parts that have the same shape as those created by the above described cutting out of blocks.

For this the molding machine has a different mold cavity in comparison to the molding machines used for the production of blocks of particle foam, as described above. The cavity will be much smaller, corresponding to the desired volume of the foam-plastic strands. To create an outer skin on the surface of the molded part, the mold-surfaces are temperature controlled in those places where the outer skin is required and/or desired. To control the temperature, the corresponding walls of the mold have cavities that allow temperature influencing substances to flow through the walls of the molding machine so that the walls may be heated or cooled as required and/or desired, making it possible to heat the foam particles at the desired spot to such an extent that melting and outer skin formation takes place on the surface of the molded part whilst inside the mold.

To accelerate the cool-down of the molded-part to its exit-temperature once the outer skin is created, it is effective to cool the walls of the molding machine. To realize this, coolant can be directed into the cavities of the walls of the molding machine.

The creation of outer skins or outer mantels on parts shaped out of particle foam in molding machines are known.

In the procedures described above, the objective is to create an outer skin or mantel, which in one possible embodiment results in at least the same reinforcement as with an unexpanded foil of 0.3 millimeters thickness (reference-foil thickness) that comprises the same plastic as the yielding material. In another possible embodiment a reference-foil thickness of at least 0.6 millimeters may result and in yet another possible embodiment a thickness is prevised of at least 0.9 millimeters.

By combining it with an additional foam layer, the reinforcing-skin produced by the outer skin formation can be positioned to be on the inside of the edge-protection.

Again, welding or gluing can be used to create the desired connection. The stability of the edge-protection may require and/or desire the creation of an outer skin on at least two opposite surfaces of the foam layer. The greater the distance between the two opposite reinforcing-skins, the greater the resistance behavior against bending.

However, the additional foam layer, arranged to be positioned on the inside of a skin/layer formation, can also be placed loosely against the skin. This is for example the case when the above-described insert (to accommodate different edges that need to or should be protected) is simultaneously or substantially simultaneously used as such a foam layer. For this, it is possible, when a U-shaped foam layer encases the insert.

Alternatively, the foamed-plastic can be given its desired strengthening-skin using a laminated foil or fabric. To laminate the foil or fabric, the proposals for creating an outer skin or mantel as described above apply accordingly. That is, foil or textile laminations are possible, in one possible embodiment on two opposite surfaces. An inner layer, made of a foil or fabric, can also be produced with the help of a further foam layer. The inner layer is formed when a foil or fabric is sandwiched between two foam layers. The foil used can be an unexpanded or expanded foil. Other conditions remaining the same, if they have a higher density, the expanded foils can have greater strength compared to other sections of foam-plastic.

Suitable textiles include non-woven fabrics, woven fabrics, knitted fabrics and braided fabrics. In one possible embodiment, fabrics are applied with low elongation in at least one and in another possible embodiment two directions. One possible embodiment may include mesh fabrics, with threads in the fabric positioned diagonally towards each other and as straight as possible. Further possibilities arise when the mesh fabric is put onto the packaging in such a way, that the threads align in the principal stress directions. The principle stress directions of a disk shaped cargo, packaged in a frame-like packaging, are viewed as being the components extending along an edge of the packaging.

The mesh fabrics are put onto the package or are lead around the package in such a way that the one threads run parallel or substantially parallel to the longitudinal edge and the other threads run parallel or substantially parallel to the adjacent, diagonal standing edge. Each blow to the packaging causes an indentation in the packaging. In this case, the mesh fabric absorbs a substantial part of the load and distributes the load across a large area of the packaging through the length of the threads; this distributes the impact energy over a large area, preventing a bundled load on the edge that needs to or should be protected.

Even if the distribution of the impact energy onto the packaging is better with laminated textiles comprising non-straight threads, than for packaging without laminated textiles, the distribution of the impact energy with straight-threads in the mesh fabric is significantly better again than with non-straight-threaded fabrics.

The edge-protection of the present application is used as a frame around the disc-shaped cargo that needs to be or should be protected, for example the glass-sheet. It is possible to assemble the circumferential edge-protection in sections. For straight edges, uniform profiles can be used as edge-protection, cut to length from one initial profile as required or desired. The required or desired quantity is obtained from the lengths of the straight edges of the cargo, for example a glass-sheet. If required or desired, the edge-protection sections for straight edges can be combined with edge-protection sections for curved edges.

The curved edge-protection sections can be produced in smaller numbers as special production; with greater numbers it will be worth it to produce the edge-protection of the present application directly with the integrated appropriate curvature.

The length of the sections of the edge-protection depends on:

a) Whether, for cargo such as a glass sheet, the sections at the corners of the edge-protection directly abut one another, whilst spanning the edge requiring protection from one corner to the other as one single profile, whereby a difference must or should also be made between corners where the edge-protection is jointed in a blunt manner and corners where the edge-protection is miter jointed or, b) Whether the sections at the corners of the edge-protection for the cargo abut against a corner piece, whilst spanning the total length of the edge that needs to or should be protected between the corners, from corner piece to corner piece as a single profile or c) Whether the sections in a) and b) are divided into further sections. This may be referred to as a modular concept, in which the modules can be combined with each other in any way and, where appropriate, with adapter pieces.

The length of the sections has a significant influence on the nature and scope of the production. The more production by the piece is required and/or desired, the more complex the production will be. The present application makes a distinction between the corners and the area between the corners. In the case of a modular composition of the packaging according to the above variant c), the aim is to compose the packaging between two corners/corner pieces of as many equal sections as possible.

Equal and differing corner pieces can be applied. The corner pieces can enclose a straight angle or any other angle between them. The corner pieces might also have legs of different length. The corner pieces may also form the connection for differently shaped packaging pieces, for example for curved and straight packaging pieces/sections.

Based on a single packaging for a rectangular-shaped disc form, there are two sides of equal width and the two sides of equal length may be composed using the width-sides added to which is an additional fitting piece. The length of the fitting piece will be equal to the difference in length between the width-side and the length-side measurement. These fitting pieces are different from the fitting pieces that are provided as center-profiles for a packaging profile cross-section, as described above.

Based on a single packaging, the difference between the modular composition as described above and the special production of single packaging pieces for the length-sides may be small. However, when multiple packagings are considered that differ from each other in their width- and length-side, the possibilities of the modular composition become clear. In fact, the higher the number of packagings with different width- and length-sides, the bigger the advantages become. The extent of the advantage created by using identical sections depends on the method of production and the design of the sections.

The system of the present application is also applicable to packaging with different sides.

According to the present application, when multiple packaging whose wide-side lengths and long-side lengths differ are considered (except for the extreme case), the length-sides as well as the width-sides of a packaging are put together with bluntly abutting sections, allowing for at least one equal section-module to be used for each packaging side. Depending on the length of the width- and the length-side, multiple section-modules can be used on each side as well. To the extent that a section on one side remains open, for which another section module is too big, a fitting piece is used instead of another section-module. When very small fitting pieces are required or desired, it may be useful to use a fitting piece, which has the length of a section-module plus the length of the otherwise required or desired very small fitting piece.

These very small fitting pieces have a possible length that is less than 0.5 times the thickness of the section-module (in the case of different thicknesses the thickness is averaged), in another possible embodiment a length that is less than 0.25 times the (average) thickness of the section-module.

The extreme case with large numbers of section-modules and fitting pieces as described above, occurs when the section-module is of the same length as the width-side of a packaging.

The above considerations apply to the section-modules and fitting pieces on all sides of the packaging forming the length between the corner-forming sections that need to or should be mitered-cut at their abutment-point. At the same time it is also possible to use the corner- forming sections simultaneously or substantially simultaneously as fitting pieces.

Because of the special situation during shock impact at a corner, additional fitting pieces are possible so that the corner-forming fitting pieces can remain untouched. The same applies if special corner-pieces are to be used at the corners and the sections abut the corner pieces.

For longer width-sides of a packaging, several section-modules per width-side can be used. In that situation, the various sections have the same length, except for one fitting piece. For the longer length-sides, which are always larger than the width-sides in a rectangular shaped disc, there is even more variation in the number of section-modules used for larger width-sides.

The reinforcing profiles/reinforcing materials on a side of the packaging possibly serve as a guidance and holder for the various section-modules and fitting pieces. The reinforcing material (forming the reinforcing profiles) extends from one corner of the disc-shaped cargo (for example, the glass-sheet) to the other corner of the disc-shaped cargo. Optionally, individual reinforcing profiles can also extend beyond. In one possible embodiment, this applies to the reinforcing profile at the lower end of the packaging. The various sections can simply be threaded onto the reinforcing profile, which provides the desired guidance and support.

This has exceptional economical possibilities for the production of small series, because this can reduce waste: the sections, intended as yielding material for small series, are expected to be cut to length from a commercially available base material. The base material can comprise commercially available extruded foam-plastic sheets, particle foam-plastic sheets or extruded foam that is cut into material bars. The desired sections or section modules can be cut to length from this material bar. In most cases a rest-material remains, but according to the present application, it is not necessary or desired to dispose of this rest-material as it can be used instead with other rest-materials and/or other sections as yielding material, without causing a substantial loss of functionality. These rest-materials, together with other rest-materials and/or other sections, are threaded onto the profiles that form the reinforcing material. Alternatively, the profiles can be pushed into the sections.

The described rest-materials can also comprise returned packaging components. Depending on the design and value of the packaging, a packaging can be disposable or reusable. With reusable packaging however, some wear and some damage to the packaging is to be expected. The worn and damaged parts of the packaging are in one possible embodiment separated, whilst the remaining parts are possibly treated as rest-material in the manner described above.

The same applies if there are delivery problems. Returned packaging components can then be used to make up for missing parts of the new packaging.

If the cargo has the same dimensions, a returned, undamaged packaging can be readily shipped again with new cargo. The present application has recognized however, that a large part of the cargo transported, such as flat glass, has made to order dimensions. Upon the return of such packaging, simply reusing the packaging is then not be possible.

The packaging, made out of packaging sections in accordance with the present application, provides a possible solution for reuse, because it allows for the returned packaging to be dismantled. The resulting sections and corner pieces can be reused to construct new packaging for different sized cargo, or combined with new sections to construct new packaging for different sized cargo.

For one-way packaging, problem-free disposability is an important aspect. The disposability depends very much on the plastic used. For example, polyethylene (PE) can be burned without any problems. The same applies to polystyrene (PS). Whereas polyurethane (PU) and polyvinyl chloride (PVC) require or desire an expensive, elaborate type burning, or an elaborate flue gas treatment, or expensive disposal as hazardous waste. At the same time, cost-considerations make that economically favorable commodity-plastics should be considered.

For reusable packaging the situation is different again. Here one can also use a better plastic such as polypropylene (PP), which has better mechanical properties than polyethylene and polystyrene. Even commodity plastics such as PU and PVC are suitable, because their costs are distributed over a multitude of packaging operations. However, the use of relatively complex plastics requires or desires that for a reusable wrapping of the cargo, the wrapping itself can be removed from the cargo after transport in a way that makes reuse possible. Removing the foam-plastic from the cargo can be simplified by an intermediate means of separation, such as a layer of silicon-paper.

Back to one-way packaging with a wrapping of the cargo made from PE and PS particle foam: Not only are both inexpensive, but they can also be processed at low temperatures as particle foam and extruded foam and appear to be compatible with cargo such as glass-sheets. However, when manufacturing the packaging using particle foam, the steam-management requires or desires special attention. Heated steam is used to bond the particles in a mold together. In common molds, the heated steam is fed in from one side and sucked out on the other side. If the constructional design of the mold and/or inserts in the mold interferes with the steam-flow through mold, the weld between the particles may be affected.

By choice sufficient steaming is nevertheless essentially ensured or promoted: Steam enters through the wall of the mold into the mold itself. To make sure that the steam is not obstructed by the cargo in such a way that a disturbance in the vapor management occurs, the wall can be steamed in sections, with next to each surface-section where heated steam is fed in, a surface-section where the heated steam is sucked out. The sucked out steam has transferred its warmth to the particle foam. The steam is applied in bursts over a predetermined time period. The steam fed to the wall-section stops and instead this wall section is now used to suck out the steam. At the same time within the adjacent wall-section the sucking out of the steam stops and steam starts to be fed in. For this procedure, every surface-section is in one possible embodiment equipped with both steam nozzles and suction openings. The, in one possible embodiment insulated, conduits leading to the steam nozzle, are different from those leading to the suction openings. This prevents or restricts the steam nozzles and their supply conduits from cooling down too much after the steam burst, which could result in too low a steam-temperature for the next steam-burst.

If required and/or desired, the alternating steam-bursts and suction-operations on the adjacent surface sections are repeated several times in order to essentially ensure or promoted that the desired bonding of the particles in the mold is achieved. The duration of the steam-bursts, the steam temperature, the steam pressure, the suction-strength, the size of the surface sections of the mold, the number of surface sections, the size and the density of the particles and the number of steam-bursts are optimized through a number of trials.

To control the dosage of the steam-bursts and suction-operations, adjustable/controllable operation valves are provided in the supply- and suction conduits of the different surface- sections of the mold.

In at least one possible embodiment of the present application, using the mold-walls as surface-sections for the supply of heated steam and/or for the withdrawal of heated steam makes it possible to directly foam-in the cargo with particle foam. For this, the cargo is placed into the mold and the remaining cavity filled with foam particles, which are subsequently bonded together by applying heated steam. As the cargo, the glass has such a high heat-resistance that the heated steam will not damage the glass.

The above coating/wrapping of objects with particle foam can also be used on other objects, besides the packaging concerned.

According to the concept as described above, the cargo can be fully or partially wrapped in a yielding material.

After the foam-plastic covered cargo has formed itself, reinforcing the foam-plastic layer can be realized in the manner described above a) By creating a skin or outer mantel b) By laminating additional layers that cover the full-surface or partial-surface c) By welding or gluing foils or tensioned fabrics with the foam-plastic covering the full- surface or a partial surface c) By wrapping the full- or partial surface loosely with fabric or foil, tensioned with strapping, a tensioning-band or a lashing-strap For details on creating a skin or outer mantel we refer to versions above. The same applies to full-surface or partial-surface laminated layers. It is also explained how welded or glued foil or textile and their tension effectuates a reinforcement of the foam-plastic layer, for example when it concerns holding the sections of the packaging together. According to the present application, the wrapping of packaging with cargo in a loose foil or loose fabric is achieved, by connecting the overlapping foil-ends or fabric-ends. Overlapping foil ends are in one possible embodiment welded or glued.

Depending on the nature of the fabric used, overlapping fabric ends can also be welded. In practice, fabrics made of glass fibers are not welded. In practice, fabrics made of organic fibers are not welded either. However, it is possible to glue different sorts of fabrics. If the mesh openings of the fabric are too large to glue together, it is possible to use close-knit connection pieces.

When of the right nature, the fabrics can be sewn together directly. Instead of sewing, a connection can be made through needling, knitting, stitching, braiding and other known processing techniques for fabrics. If the ends of the fabric are not suitable to be connected directly, connection pieces are again helpful. These may be fabrics with a small mesh size, which can be used as a connecting piece between the two fabric ends of the non-suitable fabric.

According to the present application, by strapping or enclosing with a tensioning band or tensioning strap and use of the optionally prevised wrapping with shrinking-foil or other foil or textiles, the edge-protection, composed of sections and rest-pieces, in terms of the yielding material, will function as an edge protection extending from one corner of the packaging to the other as one piece.

The connection of an edge-protection section made according to the present application to protect the required or desired edge, can be realized at the ends where the one edge protection section meets the other edge protection section.

The connection may be realized with the reinforcing profiles.

The reinforcing profiles can be connected together with conventional screws and nails. The reinforcing profiles can also interlock at the corners of the edge that needs to or should be protected, so that the use of screws and nails or the likes to make the connection becomes, completely or partially redundant. The ends of one reinforcing profile can interlock through spigots or hooks with openings or eyelets at the ends of the adjacent reinforcing profile.

It is possible that the eyelets and openings are located on the vertical reinforcing profiles whilst the spigots and hooks are located on the horizontal reinforcing profiles. Hooks may feature on both the vertical and the horizontal reinforcing profiles and interact with openings or eyelets in the adjacent reinforcing profile, without the risk of unintended loosening of the connection.

With adequate strapping, any additional connection of the edge-protection at the ends of the reinforcing profiles can become redundant. The same applies if the packaging is held together with a tensioning-band or a tensioning-strap. The same also applies when a foil or a textile with the same functionality is provided as a wrapping around the packaging. Then, the individual sections of the edge-protection may loosely abut each other at the corners of the edges requiring protection. The ends of one section can bluntly abut the ends of the other section. The ends can also be mitered-cut and loosely abut each other. Strapping or enclosing with a tensioning-band or tensioning-strap then forms an adequate connection for the entire edge-protection. A blunt joint is usually the easiest and most economical joint. A mitered joint may cause significant rest-material, which cannot be used afterwards.

When using the possible economical wooden profiles described above, as a reinforcing material, a method can be used for small series and without the support of auxiliary devices, that leads to a reliable determination of the length of the reinforcing profiles and the yielding material threaded onto or otherwise attached to it. Starting at the corner of the edge requiring protection, the end of an edge-protection section is placed bluntly against the adjacent end of the adjoining edge-protection section.

With two mutually perpendicular or substantially perpendicular edge-protection sections this is in one possible embodiment done in such a way that the edge-protection section, whose other side abuts the other edge-protection section, is flush with its front surface against the outside of the abutting edge-protection section.

Then, this flush fitted edge protection section, which corresponds with an adjacent corner of the cargo at its other end, is cut to such a length, that this end bluntly abuts the protruding end of the next edge protection section. This blunt joining of the ends is repeated as done before. This continues until the cargo (for example the glass-sheet), is enclosed with an edge-protection frame along the edges that need or should to be protected. The same method can be used when, instead of the wooden profiles, other materials are used as reinforcing material. These other materials, as described elsewhere, can for example be metal, plastic, other organic material or inorganic material. Metal is in one possible embodiment used for sheets of stone and similar packaged goods/cargo with a high weigh and relatively low strength.

The connection of the edge-protection sections at the corners of the packaged good/cargo (for example glass-sheets) may be enhanced by special corners/corner pieces that also cover the reinforcing profiles.

One part of the corners/corner pieces covers a length of one of the edges requiring protection, (for example the edge of the glass) whilst the other part covers a length of the other adjacent edge that requires or desires protection.

The corners/corner pieces can be of the same nature as the other yielding material of the edge-protection sections.

The corners/corner pieces can also be of a higher strength, in order to fulfill additional requirements for the connection of the edge-protection sections at the corners of the edges that require or desire protection. Additional strain arises from strapping, or from a tensioning-band or by a tensioning-strap. The strapping, tensioning-band or the tensioning-strap must be or should be pulled around the corners causing proportional deformation. This causes an additional strain on the corners/corner pieces. It can damage or deform the edges in a way that the yielding behavior is no longer guaranteed or promoted to be the same as it is in other places of the edge-protection. To avoid, restrict, or minimize this, an edge-protection made of foam-plastic can be provided with a higher density, and/or skin formation, and/or laminated foils, and/or laminated fabrics.

Optionally, a fixed corner-protection at the corners/corner pieces, made of yielding material, can be used. The corner-protection can be made of metal or plastic. The corner-protection can be glued or laminated on. The corner-protection can also rest loosely on the corners/corner pieces and be held in its protective position by the strapping, the tensioning-band, the tensioning-strap or by the foil or textile wrapping. The corner-protection also has advantages when the edge-protection of the present application is used without the above mentioned special corners/corner pieces.

For disc shaped cargo such as glass, the corners/corner pieces have two connection-surfaces for edge-protection sections or for reinforcing profiles.

In one possible embodiment, the edge-protection of the present application is also applicable to cargo/packaging goods that, unlike glass-sheets, have a larger three-dimensional expanse. In that case more connection-surfaces for edge-protection sections, for example three, will be provided for edge-protection sections or for reinforcing profiles. In the situation of two connection-surfaces, the edge-protection sections and the corner/corner piece lie in a plane. In the situation of three connection-surfaces, the third connection-surface is connected in such a way that the associated edge-protection section stands perpendicular or substantially perpendicular to the plane of the other two edge-protection sections. This for example allows packaging of cuboid cargo in accordance with the present application whose thickness is so large that one can no longer refer to it as a disc. When disc-shaped, square cargo is considered, using the corners/corner pieces will require or desire four such corners/corner pieces. With cuboid cargo, which can no longer be referred to as a disc, there are eight corners/corner pieces.

The corners/corner pieces are in one possible embodiment at least partially provided with ongoing openings for the reinforcement profiles that act as the reinforcing material.

The ongoing openings have the possibility that they are easily fabricated. In addition, adapting the roof battens (and other similar reinforcement profiles) to their required or desired length becomes easier when the roof battens are abutted bluntly at the one end as described above, whereas the other end which protrudes through the corner/corner piece can be cut off for example by using a saw.

Blind holes can also be provided in the corners/corner pieces for the reinforcing profiles. When used in conjunction with corners/corner pieces with blind holes, it is possible to specify the length of the reinforcing profile in advance.

When implemented as above, the reinforcing profiles can be connected together at their ends, but may also loosely abut one another. If they loosely abut one another, the edge-protection sections are in one possible embodiment held in their functional position by strapping, or a tensioning-strap or a tensioning-band. For edge-protection sections, whose reinforcing profiles are held together with screws, nails, hooks, spigots, eyelets or notches, strapping or a tensioning-strap or tensioning-band can be of additional use.

The same applies to packaging with corners/corner pieces, provided with three connection-surfaces as described above:

the ends of the reinforcing profiles can be loosely placed in the corners/ corner pieces and be kept together by strapping, or a tensioning-strap or tensioning-band. The reinforcing profiles can also be connected together in the corners/corner pieces, or be connected to the corners/corner pieces themselves. Even then, the additional strapping, the additional tensioning-band or the additional tensioning-strap can still be beneficial.

Surprisingly, tests have shown that with average loads, loosely abutting edge-protection sections, that are held together by a strapping, tensioning-band or tensioning-strap, already guarantee or essentially guarantee or promote an adequate connection between the edge-protection section and the cargo.

In one possible embodiment of the present application, a strapping, tensioning-band or tensioning-strap tightens edge-protection sections against the cargo-edge that needs to or should be protected. Optionally, multiple straps, tensioning-bands or tensioning-straps are prevised. For disc-shaped cargo, multiple strappings, tensioning-bands and tensioning-straps are arranged side-by-side/parallel/substantially parallel to each other. In one possible embodiment, the multiple-arrangement is used with very wide edge-protection applications. In addition, for large packaged goods and correspondingly large packaging, centrally arranged additional strapping, tensioning-bands or tensioning-straps may be useful as reinforcement. This is true when the frame-shaped packaging is reinforced in the middle. The additional strappings, tensioning-bands and tensioning-straps are then used on the reinforcements and run diagonally to the other strappings, tensioning-bands or tensioning-straps.

With cuboid-shaped cargo that can no longer be referred to as disc-shaped cargo and -as described above- with corners/corner pieces that have three connection-surfaces, one of which is to provide for a diagonal edge-protection-section, the various strappings, tensioning-bands and tensioning-straps can also extend diagonally to one another. Independent of this, reinforcements and additional strappings, tensioning-bands and tensioning-straps can be useful for larger cuboid-shaped cargo as well.

For strappings, tensioning-bands and tensioning-straps it is possible if a recess is provided in the packaging, on the side facing away from the edge requiring protection (for example the edge of the glass), in one possible embodiment in the yielding material. The recess provides a guidance/centering for strapping with the prevised tensioning-band or tensioning-strap. If for other reasons recesses in the outside edges of the edge-protection are required or desired, these recesses are in one possible embodiment combined with the recesses for the bands and straps.

For the strapping technique, the specialist can rely on commercially available technology. These include strapping material, tensioning devices, means for connecting the ends of the strapping material, shears for cutting the protruding ends of strapping material and for cutting the strapping material from a supply roll. The range is diverse. The range comprises complex automated systems for installation in series, mass production streets, as well as simple and inexpensive small handheld devices for incidental strapping procedures.

The strapping material is usually a ribbon/band that is tensioned after being looped around a packaged product. In this respect the band used for the strapping procedure can also be referred to as a tensioning-band; in other words, there is common ground with other tensioning-bands. In contrast to a strapping, tensioning-bands can be tensioned or loosened and tensioned again. For that, tensioning devices/turnbuckles are provided as part of the tensioning-bands. Tensioning-bands are therefore reusable.

Tensioning-straps differ from the tensioning-bands by using straps instead of bands. That is, tensioning-straps have a permanent or substantially permanent tensioning-device and can be tensioned and or loosened and tensioned again. They are reusable.

A strapping can be destroyed and be replaced by a new strapping. Compared with a tensioning-band or tensioning-strap, a strapping used as one-way packaging generally causes much lower cost than the use of a tensioning-band or a tensioning-strap. However, there are Grey areas where the costs of a tensioning-bands somewhat approach the low costs of a strapping. This concerns tensioning-bands made of metal, which are tensioned by a so-called easy-lock. The easy-lock comprises a flattened bow and a rotational slotted bulge. The easy-lock is placed in such a way that the bow slips under the overlapping band-ends with the slotted bulge placed over the end of the band in which the end of the upper tape is inserted, so that rotation of the bulge causes tensioning of the strap. Because of the workload involved, this type of tensioning-band is suitable for small series. To re-tensioning the metal band, it must or should first be bent back. The same applies for reusing this type of tensioning-band.

With tensioning-straps, commercially available products provide similar economical solutions. There are simple tensioning devices with two movable parts, where one part is held in the other. Bands and straps made of plastic are regularly used in this situation. Such straps and bands are available in the market for inexpensive prices. Typically, one end of the band is firmly connected to the tensioning-device. The other strap-end is pulled through the opening split of the tensioning-device.

The movable part of the tensioning-device does not create any obstacles for the tensioning-movement.

However, when the strap-end is released, the strap-end tensions in the opening of the tensioning-device. It is problematic to apply a high tensioning force on the strap by hand. Besides that, the tensioning effect depends on the friction and friction conditions can change significantly, under external influences. Elaborate tensioning devices are required or desired to realize a higher tensioning force and a constant or substantially constant tension not susceptible to external influences.

An alternative is a tensioning device comprising a solid piece of material, with a number of successive openings. One strap-end is fastened to the material-part. The other strap-end is moved back and forth through the openings of the material-part. After tensioning, the inserted strap-end remains in the material-part due to its friction or because of resistance in the material-part, preventing loosening.

Optionally, parts of the tensioning device are connected to a section of the packaging, in one possible embodiment with a corner piece; alternatively the turnbuckle is attached to a section or to a corner piece. This simplifies the tensioning process as one hand remains free, which is otherwise necessary or desired to hold the turnbuckle in position whilst tensioning. With sophisticated turnbuckles, the permanent or substantially permanent attachment of the turnbuckle to a section of the package is a complex measure. This is different for the simplest turnbuckles, as with the previously explained material-part with multiple openings through which the tensioning-strap or the tensioning-band is moved back and forth. Such materials can for example be manufactured from low-cost sheet metal, which can be shaped as required or desired by deep drawing and punching and provided with recesses. With large series, the use of materials such as plastic, in one possible embodiment unexpanded plastic is even cheaper, making the use of injection molds required or desired for production, economically viable.

Connecting turnbuckles to a section/corner piece can be realized by gluing. Suitable adhesives are those that are well known in construction, for example, the polyurethane adhesive.

The above versions for strapping, tensioning-bands and tensioning-straps apply to packaging sections that bluntly abut each other at the corners, as well as to packaging sections abutting against a corner piece, and they apply to packaging sections that abut at the corners with a mitered-cut.

If the ends of the edge-protection sections are mitered-cut, the mitered angle is in one possible embodiment forty-five degrees for perpendicularly or substantially perpendicular jointed edge-protection sections. For edge-protection sections that are joined under a different angle, the mitered-angle is in one possible embodiment equal to half the angle of that which the edge-protection sections enclose between them. For the above versions, the forces that act on the edge-protection during the strapping are greatest at the corners of the edge-protection and may therefore require or desire additional corner reinforcement. Besides the corner load, the corner reinforcement may have other reasons as well: for example, an additional function such as a transport-aid. The transport-aids can add to the edge-protection of the present application. They improve handling and thereby reduce the risk of damage to the packaging and the packaged good/cargo. However, the transport-aids are also possible for other types of packaging, unrelated to the edge-protection of the present application.

The transport-aid can be a handle, a sling, an eyelet, or a hook. The eyelets can serve different purposes. Eyelets are suitable for attaching tensioning means for load securing during transport. The eyelets are also suitable for attaching handles. In one possible embodiment, the eyelets can form, together with a simple accessory, a handle as well. This can be realized with two eyelets placed at a distance and a rod, for example a wooden rod. The rod can connect the eyelets placed at a distance together, so that the packaging, with the enclosed cargo, can be lifted with the rod.

It is possible if the eyelets have an opening wide enough to allow the rod to be inserted through the two eyelets. Together with the eyelets, the rod then forms a handle. A roller is suited as a transport-aid as well. The same applies for forklift-feet, containers, fasteners or connectors for transport securing. The containers are of considerable advantage for various applications of the packaging.

This is true if fasteners/assembly aids/assembly instructions/accompanying documents are to be transported with for example one sheet or a number of sheets of glass. This may be the case when glass parts for showers or building-kits for showers are transported. For the various applications, different sized containers can be made available. The transport-aids can also be made of foam-plastic. The transport-aids can also be made of other materials, and they can be made of a composite of foam-plastic and other materials.

In one possible embodiment, a container is made of unexpanded/minimum expanded plastic, as long as damping of an impact-like load is not required or desired. It is possible to manufacture such containers of the same plastic as the foam-plastic used for the packaging itself and to connect them with foam-plastic components, with which the container engages in the grooves that are provided in the packaging. In that case, the foam-plastic components simulate the cross-sectional shape of the grooves. The foam-plastic can be properly connected to the containers by gluing. Hot glue is a well-known, suitable glue for this type of gluing. The connection can also be welded, provided the container itself and the parts that engage in the grooves have a sufficient match in texture for the welding process.

Engineering the container in various parts is a possible for small series, because common parts can then be kept for various sizes. Such common molded parts will at least comprise those parts that are used to engage the container into the grooves of the packaging. In addition, it may be possible to develop containers with different volumes. This is realized by using tubular containers, which are sealed at both ends by lids and which are selected by choosing the right length to achieve the desired volume. The tubular containers in one possible embodiment have a rectangular or square cross-section in order to facilitate the connection with the molded parts, which engage into the grooves of the packaging.

The transport-aids do not have to be directly attached to the packaging, instead it is sufficient if the packaging has a connection for the transport-aids or allows the mounting of transport-aids. Attaching a transport-aid to the yielding material, and/or to the reinforcing material, and/or to the strapping, the tensioning-band, or tensioning-strap thus becomes possible.

The transport-aids can be mounted permanently or detachable. Such a detachable connection can be formed for example by an exterior and/or interior connection-surface and/or by one or more openings for securing bolts or retainer bolts. It is possible if the transport-aid is slipped over the connection and subsequently secured with a bolt. The various transport-aids may also be integrated into a packaging section. This is the case for forklift-feet and rollers. In one possible embodiment, the hooks may be formed forklike, making it possible to grab the packaging on both sides of the strapping, tensioning-band or tensioning-strap.

In one possible embodiment, grooves are provided in the packaging, for example in the yielding material, in which the transport-aid can be inserted or pressed into with a corresponding tongue. For the tongue and groove connection, a dovetail shape, or a shape derived thereof, is possible. Such connections are very stable, however with limited clearance they can be difficult to handle. Easier to implement are tongue and groove connections where the tongue has a rounded shape, so that the tongue can be pushed into the groove, transverse to the longitudinal direction, and can be pulled out again in reverse. In this case, the groove encloses the tongue; the opening width of the groove must or should be smaller than the diameter of the tongue, for it to enclose the tongue.

The smaller the opening width becomes, the more effort is required or desired to press the tongue transversely to the longitudinal direction into the groove. A few trials will be sufficient to determine the dimension of the opening width of the groove, which allows the tongue to be pressed into the groove by hand within reasonable efforts, whilst at the same time providing sufficient grip in the groove.

The grooves can be machined into the foam-plastic. Suitable methods are, for example, milling and/or sawing. However, the grooves may be pre-formed in the foam-plastic as well. This is realized during production of the foam-plastic.

It is done for example by means of a suitably shaped extrusion-die and a correspondingly shaped calibrator.

In at least one possible embodiment of the present application, rounded corners (both inside corners as well as outside corners) are created in the groove and matching corresponding round corners are realized in the transport-aids that grip into the grooves.

The grooves can also be created when shaping the packaging sections in a molding machine or in an injection mold.

Moreover, non-machined shaping and machined shaping can be combined, in a way whereby the grooves partially originate from non-machined deformation and obtain their final shape by milling or sawing. The grooves of the present application in one possible embodiment run on the sides (front and back) of the packaging sections and on the outer surfaces (including top and bottom) of the packaging sections. In this way, the transport-aids can be inserted into the grooves as desired/required. The rollers are inserted into the bottom, the handles into the side of the packaging at a comfortable height for its user. Forklift-feet or other feet are also inserted into the bottom.

Hooks and spigots can be inserted into the sides; hooks and eyelets not only into the sides, but also into the top. The same applies to connections for securing the load/transport. The eyelets, hooks and spigots may also be used for securing the load/transport. Usually, further load/transport securing is created using tensioning-straps, which can be attached to the eyelets, hooks or spigots.

The containers are used for the transport of cargo accessories. Installation of glass-sheets for example, often requires or desires special angles, rails, seals, screws, dowels, etc. These accessories must or should at least be supplied when the cargo is delivered to the end-user or to the craftsmen appointed by the end-user. The containers may be positioned anywhere on the packaging.

The connectors are for example used to connect multiple packagings together. In one possible embodiment, a connection is made between the packaging parts, which comprise opposite grooves. The various packagings may be arranged in such a way that at least one connection is created between the lower packaging-sections, as well as one between each section perpendicular or substantially perpendicular to the lower sections.

When strapped, a band is placed around the edge-protected-cargo, for example the glass-sheet, after which the band is tensioned with a tensioning device. The tension presses the edge-protection against the edges that need to or should be protected. After tensioning, the band is secured in tensioned position. This can be done by means of brackets, bushings and seals or by welding. In the tensioning procedure, the band is pulled from a roll. After securing, the band used for the strapping is separated from the rest of the band that remains on the roll.

The band can be made of plastic or steel. Plastic band made from different materials such as polyester, PP, PET are known, which can be used for strapping. At all or essentially all times the band must or should or may be able to withstand the force of the tension. Fabric bands made of plastic, such as threadlike structured band, woven band and composite band are the most suitable for this.

In most cases, the strapping tool has grooved tensioners that are used to pull the band ends together and against each other, until a desired tension is achieved. To maintain the band-tension for the duration of the transport, plastics can be used that show a negligible creep-effect and/or show only a negligible creep-effect because they have been treated, for example pre-stretched. Steel bands show no significant creep-effect of their own. The creep-effect describes a deformation of the plastic under high continuous load.

Brackets, clips and seals press the band-ends permanently or substantially permanently against each other. This might already be sufficient for the locking of the band-ends. Furthermore it is well known, how to give steel bands additional grip by making an incision before and after the clips, brackets, and seals and to bend them outwards at these positions.

Alternatively, corrugated brackets and clips can be placed at the ends of the band, with the corrugation transverse to the longitudinal direction of the band.

The corrugation increases the grip of the brackets and clips pressed around the ends of the band.

Welding is a joining-technique, which is in one possible embodiment used when plastic bands are applied.

Optionally, the transport-aids, even in the situation where rollers are used, are formed of at least two parts, where the strapping band holds one part and the connection as described above is formed by the other part of the transport-aid. In this case, the part that forms the connection can be a sleeve or a seal or be connected to a sleeve or a seal, which is attached to the strapping band. To position the sleeve or seal, it is favorable if the sleeve or seal is slit laterally and can be pushed onto the strapping band sideways after it is positioned and before it is tensioned. The sleeve or seal is in one possible embodiment pressed onto the strapping band, causing it to stay fixed on the strapping band. In addition, it would be favorable if the slit of the sleeve or seal is provided with a funnel-shaped guidance and when the sleeve, after sliding it on, engages the strapping band immediately or substantially immediately. The funnel-shape makes sliding on easier. Engaging behind prevents or minimizes it from falling of. If in addition, the sleeve clamps the strapping band, it will stay in its selected position and slipping of is impossible.

Optionally sleeves or seals for the transport aids can be mounted on the strapping band in their desired position during its production. This makes the bringing along of tools for later attachment of sleeves and seals unnecessary or not desirable.

Adhesion of the sleeves and seals to the strapping band depends on the compacting pressure and the friction values of the contact-surfaces. Roughened contact-surfaces are therefore possible. Optionally, claws on the sleeves and seals can be provided.

Providing for Grips and flaps, a distance from the top of the lateral edge-protection can be possible as well.

Optionally, a handle or eyelet can be clamped onto the strapping band, the clamping strength of which increases when the weight of the cargo requiring protection, such as a glass sheet (and its packaging), increases. Such clamping is for example created when handles/eyelets are used, which simultaneously or substantially simultaneously form a lever arm of a double-armed lever, in which the other lever arm presses against the strapping band. These levers are self-clamping based upon the explained mechanism. This mechanism can also be used when the handles and eyelets, as described above, are pushed into a groove. The friction between the tongue and groove, both made of plastic and/or of foam-plastic, is so large that the tongue jams into the groove. Another version is where the connectors or sleeves are glued, or welded, or connected with the strapping band in the same manner as with the connection of the band-ends of a strapping-band.

Even without the above described sleeves and connections, the handles/eyelets can form a transport-aid if the strapping band can be held at its desired location with two fingers/jaws, in a way that an upward pivotal movement of the handle/sleeve leads to a twisting of the strapping band as well as to a clamping of the handle/eyelet onto the strapping band.

If additional reinforcing corners are provided for the packaging to be placed over the corners of the packaging itself, it may be possible to form the additional reinforcing corners in the same way as the sleeves or seals as described above, and to position them on the strapping band.

The edge-protection of the present application can also be designed in a way that multiple disc-shaped cargos (for example glass-sheets) can be simultaneously or substantially simultaneously transported next to one another. For this purpose, the edge-protection can optionally be provided with multiple recesses that run parallel or substantially parallel to one another.

In one possible embodiment, it is provided for each individual packaging to be connected to a multitude of other packagings, making space-savings for transport possible. The connection can for example be realized with tongue and groove as described above.

Using recesses with a dovetail cross-section is thereby possible. In one possible embodiment, recesses are provided in each packaging, so that the connection can be made with appropriate tongues, which engage with one side in one recess and with the other side in the other recess. In one possible embodiment, the recesses can also be used for other tasks, such as connecting with other profiles to thicken the yielding material.

In one possible embodiment, the edge-protection of the present application solely or substantially solely forms the packaging for glass and other goods requiring packaging.

In the above-mentioned rough construction environment, it may also be necessary and/or desired to supplement the edge-protection of the present application with protection for the space enclosed by the edges of the packaged goods. This is for example the case for items with a sensitive surface.

To prevent or reduce scratching of the outer surfaces of transported goods such as glass, the space, which is enclosed by the proposed edge-protection, might for instance be wholly or partially filled with carton or cardboard.

Corrugated cardboard in substantial thicknesses is widely available on the market, so that the space can easily be filled with single-layer or multi-layer corrugated cardboard. If the space is large or the carton/cardboard insert should even protrude over the edge-protection, the use of a honeycomb insert made of cardboard or cardboard/corrugated board is possible.

In comparison to other carton/cardboard constructions, the honeycomb carton/cardboard construction has a very favorable overall protective-effect. The various protective features include a good scratch protection. Cardboard/corrugated cardboard is a very economical protection for the glass and cargo alike.

If the carton/cardboard cannot meet the requirements of the cargo, a flexible layer, made out of foam-plastic, can be used between the carton/cardboard and the cargo. The foam-plastic may have the same characteristics as the material that is provided as edge-protection.

The cardboard can fill the space of the glass-sheet enclosed by the edge-protection according to the present application either by itself or in combination with other protection material. Air cushions can be seen as other protection materials as well. Air cushions can be used alone and/or with cardboard, or in combination with other protection materials, to fill the space of the packaged good enclosed by the edge-protection of the present application.

Optionally, the filled space on both sides of the packaged good is covered with a protective plate. The protective plates can overlap the packaging itself, or fit into the space enclosed by the packaging. The protective plates create stiffening, which can replace the reinforcing bars, as suggested elsewhere, or can be used in addition to the reinforcing bars. Attaching the protective plates can be done in any manner. A detachable type of fastening is possible, which will not hinder the reusability of the packaging. Optionally, the protective plates can be attached to the packaging with claws or hooks. These claws or hooks can grip into the grooves of the packaging, in the same way as the transport-aids explained earlier. If sections of the packaging are provided with such grooves, the claws or hooks may clasp the protective plate on four sides, thereby ensuring that with common transport loads, the protective plates do not detach from the packaging.

For the attachment of the protection plates, the claws or hooks are pushed into the grooves and slid over the protective plates at the same time. To detach, the claws or hooks are pulled out of the grooves. Optionally, the entire cargo is wrapped in foam-plastic. For small series, the wrapping is assembled using different parts in order to avoid or minimize the cost of molds, which would allow wrapping in a single step.

Once large series are foreseeable, "wrapping in one step" can be considered. To start with, wrapping in particle-foam is possible. In order to wrap in particle foam, a large-size mold must or should be obtained. This mold is also referred to as a tool. The cargo is placed in the open mold, which is then closed and filled with particles ensuring that the cargo is surrounded by particles on the sides.

Subsequently, heated steam is injected into the mold, so that the particle's outer surface softens and becomes doughy and they weld together. After sufficient cooling, the mold is opened and the wrapped cargo is removed.

In one possible embodiment, the foam-plastic is then strengthened near the edges of the cargo, for example the glass, in the manner as described above.

In one possible embodiment, the cargo together with its packaging, is wrapped with shrink-foil.

These are foils that shrink greatly under the influence of heat. Shrink-foils are usually composed of a mixture of polyethylene and poly propylene. The foils are often wrapped around the packaged product. The foils can also be shaped as bags or tubes and slipped over the packaged product. The heat required or desired to shrink the foil can come from hot air or hot gas.

Series products are in one possible embodiment led into a tunneled-oven and heated while going through.

The earlier-mentioned transport-aids (or their connections) are in one possible embodiment cut out from the shrinking-foil. This might already be done while wrapping the foil. Cut outs for transport-aids can be provided in the foil-tubes and foil-bags for the transport-aids and/or their connections. It is also possible to provide cut outs in the foil when the connections must or should be accessible for transport-aids.

The cargo, packaged with the packaging of the present application, such as a type of glass used in construction, must or should be moveable on a construction site. It is important to distinguish between smaller size glass-sheets with corresponding lower weight, which can be offloaded and moved around on location by one or more builders by hand, and larger size glass-sheets with corresponding weight that need to or should be moved mechanically.

In any case, using transport-aids attached to the edge protection such as handles and/or loops and/or eyelets and/or hooks and/or fasteners and/or feet, can simplify handling of the glass-sheets. The transport-aids can be attached to the edge-protection permanently or for the duration of the transport. If the transport-aids are permanently or substantially permanently attached, an appropriate attachment method to the edge-protection can be used. Detachable attachments are provided for temporary attachment.

For the edge-protection (together with the transport-aids) to be mainly exposed to pull forces, and less exposed to bending forces is thereby possible. This is achieved when the transport-aids attach to the side of the edge-protection.

Furthermore it is possible to provide the bottom edge-protection with forklift-feet. Forklift-feet attached to pallets are well known. Pallets have forklift-feet in the form of wooden bars at the bottom. The forklift-feet guide a forklift that puts its forks under the pallet to lift it up, transport it to another location and then put the pallet back down again. The same is true for pallet-trucks, which are equipped with the same fork as a forklift, and which are intended for moving pallets. However, the pallet-trucks serve for short transport distances and are not suitable for stacking. The pallet-truck lifts to provide the necessary or desired ground-clearance to move the packaged cargo. The pallet-trucks are usually moved by hand. To the extent that forklifts are further mentioned, it includes pallet-trucks.

The forklift-feet essentially ensure or promote a central gripping of the cargo by the forklift and prevent or restrict the pallet from slipping sideways, which may otherwise occur during movement of the forklift. This may be important when the forklift is turning corners.

Compared to normal pallets, the forklift-feet may be smaller. However, this is possible to the extent that the forks of the forklift/pallet-truck still fit between the forklift-feet. The forklift-feet have a thickness that essentially ensures or promotes that the forklift can drive its forks under the edge-protection, allowing it to lift the cargo together with its packaging. The forklift-feet can also be seen as transport-aids. They can be attached to the fastening strap using sleeves and seals, as is prevised in the previously described transport-aids. Optionally, the forklift-feet are integrated in the protective packaging, in another possible embodiment, they are integrated in a packaging section.

Other transport-aids are handles, loops, hooks, spigots, rings, rollers, fasteners, containers, and connections for safe transport.

Handles and loops make it easier to move the packaged cargo by hand, for example to lift the cargo or to push/pull the cargo by using the rollers. The hooks, spigots and eyelets simplify the attachment to the packaging of lifting means and means for securing during transport (i.e. chains, ropes, bands). Fasteners should enable/facilitate connecting different packages to one another. Containers facilitate the carrying of cargo-accessories and of accompanying documents.

Transport-aids can be attached to different places of the packaging in a fixed or detachable manner. As a permanent or substantially permanent arrangement, combined individual packaging sections can form the desired transport-aids, or be permanently or substantially permanently connected to the transport-aids. Packaging sections at the bottom may have protrusions serving as feet or forklift-feet. Handles, hooks, spigots, eyelets, fasteners and connectors for a transport-lock may be molded or welded or taped to the packaging. Loops and containers may be welded or taped to the packaging as well. Rollers are held in a roller casing. The casing may be formed by a packaging-section, or it might be welded or glued to the packaging. In one possible embodiment, the transport-aids are mounted in a detachable manner in order to reduce the number of transport-aids required or desired for packaging.

For this purpose, the transport-aids can be fastened to connections that are provided on the packaging. The connections might be formed for example, by means of protrusions and/or recesses in the packaging. The transport-aids engage with the projection and/or hook into the recesses.

In one possible embodiment, grooves are provided in the packaging and the transport-aids will engage with a so-called tongue into the grooves. There are no special requirements for the grooves, if they are on opposite sides from one another. Small depressions as grooves and small elevations building the tongues will already be sufficient. In principle, the depressions (grooves) may also be provided in the transport-aids and the elevations (tongues) may be provided in the packaging. The effort required or desired for this is however higher the other way around. In addition, the packaging can damage more easily at the elevations than in the depressions.

More needs or desires to be considered when using grooves and tongues when the transport-aids need to or should engage into one groove. The transport-aids should then be secured against falling out of and against tilting and unforeseen sliding in the grooves.

A cross-sectional shape of both the groove and tongue can largely achieve this. A cross-sectional shape such as a dovetail fitting is thereby possible. Undercuts in the grooves and tongues characterize such cross-sectional shapes, making it possible for the tongue of the protruding cross-sectional parts to engage in the undercuts of the grooves. Using such grooves and tongues prevents or restricts falling out as well as tilting.

The stability of the tongues and grooves will depend on the foam-plastic. If desired, reinforcing the grooves/springs and/or the surrounding area can alter stability. Using a different plastic for the packaging in order to increase strengthening is possible within the limits of the prescribed yieldability of the packaging. However, simple measures such as the rounding of corners/edges on the tongues and in the grooves lead to substantial strengthening. In addition, providing a mantle and/or coating as described above can also create strengthening. A material for the transport-aids that can withstand stress types can easily be selected as well. Transport-aids with low weight, for example when made out of aluminum, are desired. Clamping prevents or minimizes the transport-aids from slipping in the grooves.

Clamping devices are provided for such situations. Simple clamping devices are for example wedges. More elaborate clamping devices might also be used. The transport-aids themselves can also be formed as clamping devices.

The amount of friction between tongue and groove, the amount of play between tongue and groove, and the lever ratios, resulting from the forces exerted by the transport-aids and their distance from the tongue and groove connection to the packaging, greatly influence the strength of the clamping.

Transport-aids that can self-lock in the grooves and on the tongues are of economic value.

Depending on the circumstances, the transport-aids are self-locking in the groove or on the tongues. This is for example the case if foam-plastic surfaces slide against each other in the tongue and groove connection.

Such transport-aids wedge if a load is not exactly or substantially exactly centrally positioned opposite the central axis of the grooves. This can be achieved easily by choosing an appropriate distance within which loads are directed towards the transport-aids.

Wedges might also be used to clamp transport-aids. The transport-aids as described above are possible. At construction sites, a crane or a forklift is frequently available. The crane can be the construction crane or a crane that is transported with the truck itself. These devices can facilitate the unloading of the cargo. Sometimes the crane can also provide the transport onto the respective construction floor. In general however, on the construction floor, the cargo must or should then further be moved by hand. Often too, the packaged goods must or should be off-loaded by hand and then carried to the relevant floor. On a construction site, transporting by hand is linked to the risk of damage. With current transports, cargo corners are bumped and the cargo placed on the floor too hard too often. On the other hand, with the packaging of the present application, transport is no longer associated with the risk of damage to any great extent. This becomes evident in the drop tests as described above. When cargo survives such drop tests without damage, cargo in the packaging of the present application will also survive the usual bumping and being placed hard on the floor without damage. In one possible embodiment, glass can be extra protected as a cargo when it is lightly honed at the edges.

Minimal honing, sufficient to cover the size and deepness of the micro-cracks, is enough.

Although this improved transport safety furthers the transport, it can also increase the negligence during transport. In order to counteract this, the cargo can be equipped with a shock detector that responds when the impact force exceeds a certain level. A commercially available detector uses a liquid-filled glass tube. A color-coded impact causes the liquid to spill over the detector and colors it.

The above-discussed embodiments of the present invention will be described further herein below. When the word "invention" or "embodiment of the invention" is used in this specification, the word "invention" or "embodiment of the invention" includes "inventions" or "embodiments of the invention", that is the plural of "invention" or "embodiment of the invention". By stating "invention" or "embodiment of the invention", the Applicant does not in any way admit that the present application does not include more than one patentably and non-obviously distinct invention, and maintains that this application may include more than one patentably and non-obviously distinct invention. The Applicant hereby asserts that the disclosure of this application may include more than one invention, and, in the event that there is more than one invention, that these inventions may be patentable and non-obvious one with respect to the other.

BRIEF DESCRIPTION OF THE DRAWINGS

In the drawings, a number of examples of the present application are shown.

FIG. 19F shows another variation of the edge-protection;

FIG. 31 shows a bracket;.

FIG. 32 also shows a bracket-like accessory/transport-aid;

FIGS. 48A and 48B show variations of the thickening profiles;

FIG. 48E shows an eyelet as yet another transport-aid;

DESCRIPTION OF EMBODIMENT OR EMBODIMENTS

Figure 1:
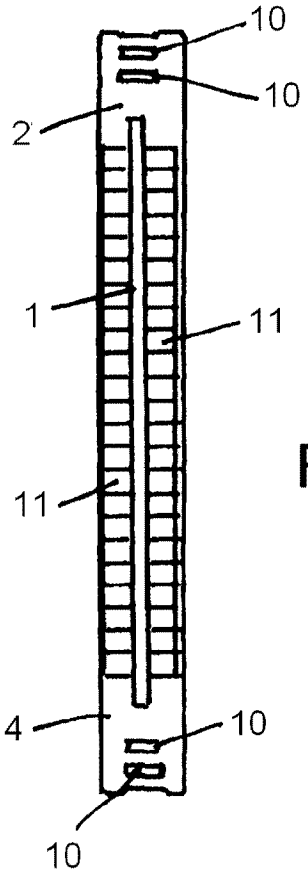
FIGS. 1 and 2 show a laminated glass-sheet, which is covered around its edges by edge-protection profiles.
Figure 2:
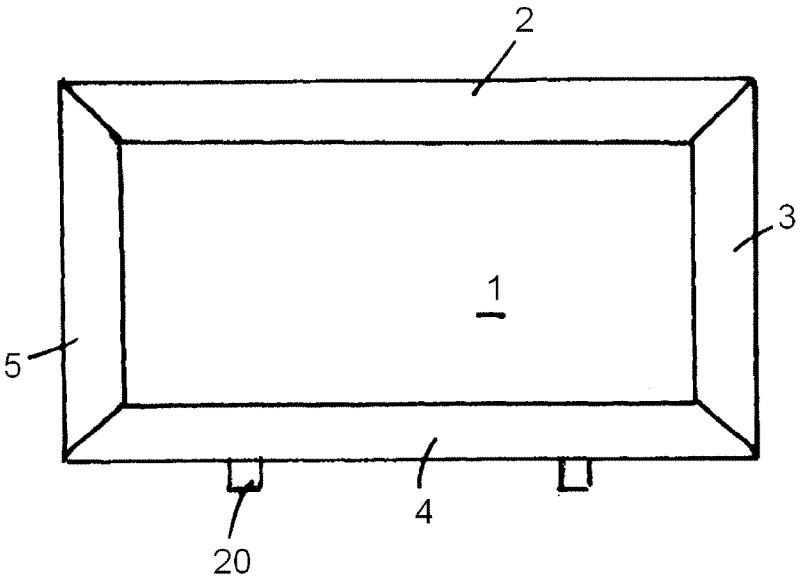

FIGS. 1 and 2 show a laminated glass-sheet 1, which is covered around its edges by the edge-protection profiles 2, 3, 4 and 5. In the example of this version, profiles 2, 3, 4 and 5 are made of XPS foam ((extruded polystyrene foam) (in other version-examples of other foam)), with a density of 25 kg per cubic meter. Profiles 2, 3, 4 and 5 have the same cross-section. In addition, profiles 2 and 4 have the same length. The same applies to the profiles 3 and 5. The cross-section of the profiles 2, 3, 4 and 5 can be seen in FIGS. 1 and 3.

Profiles 2, 3, 4 and 5 are mitered cut at the ends.

Figure 3:
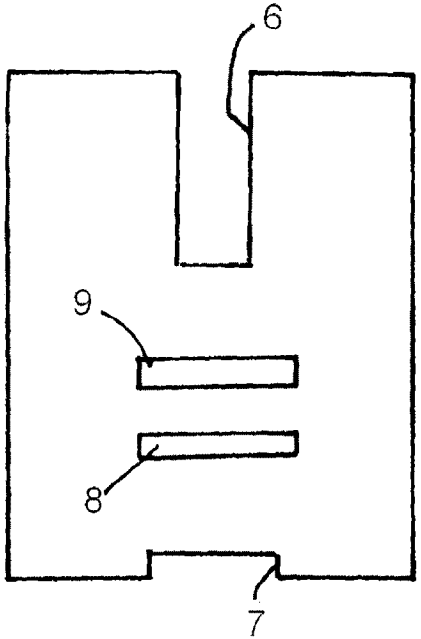
FIG. 3 shows the cross-section of a profile.

The cross-section of the profile is shown in FIG. 3. The profile cross-section is basically rectangular with dimensions of one hundred thirty millimeters by two hundred millimeters. On the one narrow side a recess 6 with a width of twenty-three millimeters and a depth of fifty millimeters is provided, in which the laminated glass-sheet 1 is placed. On the opposite narrow side a recess 7 with a width of sixty millimeters and a depth of five millimeters is provided; this recess is provided for a strapping band. In the inside of the profile two recesses 8 and 9 with cross-sectional dimensions of twenty-five millimeters by fifty millimeters are provided, which are to accommodate wooden slats 10.

In the example of this version, the XPS foam of the profile functions as yielding material. The wooden slats form a reinforcing material for the yielding material. Using multiple wooden slats, with foam separating the individual wooden slats from each other, creates a remarkable resistance of the edge-protection against the dreaded impact- and shock loads that occur with glass transportation.

In the example of this version, the profile is composed of three parts (not shown).

When the three parts are not connected, two parting joints extend through the openings 8 and 9, parallel or substantially to the narrow sides.

The three parts are cut out of standard XPS foam panels and they are composed on the surface in such a way that the recesses 6 and 7 and further recesses are created, which become visible as recesses 8 and 9 when the parts are put together.

The cutting is done by sawing.

The recesses are milled into the version example.

During assembly the parts are glued together at high temperatures. The hot glue is applied with suitable glue-guns.

In other versions the individual parts are welded together. During the welding process, the welding surfaces are heated and the parts are then pressed together. A hot air blower can be used to apply the required or desired heat (in other versions, the heat is applied by contact with a heating blade or by means of another object that has a corresponding heated surface, with which the welding surfaces are brought into contact).

After bringing the edge-protection of the present application onto the market, the desired quantities of profiles can be produced by (in relation to the cross-section) one-piece extrusion, or by injection molding, or particle foam moldings. Extruders with extrusion-dies are required or desired for extruding, which are designed with the required or desired profile cross-section and guide the foam into a shaping calibrator.

With the extrusion of a profile, comprising the cross-sectional dimensions of the desired profile, the processes as described above become (at least partially) unnecessary or undesired.

The shown profiles 2, 3, 4 and 5 are pressed onto the edge of the glass sheet 1 with a strapping band not shown here (in other versions with a tensioning-band or a tensioning- strap). In the version shown, the strapping band is made of plastic.

A strapping-machine pulls the strapping-band from a roll and then guides it around the outside of the profiles 2, 3, 4 and 5. This process is initially done by hand. For larger quantities, a strapping- machine is prevised, equipped with an automatic band feeder and automated guidance respectively, guiding the strap around the profiles 2, 3, 4, 5.

The strapping-machine comes in various versions. Initially a simple hand-operated device can be used for tensioning the band. When larger quantities of packaging need to or should be strapped, an electric strapping-machine with automatic control can be used instead of a hand-operated device. In this version the two ends of the plastic strapping band are welded together after tensioning the band. For this, a heated blade is shortly inserted between the two ends of the band. The heating blade shortly melts the surfaces of both ends of the band in such a way that, with sufficient pressure, a weld is created without causing a notable weakening of the strapping itself. Immediate or substantially immediately cooling of the weld essentially ensures or promotes it is given sufficient strength.

The strapping holds profiles 2, 3, 4 and 5 together in the form shown, without further action being required or desired.

In another version, a reinforcement/corner-protection is provided for the corners. The reinforcement/corner-protection is achieved by caps that are placed over the corners before the profiles are being strapped together. Such caps are commercially available and offered as plastic or metal corners. Automated equipment places the caps automatically. The functionality of such equipment depends on whether the caps that are used, meet the requirements of the equipment. As long as there are no high volume production series that justify automatic strapping machinery, manual strapping is recommended. When strapping is done manually, the positioning of the caps is a problem when the caps are not held in place by the strapping itself. It is advisable for the caps to be brought/held in position with a double-sided self-adhesive strip, for as long as the strapping itself does not do this.

Figure 49:
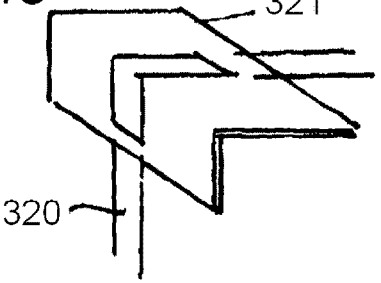
FIG. 49 shows caps positioned on the strapping.

According to FIG. 49, the caps 321 can also be positioned on the strapping 320. To achieve this, the caps may be provided with slits, through which the strapping is guided as shown.

For strapping-by-hand several tools are available, varying from very simple designs to upscale versions.

Figure 50:
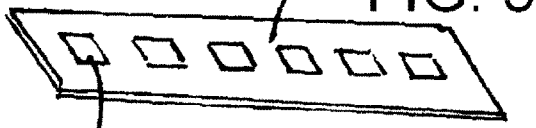
FIG. 50 shows a band of material with a row of cutouts.

A simple design is shown in FIG. 50. It shows a band of material 325 with a row of cutouts 326, whose openings and the distances between them are adapted to the dimensions of the strapping-band. The material used in the version example is a sheet-metal. Other rigid materials are used in other version examples. The strapping-band is fastened with one end to the end of band 325. The strapping-band is guided around the package and its other end is threaded to and from through the openings 326. After tensioning the band, it remains tensioned due to the frictional resistance in the sheet-metal strip.

The profiles 2, 3, 4 and 5 create an edge-protection measuring approximately fifty-three and one-millimeters in height perpendicular or substantially perpendicular to the glass-sheet. In the resulting enclosed space a layer of cardboard 11 with a thickness of fifty millimeters is provided on each side. In addition, soft foam- plastic, made of polyethylene not shown in the example with a thickness of one and one-half millimeters, is placed between the cardboard 11 and the glass-sheet 1.

Figure 4:
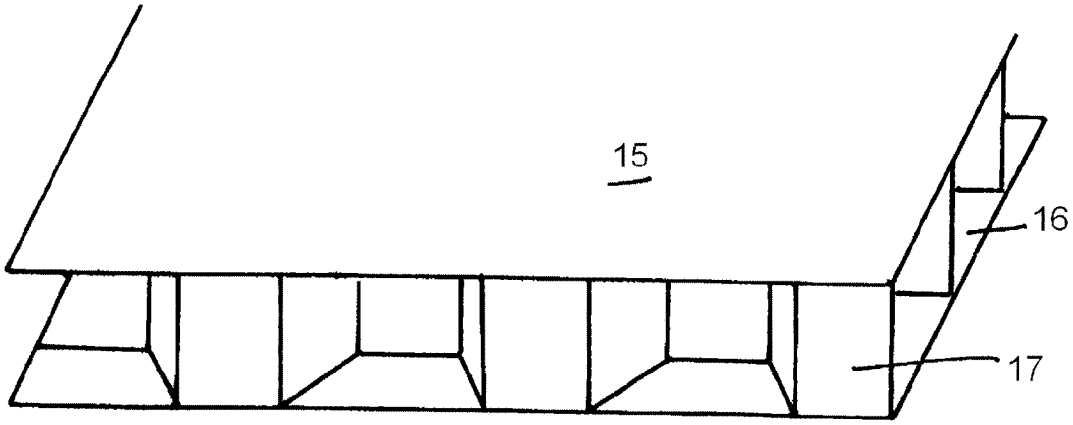
FIGS. 4 and 5 show corrugated cardboard with different structures.
Figure 5:
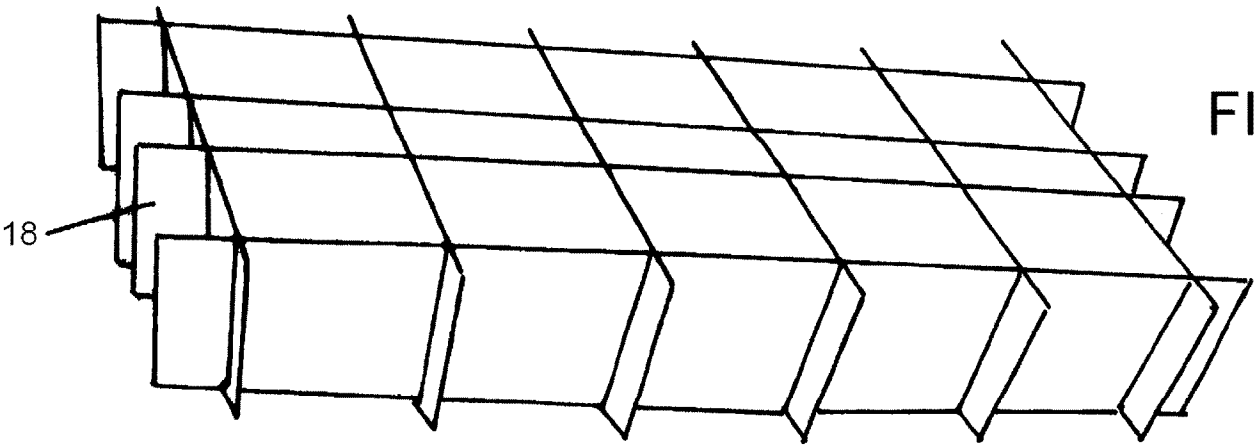

FIGS. 4 and 5 show corrugated cardboard with different structures.

According to FIG. 4, each cardboard layer has a honeycomb core 16, which is connected on either side with a paperboard layer 15 or 17. The honeycombs are formed through cardboard strips that are bent and glued together in a way that creates a honeycomb-like structure. The cardboard in FIG. 5 shows a differently structured core. Here also the core is made out of cardboard strips, however the strips are inserted into each other in such a way that they create a four-cornered structure as opposed to the 6-cornered honeycomb structure.

The glass-sheet, combined together with its edge-protection and the cardboard layers on the side, is wrapped in a shrinking-foil after it has been strapped. The shrinking-foil leaves the underside partially uncovered, so that forklift-feet 20 can be attached. The forklift-feet serve as transportation-aid in order to position the forks of a forklift used for loading and/or offloading.

Figure 6:
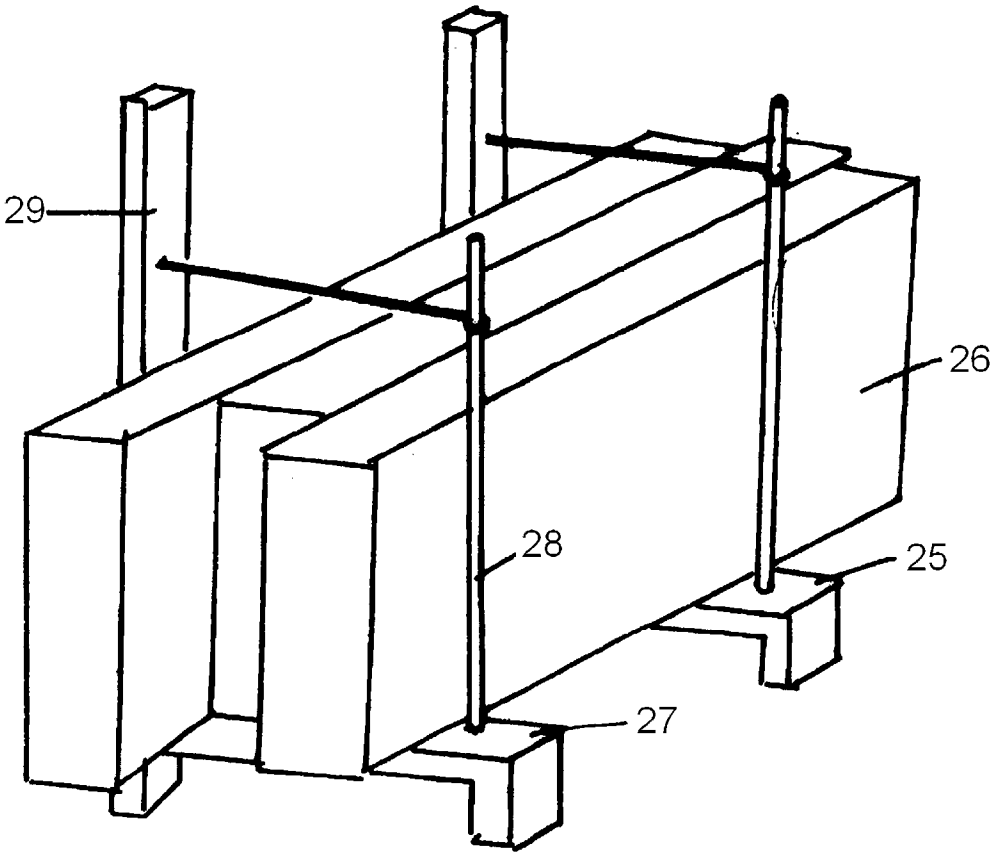
FIG. 6 shows skids as transport-aid for the glass-sheets with their edge-protection and shrinking-foil.

FIG. 6 shows skids as transport-aid for the glass-sheets 26 with their edge-protection and shrinking-foil. The skids are made of struts 29 with feet 25. The feet 25 have different openings 27 at the top. The openings 27 take rods 28 that can be tensioned with the load against the struts 29. With the skids, the load can be easily stored and transported with vehicles.

Figure 8:
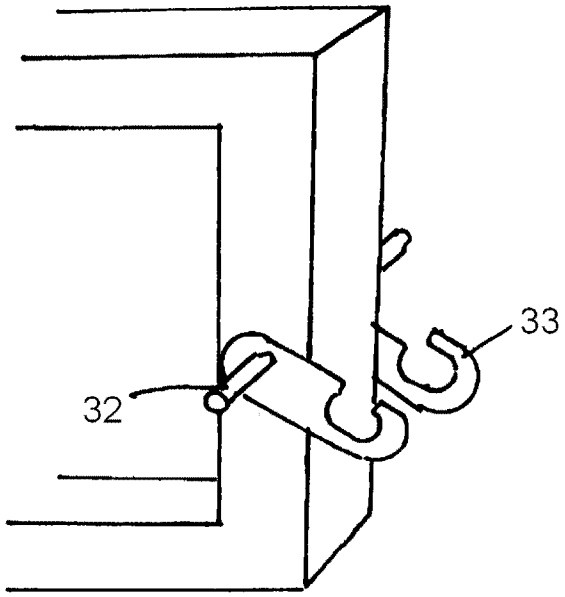
FIGS. 7 and 8 show an edge-protection made of various profile sections with a hole.
Figure 7:
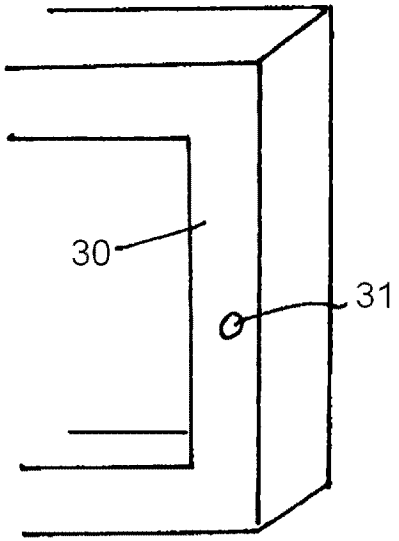

FIGS. 7 and 8 show an edge-protection 30 made of various profile sections with a hole 31. The hole 31 serves as a transport-aid for the attachment of a hook 33. With the hook, every glass-sheet including its edge-protection and possible other packaging can be loaded/offloaded.

Figure 9:
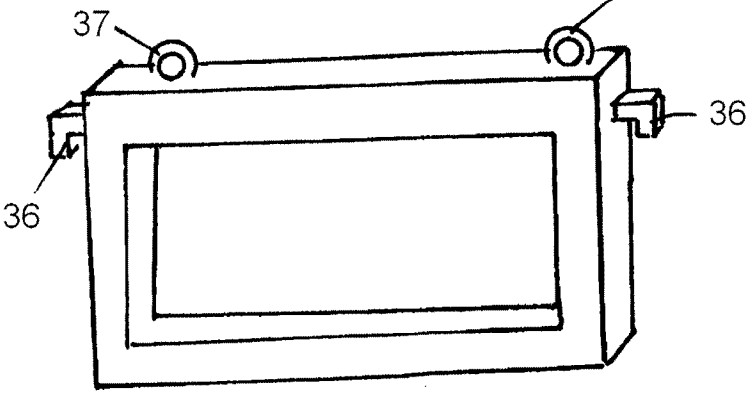
FIG. 9 shows an edge-protection made of various profile sections with side hooks and eyelets as transport-aids.

FIG. 9 shows an edge-protection made of various profile sections with side hooks 36 and eyelets 37 as transport-aids.

Figure 21:
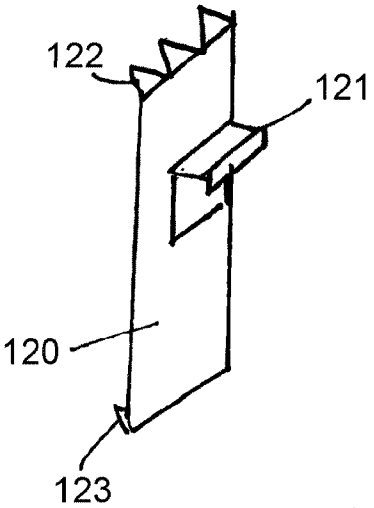
FIGS. 21 and 22 show another version of the packaging where a grip is used.
Figure 22:
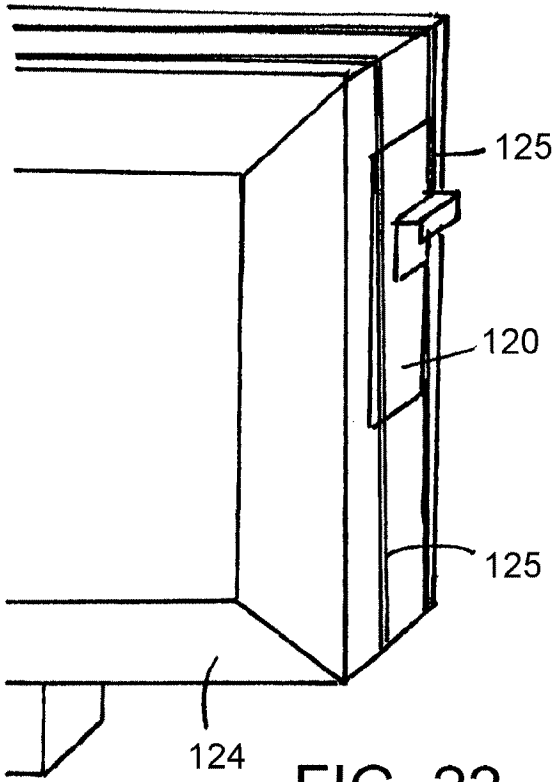

FIGS. 21 and 22 show another version of the packaging where a grip 121 is used. The grip 121 has been cut out of a plate 120 and folded. In addition, the plate is toothed 120, which allows the plate 120 to be pressed into the yielding material. This is done as required or desired. The strapping-band 125 that is placed around the packaging/edge-protection 124 is then lifted slightly in order to push the plate with the grip 121 into its desired position under the strap 125, and to push the teeth into the yielding material. The strapping-band 125 holds the plate 120 in the desired position.

Figure 10:
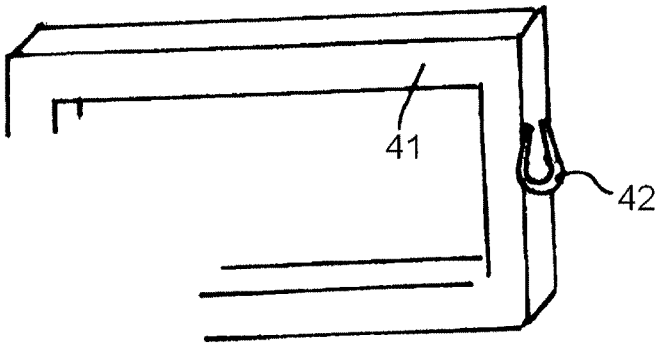
FIG. 10 shows an edge-protection made of various profile sections with lateral loops as transport-aids.

FIG. 10 shows an edge-protection made of various profile sections 41 with lateral loops 42 as transport-aids.

Figure 11:
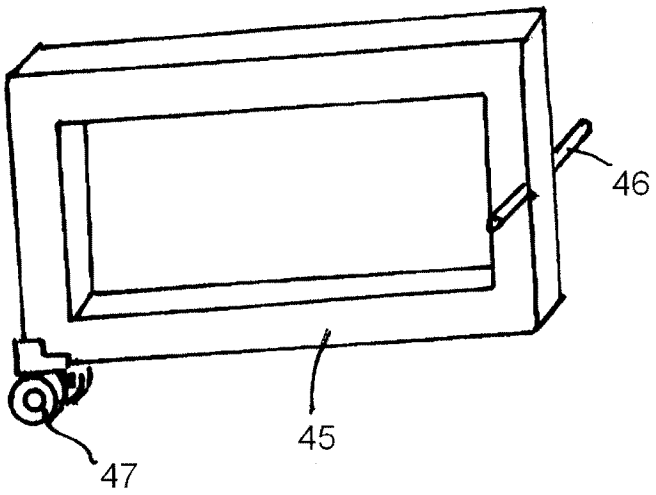
FIG. 11 shows an edge-protection made of various profile sections with a roller at one of the lower corners as transport-aid.

FIG. 11 shows an edge-protection made of various profile sections 45 with a roller 47 at one of the lower corners as transport-aid. The roller makes the glass-sheet easy to move. In addition a grip 46 is possible.

Figure 20:
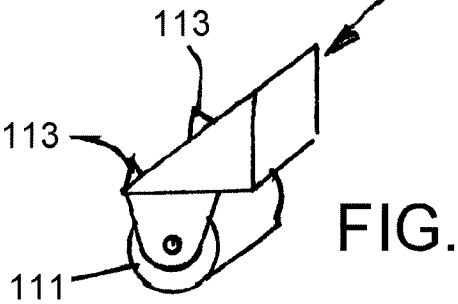
FIG. 20 shows another version of a roller used as a transport-aid.

FIG. 20 shows another version of a roller 111 used as a transport-aid. The roller 111 is seated in a housing 112, which is designed at the same time as a hood/cap for enclosing a corner of the edge-protection. In this version example the hood/cap 112 is made of tin-plating, in other versions it is made of plastic. The hood/cap 112 has a number of teeth 113, with which it presses into the yielding material. The hood/cap can be placed as required or desired once the packaging is finished, and can be reused when the glass-transport has been completed.

The hood/cap 112 can also be placed whilst strapping. If so, in one possible embodiment, the strapping should be guided through between the roller and the hood/cap 112 in order to mount the hood/cap in a fixed manner. The hood/cap then acts as a corner reinforcement/corner-protection for the packaging itself as well. The version example shows a roller, which is seated rotatable at both ends in the hood/cap 112. To facilitate placing the strapping-band between the roller and hood/cap, the roller can be seated in the hood/cap one-sided (floating) in other version examples.

Figure 12:
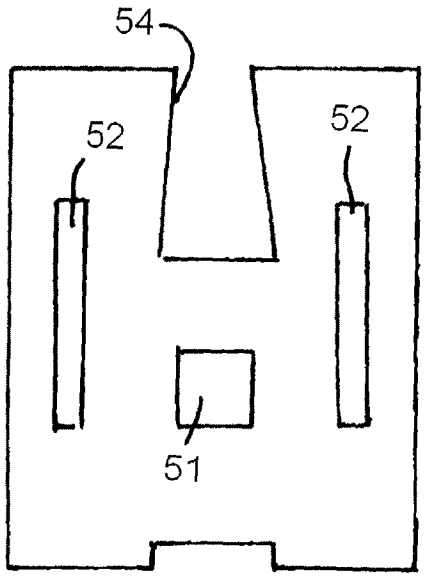
FIG. 12 shows another cross-section of an edge-protection.

FIG. 12 shows another cross-section of an edge-protection 50. The three grooves 51 and 52 are for reinforcing profiles and make cross-section 50 differ from the cross-section as shown in FIG. 3. Furthermore, a groove 54 is provided for inserts 60.

Out of the recesses for reinforcing profiles, recess 52 is positioned at a distance from and centered under the recess/groove 54 for the inserts. The recesses 52 are positioned on both sides of the recess/groove 54 for the inserts 60. This arrangement should result in improved shock-resistance, impacting the plane of the glass edge-protection at a right-angle. The recesses 51 and 52 are formed in the same way as the recesses/openings of the edge-protection in FIG. 3.

Recess/groove 54 has a dovetail shape. The dovetail-shape essentially ensures or promotes that the respective insert 60 is firmly held in the edge-protection. The cross-section of the insert 60 is provided with a corresponding recess/groove.

Figure 14E:
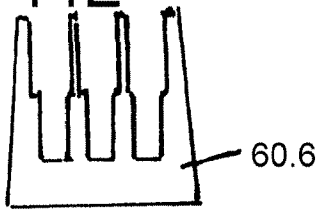
FIG. 14E shows another version example of an insert related to FIG. 14A.
Figure 14F:
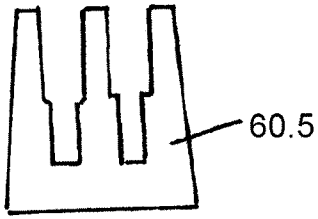
FIG. 14F shows another version example of an insert related to FIG. 14A.
Figure 14D:
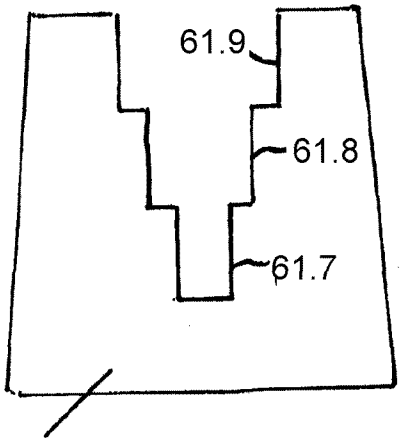
FIG. 14D shows another version example of an insert related to FIG. 14A.
Figure 14C:
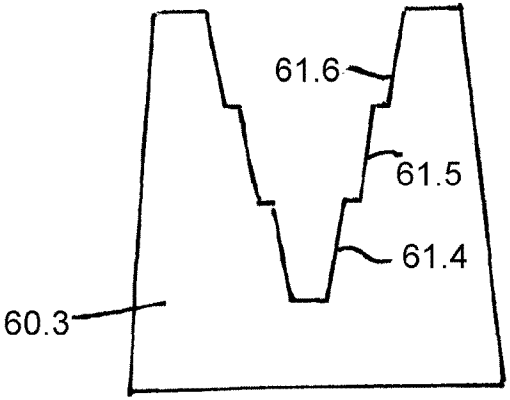
FIG. 14C shows another version example of an insert related to FIG. 14B.
Figure 14B:
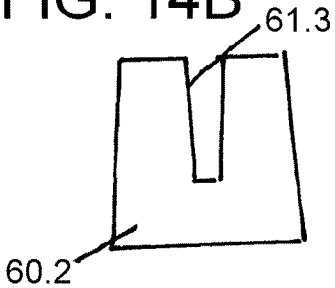
FIG. 14B shows an insert with a recess conically tapering to its deepest end.
Figure 14A:
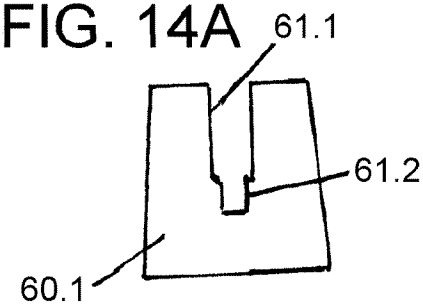
FIG. 14A shows another version example of an insert.
Figure 14:
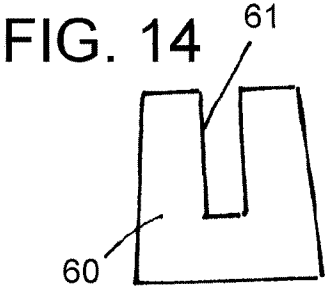
FIG. 14 shows an insert that has an opening.

In the version example of FIG. 14, the insert 60 has an opening 61, in which the glass-sheet is placed. In the version example the insert 60 is made of an elastomer. There are natural and artificial elastomers. Rubber is one of the natural elastomers. The elastomers are capable (within certain limits) to hold different thicknesses of glass-sheets. In the version example the insert 60 is intended for glass-sheets with a thickness of five to ten millimeters. Other inserts are provided for thicknesses that range from ten to twenty millimeters and from twenty to thirty-five millimeters.

FIG. 14A shows another version example of an insert 60.1, providing an incremental recess. One part of the recess has an opening width for glass-sheets with a thickness of twelve millimeters 61.1. The deeper part of the recess has a width for glass-sheets with a thickness of eight millimeters.

FIG. 14B shows an insert with a recess conically tapering to its deepest end 61.3. The taper enables a continuous adjustment to any glass thickness ranging between twelve and eight millimeters.

FIG. 14C corresponds to the principle of continuous adjustment as shown in FIG. 14B. However, for insert 60.3 three different ranges 61.4, 61.5, 61.6 are provided that allow for a continuous adjustment to any glass thickness, provided the glass thickness falls within one of the three ranges.

FIG. 14D corresponds to the principle shown in FIG. 14A. However, the example shows an insert 60.4 providing a three-staged incremental recess 61.7, 61.8 and 61.9 for three different glass thicknesses.

The version example in FIG. 14F differs from the version example in FIG. 14A in that instead of one single glass sheet, two sheets of glass can be placed side-by-side.

The version example in FIG. 14E differs from the version example in FIG. 14A in that instead of one single glass sheet, three sheets of glass can be placed side-by-side.

Figure 23:
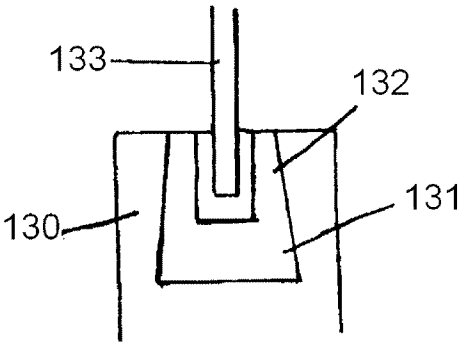
FIG. 23 shows an edge-protection with an insert.

FIG. 23 shows an edge-protection 130 with an insert 131, which differs from the insert 60 in FIG. 14 in a way that it holds the glass sheet 133 within an inlay 132. In the version example the insert 132 is made of cardboard. Its task is to prevent or minimize damage to the insert caused by the edges of sharp glass.

Figure 13:
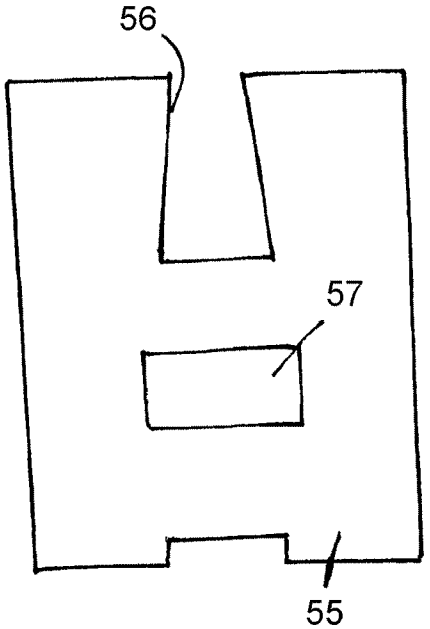
FIG. 13 shows a cross-section of an edge-protection.

The version example in FIG. 13 shows a cross-section of an edge-protection 55 and differs from the edge-protection 50 in FIG. 12, in that one recess 57 centered below recess 56 is provided for inserts 60.

Figure 19:
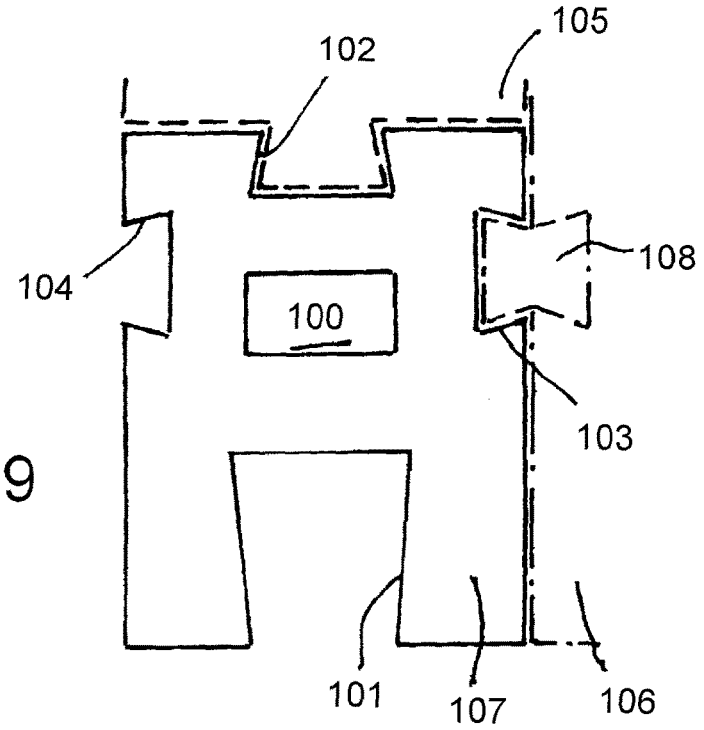
FIG. 19 shows an edge-protector comprising polystyrene foam.

The edge-protector 107 in FIG. 19 comprises polystyrene foam with a density of thirty kilograms per cubic meter and differs from the edge-protector in FIG. 13 in that different dimensions are used. The cross-section width is one hundred thirty millimeters, the height one hundred sixty millimeters and a centered opening 100 of twenty-four by forty-eight millimeters is provided in the middle. The opening allows insertion of a roof batten as reinforcement. Furthermore, four grooves 101, 102, 103 and 104 are provided on the outside. The four grooves have a dovetail shaped cross-section. Groove 101 differs from groove 56 in FIG. 13 in that different dimensions are used, that is a width of sixty millimeters at the bottom, a depth of sixty millimeters and an opening width of fifty millimeters at the top.

Groove 101 serves to hold an insert, similar to the one shown and described in FIG. 14. On its opposite side, a recess 102 is provided, just as in the edge-protector of FIG. 13. In the edge-protector as shown in FIG. 13 the groove/recess 13 serves to guide and secure a strapping-band.

In the version example, the groove/recess 102 has a depth of twenty millimeters, a width of fifty millimeters at its deepest point and a width of forty millimeters at its opening. According to FIG. 19, the groove/recess 102 has additional functions. A housing can be inserted in the groove, in which a rotatable roller is held. Additionally or alternatively, two forklift-feet can be inserted in the groove 102, which are placed at a distance of each other in accordance with the distance between the forks of a forklift, centered under the glass-sheet in its packaging, in order to facilitate the transport of the glass-sheet by forklift, for example during loading or offloading a vehicle.

Additionally, the groove/recess 102 can be used to attach a flat profile shown in a dash-dotted manner 105, made of the same foam-plastic as the profile. A similar flat profile may also be attached to the grooves/recesses 103 and 104 on the other two sides. Attaching flat profiles creates more yielding material, which proportionally increases the damping behavior, in line with the use for heavier glass sheets.

The grooves/recesses 103 and 104 have a depth of fifty millimeters, with a width of forty millimeters at their deepest point and of thirty millimeters at the opening.

An important further functionality of the grooves/recesses 103 and 104 is to create a connection with other packaging/edge-protection, shown as dash-dotted packaging detail 106.

The packaging/edge-protection 106 has the same groove/recess as the packaging/edge-protection/yielding profile 107. The connection can be achieved with the help of a so-called tongue 108. The tongue 108 is formed by a profile-rod, which has two sides/ends in cross-section, corresponding to the grooves/recesses 106 and 107 in the packaging/edge-protection in such a way that a firm connection is created. With the use of the tongue 108 as connecting technique, multiple packages and their enclosed packaging goods can be connected to each other to form one block, which positively influences transport costs. The block can be made in a wide range of desired widths, allowing for transport surfaces to be used to their maximum available width. In addition, the blocks can be made in a wide range of desired heights, allowing for transport volumes to be used to their maximum available height.

For that, instead of the flat profile 105, a different packaging is placed on top, and connected using the tongue 108.

Finally, the block can be made in a wide range of desired lengths. The packagings with their enclosed cargo, arranged one behind the other, are connected together with the tongue 108. For container or truck transport respectively as well as other similar types of transport, utilizing the transport volume in this way brings considerable possibilities.

Packagings of different sizes can also be connected together. If the grooves in the various packagings are exactly or substantially opposite one another, this can be realized with the tongue 108. If the grooves are not exactly or substantially opposite one another, a connection can still be made with the grooves 108. For this an adapter-piece is provided. For the adapter-piece, grooves of corresponding height and/or distance are provided, so that the tongues 108 can connect the one packaging from one side and the other packaging from the other side to the adapter piece.

Alternatively, adapter-pieces can be provided which are adapted to the different sizes of the packagings to be connected. These adapter-pieces correspond to the previously described adapter-pieces with tongues provided on both sides, now the tongues are integrated in the adapter-piece itself.

Figures 19A, 19B, 48, 48C, 48D:
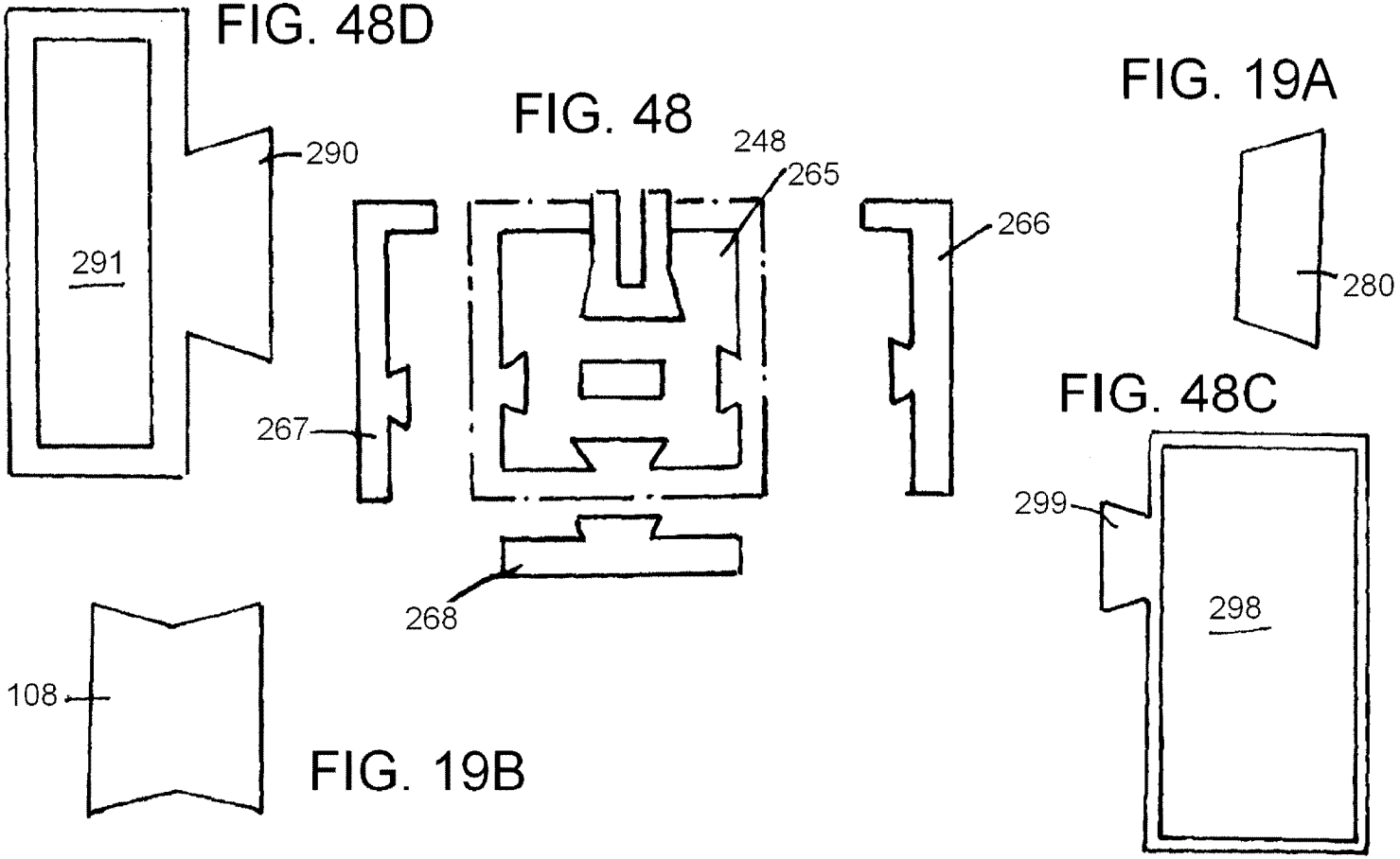
FIG. 19A shows a tongue that can fill-out unused grooves in the packaging of the present application.
FIG. 19B shows a tongue in cross-section view.
FIG. 48 shows a frame.
FIGS. 48C and 48D show containers as two additional transport-aids.

The tongue 108 is shown in cross-section view in FIG. 19B. FIG. 19A shows another tongue 280, which can fill-out unused grooves in the packaging of the present application.

Figure 19D:
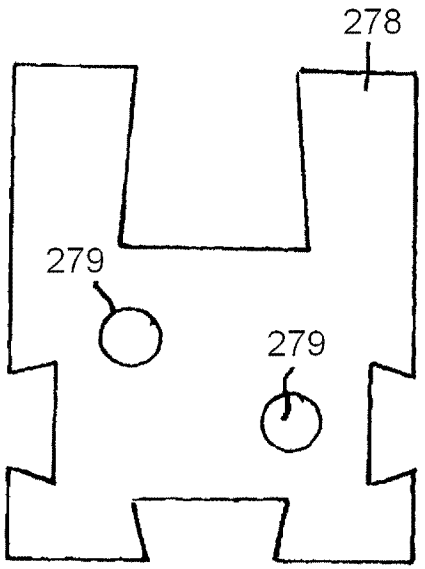
FIG. 19D shows another variation of the edge-protection.
Figure 19E:
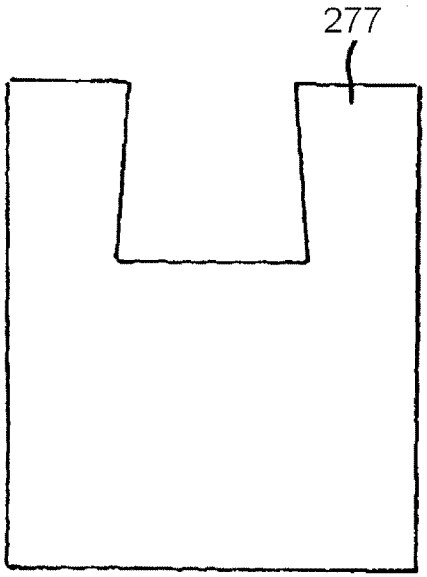
FIG. 19E shows another variation of the edge-protection.
Figure 19C:
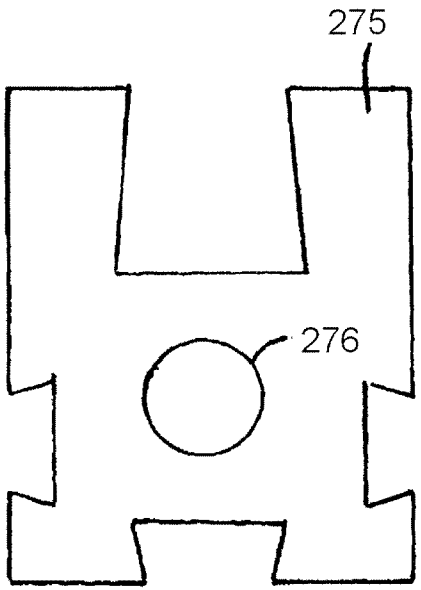
FIG. 19C shows a variation of the edge-protection.

FIGS. 19C and 19E show variations of the edge-protection of the present application profile made from yielding material. In contrast to the profile according to FIG. 19, FIG. 19C shows a round opening 276 in the profile 275. This allows for the use of a reinforcing material with a round cross-section. The round opening is more easily machine-manufactured than an angular opening.

FIG. 19D differs from the version example in FIG. 19C in that it shows two round openings 279 in cross-section instead of one round opening 276 in cross-section, provided for round reinforcing material.

FIG. 19E shows a profile 277, which, in contrast to the profile shown in FIGS. 19 to 19C, has no openings other than for the recess for an insert.

As a further alternative to the version example in FIG. 19, FIG. 19F shows the possibility to connect two side-by-side packagings. In FIG. 19 this is done with a separate tongue. The version example in FIG. 19 shows one connection at the bottom of the packaging enclosing the glass-sheet. Usually this is sufficient, because the packagings are handled individually after offloading from a vehicle. Therefore, the possibilities of this type of connection may be true with transport of several side-by-side packagings in one vehicle. This makes securing the load much easier. Securing the cargo can for example be limited to lashing to top of the packagings together. In other version examples requiring better securing, this can be realized by also connecting the side-by-side packagings at the top using the same type of connection. This connection will result in a very stable/robust overall packaging.

Such a need or desire arises if the transport does not take place by trucks but with transporter-vans with a maximum allowed gross vehicle weight of less than seven and one-half tons. Such transporter-vans are generally used for transports with which handling takes place by hand (without lifting means), because the transporter-vans are much faster than freight trucks. Experience has shown that proper load securing, despite transport/traffic regulations, is severely lacking in such transporter-vans. For such transports, use of an additional connection at the top of the side-by-side packagings, is possible.

If there is the need or desire to further connect the side-by-side packagings, a connection between both sides connecting the top and bottom of the packaging is also provided.

FIG. 19B shows a variation of the profile as used in combination with the yielding material in FIG. 19. In addition profiles 280 and 281 have arisen, which show a groove 282 on one side as shown in FIG. 19, whereas on the opposite side it shows a tongue 283 instead of a groove 282. When connecting two side-by-side packagings, the separate tongues 108 become dispensable. This may apply if the simultaneous or substantially simultaneous connection of side-by-side packagings on the sides connecting the top and bottom of the packagings is not required or desired.

Figure 27:
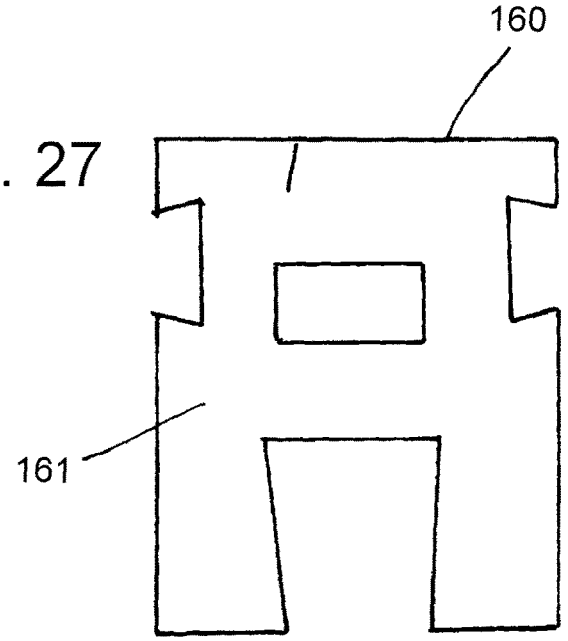
FIG. 27 shows another version example of an edge-protection.

FIG. 27 shows an edge-protection 151 with a profile cross-section that differs from the cross-section of FIG. 19, in that there is no recess/groove provided on the outer side 160 of the edge-protection for the strapping-band. This is possible because the strapping-band will also maintain its intended position without a recess/groove, as long as the strapping-band is slightly constricted when tensioned around the yielding material.

Figure 28:
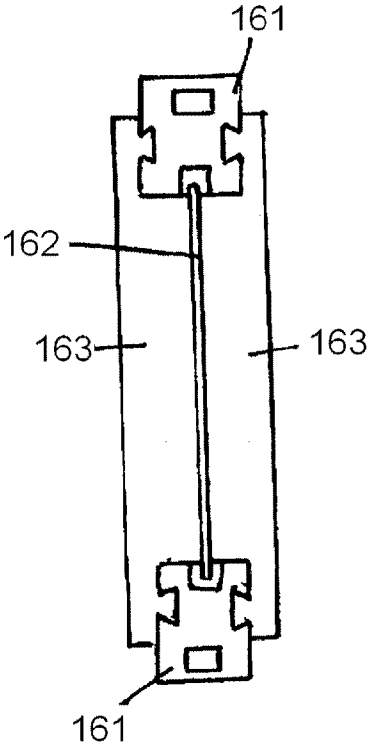
FIG. 28 shows the schematic application of the profile cross-sections as packaging for a glass-sheet.

FIG. 28 shows the schematic application of the profile cross-sections 161 as packaging for a glass-sheet 162. In the version example, the packaging is covered on both sides with a foam layer 163, which although also made of polystyrene, has a density that is thirty percent lower. This is synonymous for being more yieldable.

In the version example the foam layers 163 are formed in such a way that they fill out the space enclosed by the edge-protection on both sides of the disc.

Figure 15:
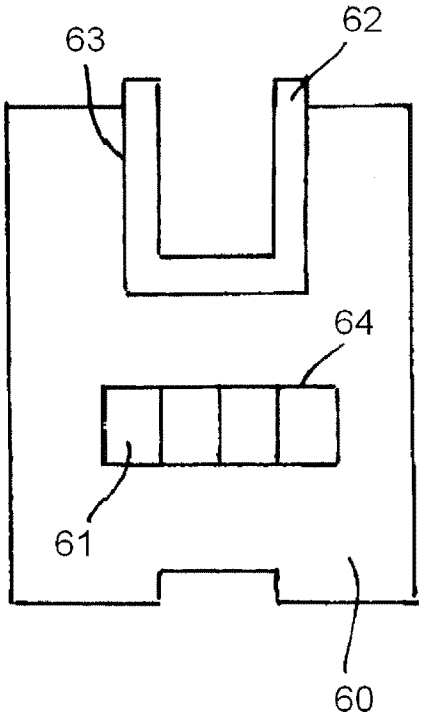
FIG. 15 shows a cross-section of an edge-protection.

FIG. 15 shows a cross-section of the edge-protection 60 that differs from the edge-protection of FIG. 3 in that recess 63, intended to accommodate the glass-sheet, is provided with an insert 62, which may be replaced by other inserts, when other glass-sheets need to or should be accommodated. Additionally, recess 64, which is centered below recess 63, is provided for not just one reinforcing profile 61, but for multiple reinforcing profiles.

Figure 16:
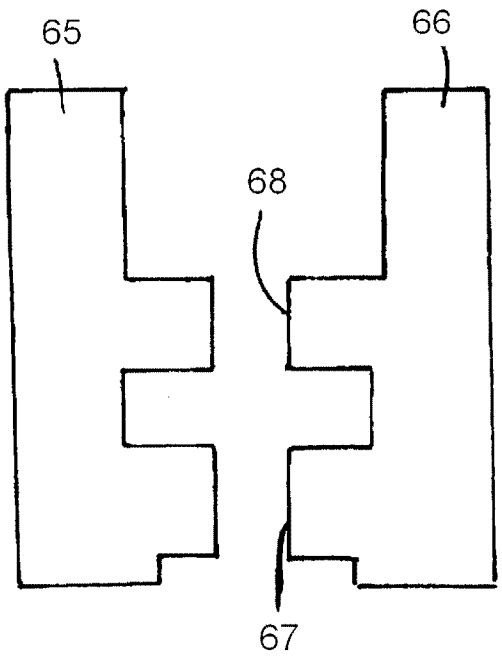
FIG. 16 shows a cross-section of an edge-protection.

FIG. 16 differs from the one-piece cross-section of FIG. 3 in that it shows two-halves 65 and 66, which are brought together at their cross-section, as shown in FIG. 3. In the version example the contact-surfaces 67 and 68 of the two halves are positioned on the center line when assembled. The halves are made of the same foam-plastic as in the version example in FIG. 3.

To connect the two-halves 65 and 66, the contact surfaces are melted and pressed against each other, creating a weld.

Figure 17:
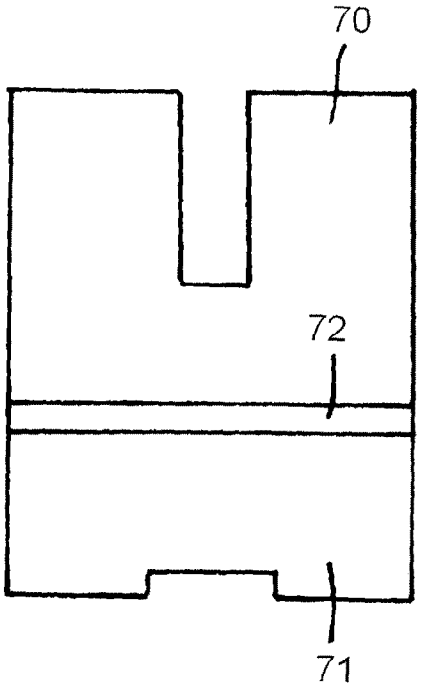
FIG. 17 shows the cross-section of another edge-protector.

FIG. 17 shows the cross-section of another edge-protector. This edge-protector has the same recess for the glass-sheet as shown in FIG. 3 and the same recess for the strapping-band as shown in FIG. 3. In difference from the version example in FIG. 3, the cross-section shown in FIG. 17 comprises the three parts 70, 71 and 72. The parts 70 and 71 comprise the same foam-plastic as provided in FIG. 3. The parts 70 and 71 thus form the yielding material. At the same time, part 70 forms the recess, in which the glass-sheet is placed, while part 71 functions as the recess for the strapping-band. A reinforcing layer 72 of a expanded plastic is provided between the two parts. Like parts 70 and 71, this plastic is also made of polystyrene, making it possible to weld parts together.

For other version examples, other materials are provided. If materials are provided that cannot be welded, gluing can be used.

Figure 18:
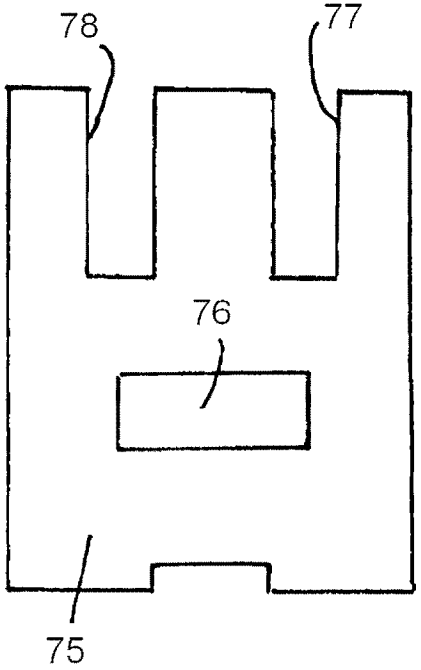
FIG. 18 shows a version example with a cross-section.

FIG. 18 shows a version example with a cross-section 75, which has a similar recess 76 as used in the cross-section shown in FIG. 3. It also has the same recess for the strapping-band. In contrast to FIG. 3, two recesses 77 and 78 are provided for placing two parallel-arranged or substantially parallel-arranged, spaced apart glass-sheets.

Figure 24:
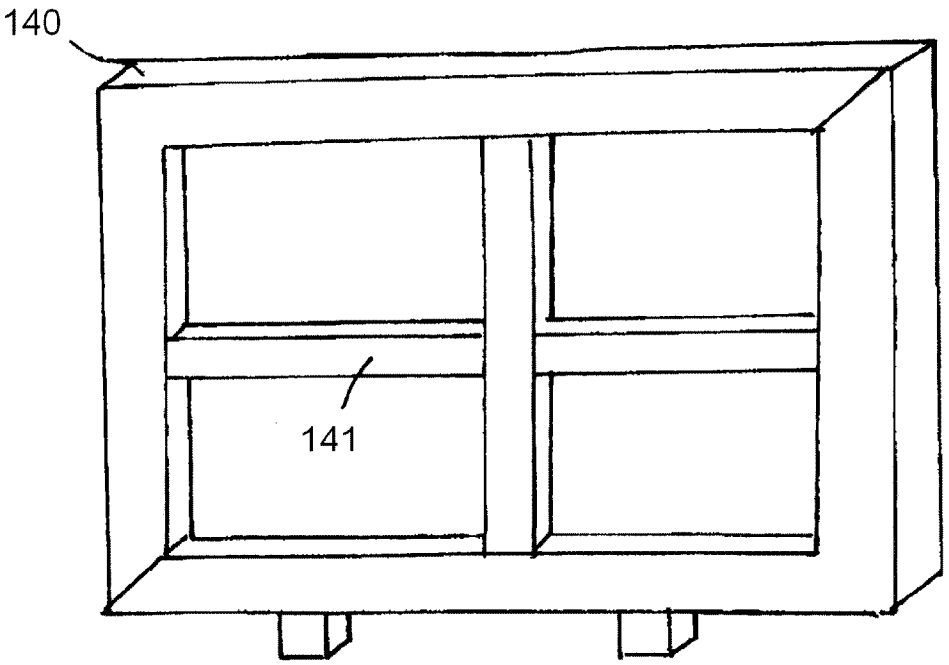
FIG. 24 shows another version example of an edge-protection.

FIG. 24 shows another version example that differs from other versions in that in the hollow on both sides of the glass-sheet enclosed by the edge-protection 140, a cross 141 made of foam-plastic is provided to further secure the glass-sheet. The struts from the cross forms a brace. In the current version example, the cross is made of the same foam as the yielding material.

In other version examples, one or more struts are provided instead of the cross.

Furthermore FIG. 24 shows an edge-protection, composed of an upper profile/side, a lower profile/side and two similar side profiles. In this, the edge-protection forms a rectangular frame corresponding with the rectangular glass-sheet that needs to or should be packaged. The different profiles extend between two adjacent corners of the frame.

Figure 25:
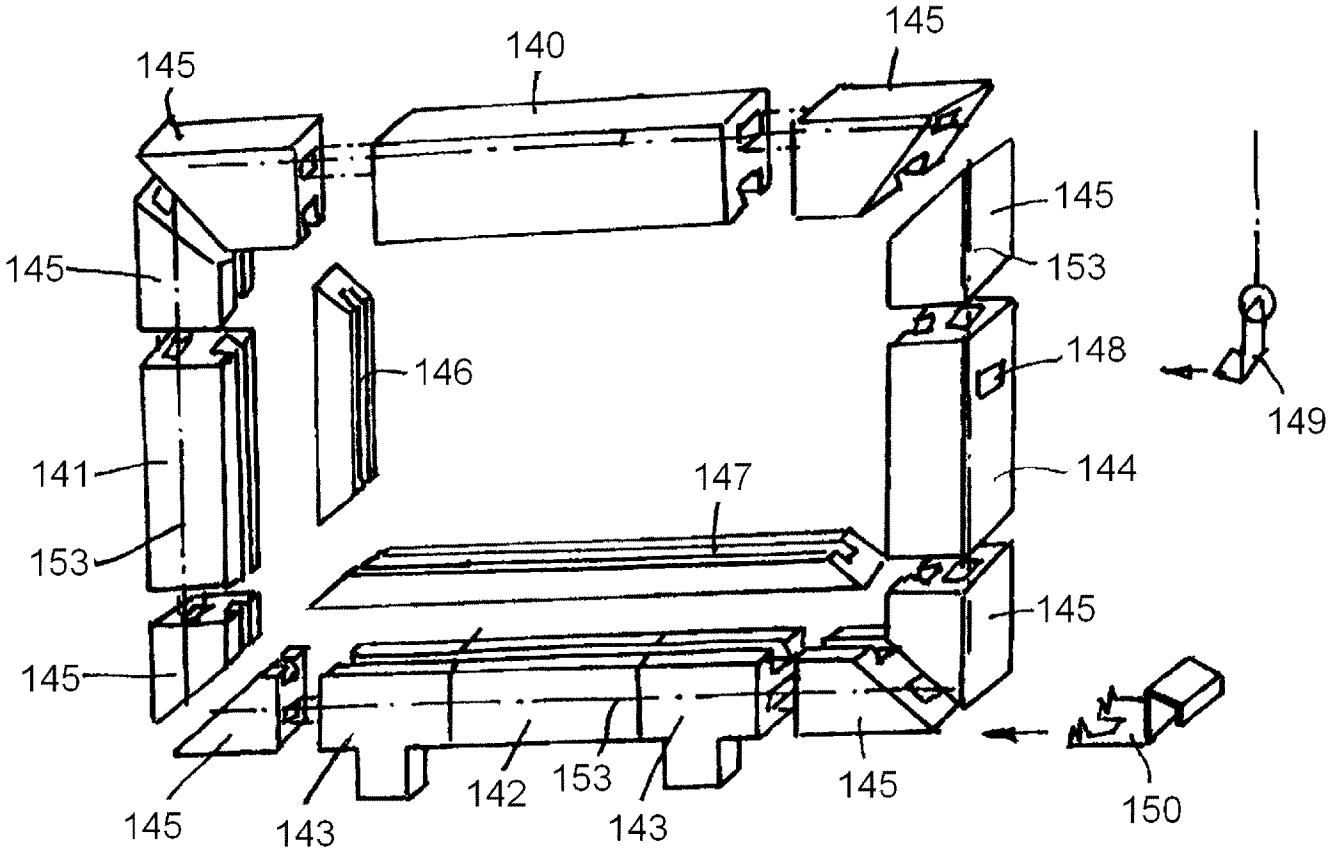
FIG. 25 shows another version example of an edge-protection.

According to FIG. 25, the profiles shown in FIG. 24 are divided into different sections. The sections are labeled 140, 141, 142, 143, 144 and 145. The sections 140, 141, 142, 143, 144 and 145 have a profile with a cross-section corresponding to the cross-section shown in FIG. 13. The sections 140, 141, 142, 143, 144 and 145 were created by cutting the right length from profile bars/rods. In addition, the sections 145 are mitered. Finally, sections 143 are also provided with forklift-feet.

Each section 140, 141, 144, 142 and 143 is placed with two mitered-cut sections 145 on wooden profiles, whose cross-section is shown and in the remaining's of this document show as dashed and dash-dotted center lines 153. In this example, the inserts 146 and 147 are pushed into the corresponding grooves. In this way parts are created corresponding to the profiles/sides/side profiles as described in FIG. 24. The wooden profiles give the profiles/sides/side-profiles composed of individual sections already considerable support, allowing the edge-protection to be placed around the glass-sheet. The required or desired additional cohesion with the glass-sheet is realized by the strapping. In sections 140, 141, 144, 141, 143 and 145 corresponding recesses for the wooden profiles are provided. Due to the strapping tension of the strapping-band, it is not necessary or desired to connect the ends of the wooden profiles. This makes for easier installing of the packaging.

In other version examples, sections 140, 141, 144, 142 and 143, with the exception of one for each section of the profile/side/side-profile, have the same profile length. This one profile section has a customized length and can therefore be referred to as a fitting section. Using the same length for the other sections streamlines production. For larger quantities it opens up the possibility of producing the sections as particle-foam parts. Obtaining a complex mold is a prerequisite for the production of particle-foam parts, which is worthwhile when quantities are large enough, even when particle-foam is cheaper than extruded foam.

Figure 26:
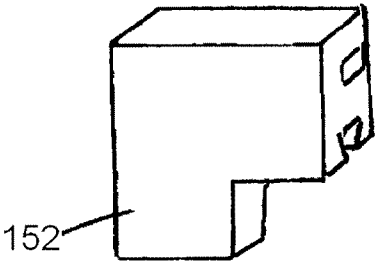
FIG. 26 shows another version example of an edge-protection.

According to FIG. 26, instead of the sections 145 providing the corners as shown in FIG. 25, corner pieces out of one piece 152 are provided. The corner pieces 152 may contribute to an efficient production, because they make miter-cuts unnecessary or undesired, which otherwise cause significant waste/scrap.

In the corner-pieces, the wooden-profiles may abut one another bluntly, or abut one another with a miter-cut, or a small distance may even remain in between.

Figure 26A:
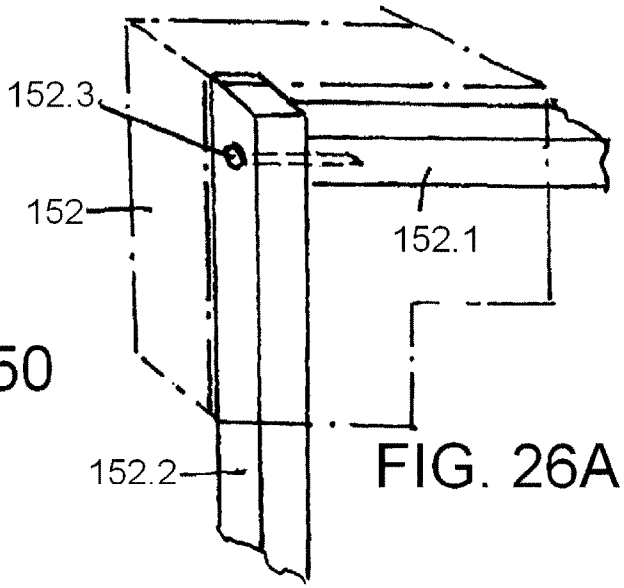
FIG. 26A shows another version example of an edge-protection.

FIG. 26A shows the situation where the blunt ends of the wooden-profiles 152.1 and 152.2 abut one another. The corner-piece 152 of FIG. 26 is shown in dash-dotted lines. In other version examples, instead of the wooden profiles loosely abutting each other, a connection of the wood-profiles is provided. The connection can be used as an assembly aid, or it can provide cohesion for the packaging if so required or desired, either alone or in combination with the strapping of the packaging. As a connection, a screw 152.3 is provided. The screw can be easily screwed through the corner-piece 152, because the corner-piece 152.1 has an opening for the wooden profile extending from one end to the other. The same is true for the opening 152.2 of the wood-profile. Both openings cross. As a result, the screw 152.3 can be screwed through the wooden profile opening 152.2, and into the profile 152.1.

In the version example according to FIG. 25, more transport-aids besides the forklift-feet are provided, shown as the hooks 149 and handles 150.

In the version example, the hooks combine with the openings 148 provided in the side-profiles 144. The hooks 149 can be hooked in the openings 148, making it possible to transport the glass-sheets in their packaging in a suspended manner.

This has significant possibilities on construction sites, because cranes or other lifting equipment are often used on site. With these provisions, transporting a glass-sheet by hand becomes partly unnecessary or undesired.

If however a glass-sheet transport by hand is required or desired, a handle 150 attached to the packaging can be very helpful. The handle 150 differs from the version example in FIG. 21 and FIG. 22 in that it is made of S-shaped, or meandering bent sheet metal, or it comprises molded plastic. The handle 150 is attached to the lower corners of the packaging and should grip into the package with claws. At the same time, the handle 150 can encompass the corners of the packaging, thereby adding to the corner protection and improving the seating of the handle 150 at the packaging corner.

Figure 29:
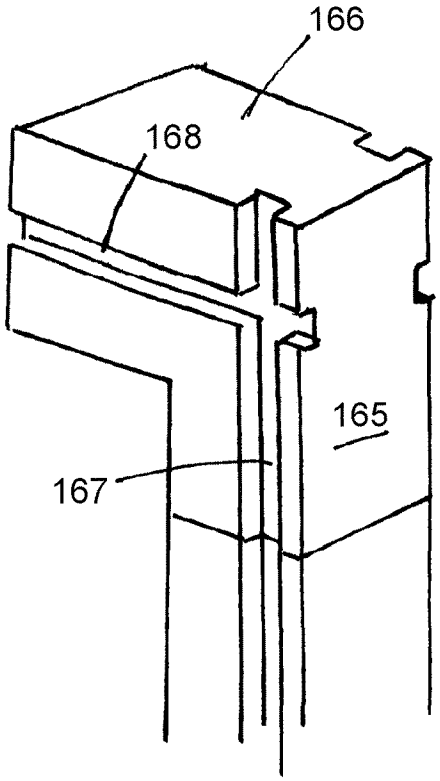
FIG. 29 shows a further application of the edge-protection profile.

FIG. 29 shows a further application of the edge-protection profile of the present application shown in FIG. 27. Here, the edge-protection is composed of sections 165 and corner pieces 166. As already shown in FIG. 27, grooves/recesses are provided on the sides of the sections 165 with dove-tail-shaped cross-sections. These grooves continue in the corner pieces 166, up to the ends of the corner pieces 166, so that it is possible to slide accessories on at the corner pieces. The accessories grip into the grooves/recesses with, in cross-section, dove-tail-shaped tongues/protrusions.

Figure 30:
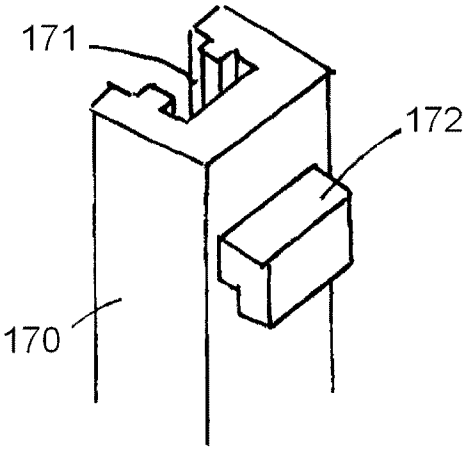
FIG. 30 shows an accessory.

An accessory is shown in FIG. 30. It concerns a U-shaped sleeve 170, which can be slid onto the outside of the edge-protection as shown in FIG. 29. For this, the inside of the sleeve 170 fits the outer shape of the edge-protection. That is, the width of the inside space is equal to the width of the edge-protection plus the necessary or desired freedom of movement to allow the sleeve 170 to be slid on. Moreover, as with other accessories, tongues/protrusions with dove-tail-shaped cross-sections are provided, which connect with sufficient freedom of movement into the grooves/recesses of the edge-protection. This includes a corresponding distance of the tongues/protrusions from the deepest part of the sleeve 170.

The sleeve 170 is equipped with a handle 172. After blocking the sleeve 170 at a desired position, the glass-sheet with its packaging can be carried by hand using the handle 172. In the version example, blocking by inserting a small wedge (not shown) between sleeve and edge-protection is provided. In the version example, when the cargo/packaged-good is to be carried by the sleeves, it is inserted from above. This has the possibility that the wedges cannot fall out from the gap between the sleeve and the packaging.

The shorter the sleeve 170 becomes, and if the sleeve length is shortened to such an extent that one can speak of a bracket, the more a situation occurs where the sleeve will self-lock onto the packaging. The force engaging on the handle forces a tilting of the sleeve 170 towards the packaging. A small tilting is already sufficient when both the packaging and the sleeve are made of foam-plastic, which is cut at the contact surface. The self-locking does not interfere with the ability to move the sleeve 170 on the packaging if the sleeve 170 is made to hold in the area of the dove-tail-shaped grooves/recesses and tongues/protrusions, so that the sliding forces are exerted there.

The handle 172 can also be used as a hook for suspended transport of the glass-sheet and its packaging.

FIGS. 31 and 32 show further version examples of handles. In both cases, the handles are shaped like a bracket, created by shortening the sleeve, resulting in a self-locking attachment/transport-aid as shown in FIG. 30.

FIG. 31 shows a bracket 175 that has an opening 177, which has the same cross-section as the sleeve 170. As a result, the bracket 175 can be slid onto the edge-protection just like the sleeve 170. In one possible embodiment, tilting blocks the bracket inside the recesses/grooves when a corresponding pull is applied to the bracket. For that, a handle opening 176 is provided in the bracket. Using a hook that hooks into the handle's opening or through which a means to pull is guided and secured, a suspended transport becomes possible.

Figure 31A:
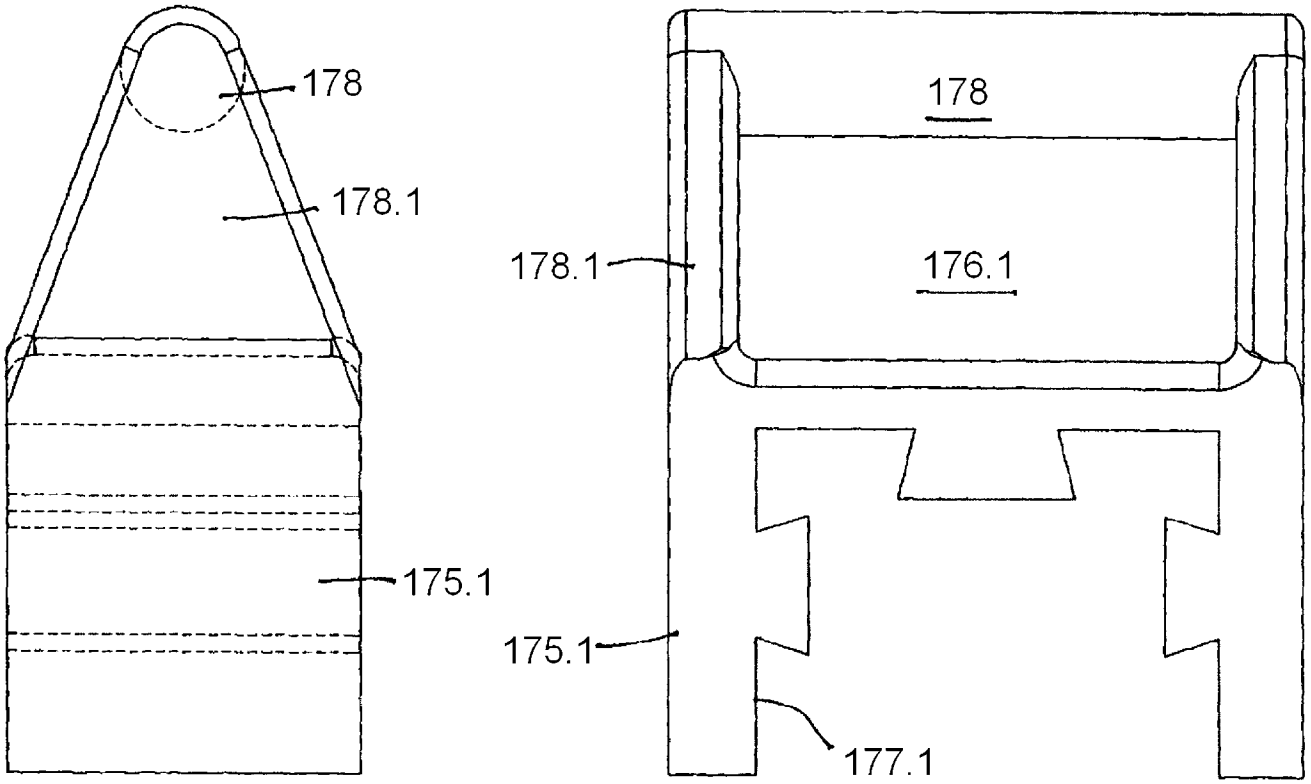
FIG. 31A shows a handle.

FIG. 31A builds on the version example of a handle that can slide onto the packaging as in FIG. 31. FIG. 31A provides the same recess as in FIG. 31, but referred to as 177.1. The material that covers the packaging material is the same as in FIG. 31 and referred to as 175.1. However, an ergonomically enhanced shape is selected on the opposite side of the recess 175.1. The handle 178 has no sharp edges, but is rounded and therefore more pleasant to use. The handle bar 178 is held between two sides, which taper from the enclosing material 175.1 to the handle bar 178.

This transport-aid, like the other transport-aids, is made of plastic. However, reinforcement by creating a mantle or coating is provided, as described elsewhere for the reinforcement of foam-plastic.

FIG. 32 also shows a bracket-like accessory/transport-aid 180 that differs from the accessory shown in FIG. 31 in that it is shaped like a hook, attached to the opposite side of the recess 181. The hook-shaped end 182 can be used as a handle or can be used for a hitch like type of traction device.

Figure 32A:
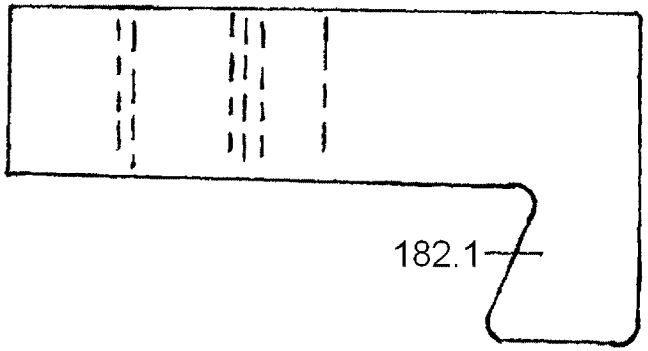
FIG. 32A shows another handle as a transport-aid.

FIG. 32A shows another handle 182.1 as a transport-aid, which differs from the handle of FIG. 32 in having a better ergonomic shape. When using this transport-aid as a hook, it will provide more security against the possibility of cables or similar type lifting means slipping off.

The accessories/transport-aids shown in FIG. 31 and FIG. 32 can also be used as forklift-feet, by pushing them from the outside onto the bottom edge-protection. According to FIG. 33, a special part 190 is optionally provided as an accessory/transport-aid that differs from the accessories shown in FIG. 31 and FIG. 32 in that it has neither a handle opening nor a hooked-end.

Figure 33:
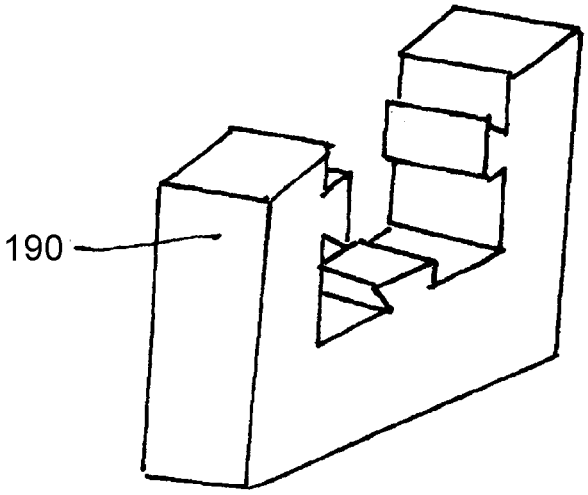
FIG. 33 shows a part is optionally provided as an accessory/transport-aid.

In one possible embodiment, when used as forklift-feet, the accessories shown in FIGS. 31 to 33 improve to the stability of the glass-sheet and its packaging, because they create a wider contact area.

Figure 34:
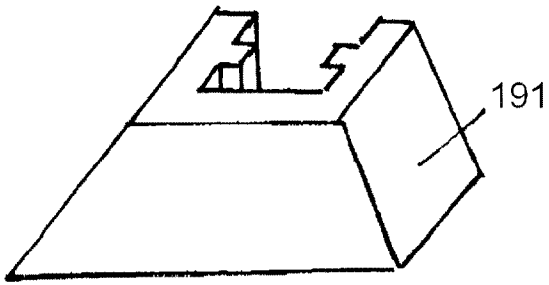
FIG. 34 shows a foot as an accessory.

FIG. 34 shows a special foot 191 as an accessory, which creates an even wider contact area in comparison to the accessories shown in FIGS. 31 to 33. The foot 191 is slid onto the packaging at the bottom corners.

Figure 35:
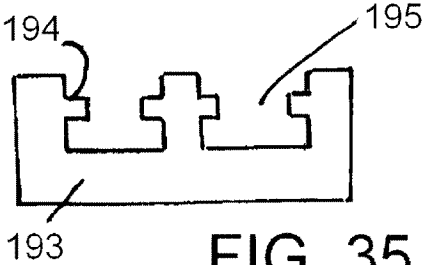
FIG. 35 shows another accessory.

FIG. 35 shows another accessory 193 for the packaging according to the present application. The accessory 193 has two openings 194 and 195, both of which are able to slide over the packaging/edge-protection of the present application. This allows for the packaging of two sheets of glass to be joined. In one possible embodiment, the glass packaging and the glass-sheets will then support each other.

Figure 36:
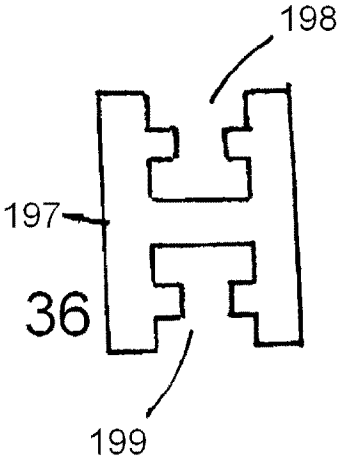
FIG. 36 shows an accessory/transport-aid.

FIG. 36 also shows an accessory/transport-aid for a connection between two glass-sheets and their packaging. In this situation however, a connection profile 197 is provided to connect glass-sheets and their packaging standing one behind the other. To achieve this, the connection profile has a H-shape with consecutive openings 198 and 199, which allows the connecting profile to be slid over the packaging/edge-protection of the present application.

Figure 37:
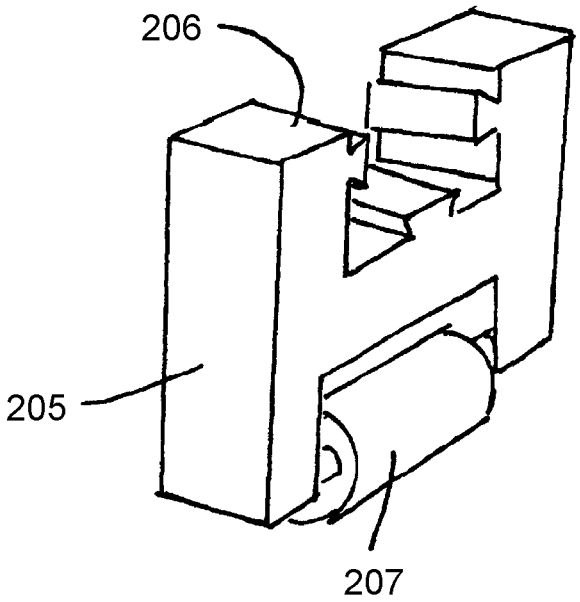
FIG. 37 shows an H-shaped transport-aid.

FIG. 37 also shows an H-shaped transport-aid 205, where the upper opening 206 is intended to grip the lower edge of the packaging/edge-protection according to the present application with the opening facing upwards, with a roller 207 positioned in the lower opening so that the glass-sheet, together with its packaging, can be moved, with the aid of the transport-aid.

Figure 38:
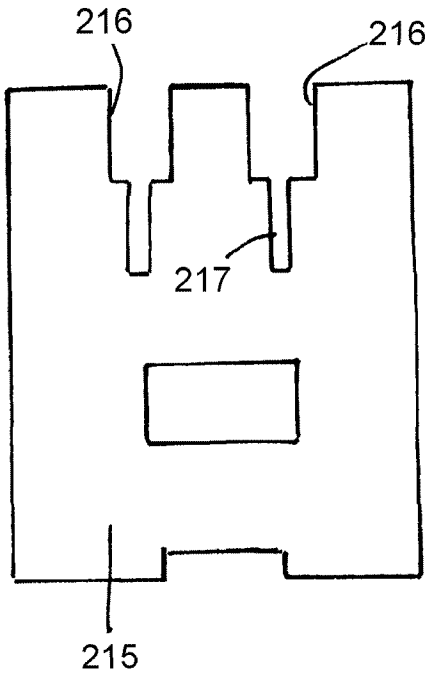
FIG. 38 shows a variation of the edge-protection of FIG. 19.

FIG. 38 builds on the profile for the edge-protection of FIG. 19, which forms the yielding material for the edge-protection of the present application. The profile shown in FIG. 19 shows a single recess 101 for placing an insert to hold the glass-sheet. The insert is exchangeable and by changing the selected thickness, it can be adjusted to suit the thickness of the glass-sheet.

This way, a variety of glass thicknesses can be placed into the inserts: for example, five or ten or more different glass-sheets can be held, depending on the dimensions of the inserts. Profile 215 in FIG. 38 differs in that two side-by-side recesses are provided. In this version example the two recesses are designed to hold the glass-sheets directly, without the use of an insert (as shown in FIGS. 14 to 14F).

Other version examples are also intended to hold the glass-sheets without the use of inserts and show to the same recesses as the inserts of FIGS. 14 to 14F.

The recesses in the possible version of FIG. 38 are stepped. On the top side, the recesses are made to hold glass-sheets with a thickness of eight millimeters towards the deepest side of each recess 216, a narrowing 217 is provided to hold glass-sheets with a thickness of six millimeters.

Therefore the profile in FIG. 38 can accommodate two glass-sheet thicknesses.

Figure 39:
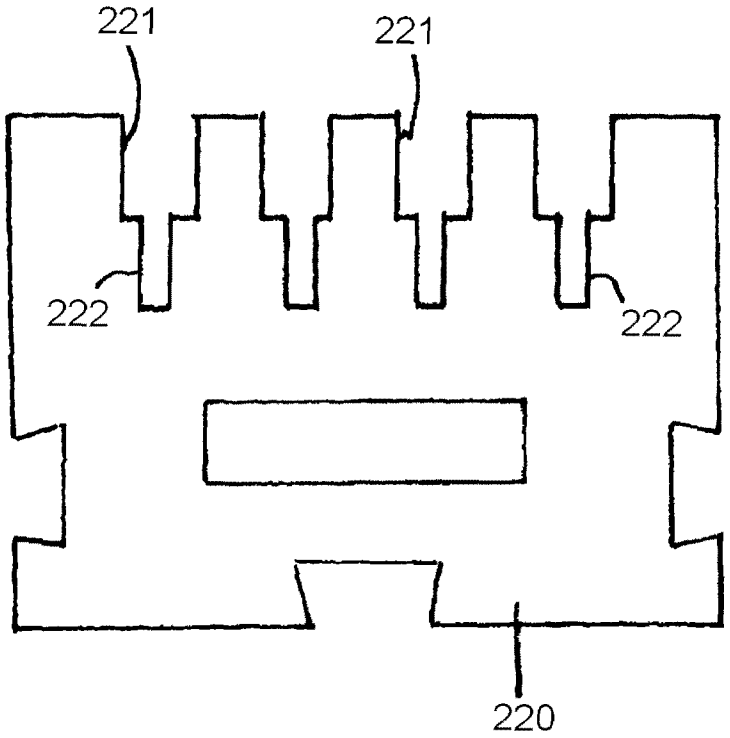
FIG. 39 and FIG. 40 show other profiles for the edge-protection.
Figure 40:
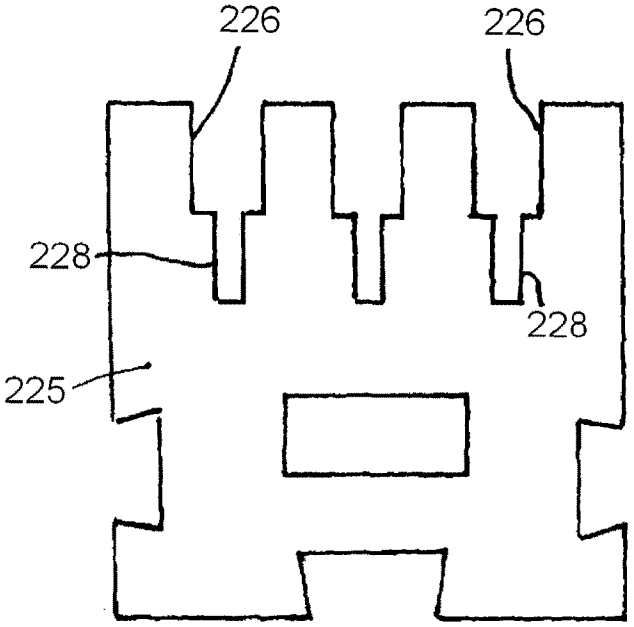

FIG. 39 and FIG. 40 show other profiles for the edge-protection according to the present application, which are also intended to hold the glass-sheets directly.

The profile 220 in FIG. 39 has four recesses 221 with narrowings 222 towards their deepest side. In the version example, the recesses 221 and 222 are provided for other glass-sheet thicknesses than with the profile in FIG. 38.

FIG. 40 shows a profile 225 with recesses 226 and narrowings 228 at their deepest. The profile 225 is intended for further glass-sheet thicknesses.

Figure 41:
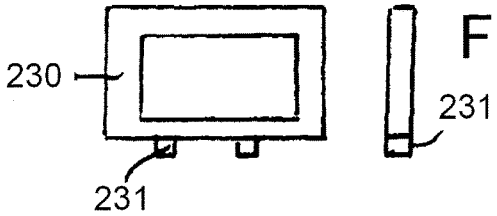
FIG. 41 shows a packaging.

FIGS. 40 to 47 show various packaging for glass-sheets in comparison to one-another. Packages enclose the glass-sheet in a frame-shape. FIG. 41 shows a packaging 23 that is permanently or substantially permanently provided with forklift-feet 231.

Figure 42:
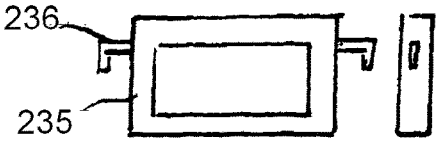
FIG. 42 shows a frame.
Figure 43:
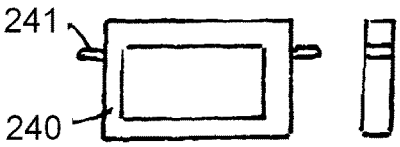
FIG. 43 shows a frame.

FIG. 42 shows a frame 235 with permanently or substantially permanently provided band-hooks 241. These are hooks allowing the frame, hanging on bands, to be transported in a suspended manner. FIG. 43 shows a frame 240 with permanently or substantially permanently provided handles 241, which allows the frame to be carried by the handles.

Figure 44A:
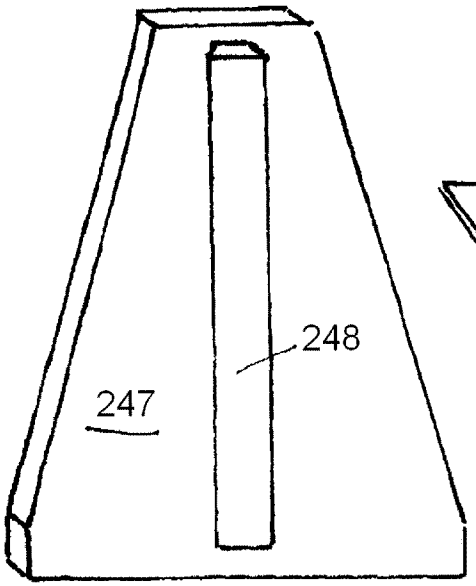
FIG. 44A shows the feet in detail.
Figure 44:
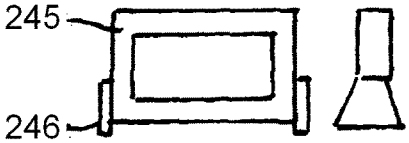
FIG. 44 shows a frame.

FIG. 44 shows a frame 245 with feet 246 attached to it. The feet serve to position the frame 245 with the glass-sheet firmly on the ground in an upright position. FIG. 44A shows the feet in detail. It shows that the feet comprise a triangular plate 247 and a tongue 248.

The tongue 248 is meant to slide into the grooves described above, which are provided on the outside of the packaging.

Both plate and tongue can be made of foam-plastic, so that both parts can be manufactured as one-piece. Using a plate-shape saves space. On the other hand, a thin plate is easily damaged. To reduce the risk of damage, strengthening the foam-plastic plate will be possible. To achieve this, the plate can be given a mantle or coat, or be reinforced in the same way as described elsewhere for the profiles, which form the packaging for the glass-sheets.

In other version examples, the plate and the tongue are made of different materials. The connection can be made by gluing, or in a conventional mechanical manner. The feet can be mounted flush to the packaging and they can create distance between the packaging and the ground. In this case it is possible to create a small plinth to the feet that grips the packaging. The plinth creates a corresponding distance of the packaging to the contact area.

Figure 45:
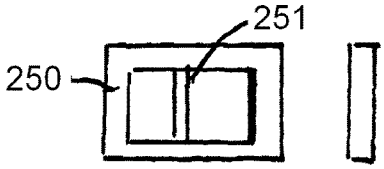
FIG. 45 shows a frame.

FIG. 45 shows a frame 250 with a built-in strut 251 to stiffen the frame.

Figure 46:
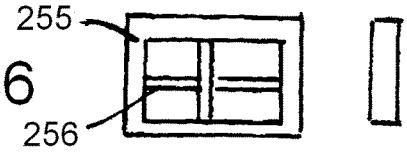
FIG. 46 shows a frame.

FIG. 46 shows a frame 255 with multiple struts 256, connected in the form of a cross, to stiffen the frame.

Figure 47:
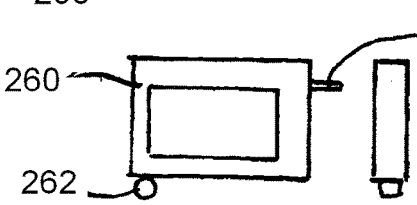
FIG. 47 shows a frame.

FIG. 47 shows a frame 260 with a handle 261 at the upper end of the frame on one frame-side, and a roller 262 underneath the frame on the opposite frame-side.

FIG. 48 builds on FIG. 19 and shows a profile 265 with further profiles 266, 267 and 268. Profiles 266, 267 and 268 are made of the same foam-plastic as profile 265 and serve to thicken profile 265. The additional profiles 266, 267 and 268 grip into the grooves of profile 265. The details of the grooves are described in FIG. 19.

These grooves correspond with tongues in the profiles 266, 267 and 268. The tongues are part of a so-called tongue and groove connection. The tongues are formed by protrusions/bulges on the profiles 266, 267 and 268, which match the grooves cross-sectional, so that the profiles can be slid into the grooves with the tongues.

In another version example, profiles 266, 267 and 268 comprise open-cell foam-plastic with an open-cell percentage of thirty percent. The open-cell percentage is indicated as a percentage of the total number of cells. The open-cell percentage is measured by counting the open cells on a straight line per unit length.

The open-cell structure causes a damping characteristic of the profiles 266, 267 and 268; during deformation the air can escape from the open cells, allowing a slow reset/recovery of the profiles after release. This prevents or minimizes the cargo from vibrating after being bumped into or bumping against an object. For sensitive glass like float glass, this has considerable possibilities.

In other version examples, profiles 266, 267 and 268 may have a different cross-sectional shape, for example with curvatures or nubs on the surface.

FIGS. 48A and 48B show variations of the thickening profiles 266, 267 and 268 as shown in FIG. 48. The figures show thickened profiles 270 and 271, whose tongues 272 and 273 respectively are in a different position. It means that, in modification of the version example in FIG. 48, the lengths, thicknesses, and arrangement of the tongues on the thickening profiles 266 to 268 can vary over a wide range.

FIGS. 48C and 48D show containers as two additional transport-aids for the packaging of the present application, with which accessories and/or transport documents and/or assembly instructions can be sent. The container according to FIG. 48D is small; the container according to FIG. 48C in comparison large. Both containers have a tongue 290 or 299 that allows them to be inserted into the available grooves of the packaging. In both figures the containers 291 and 298 show a tubular shape. After filling the containers they are sealed with lids (not shown).

FIG. 48E shows an eyelet as yet another transport-aid for the packaging according to the present application. This transport-aid comprises a part 300, which is identical to part 175.1 of FIG. 31A that encompasses the packaging, but is now equipped with a ridge 301.

Like the other transport-aids, the eyelet is made of plastic. However, the plastic is reinforced by providing it with a coat or mantle, in the same way as described elsewhere for the reinforcement of foam-plastic.

The eyelets are suitable both for attaching lifting means, such as hooks and cables, as well as for transport securing.

When used as lifting means, the eyelets may be pushed onto the sides of the edge-protection, that are the top and bottom sides of the frame-like packaging surrounding the glass-sheet.

The same applies to the upper end of the packaging, where the lowest load on the packaging can be expected.

For using eyelets to secure the load, the same applies as for attaching lifting means.

Figure 48F:
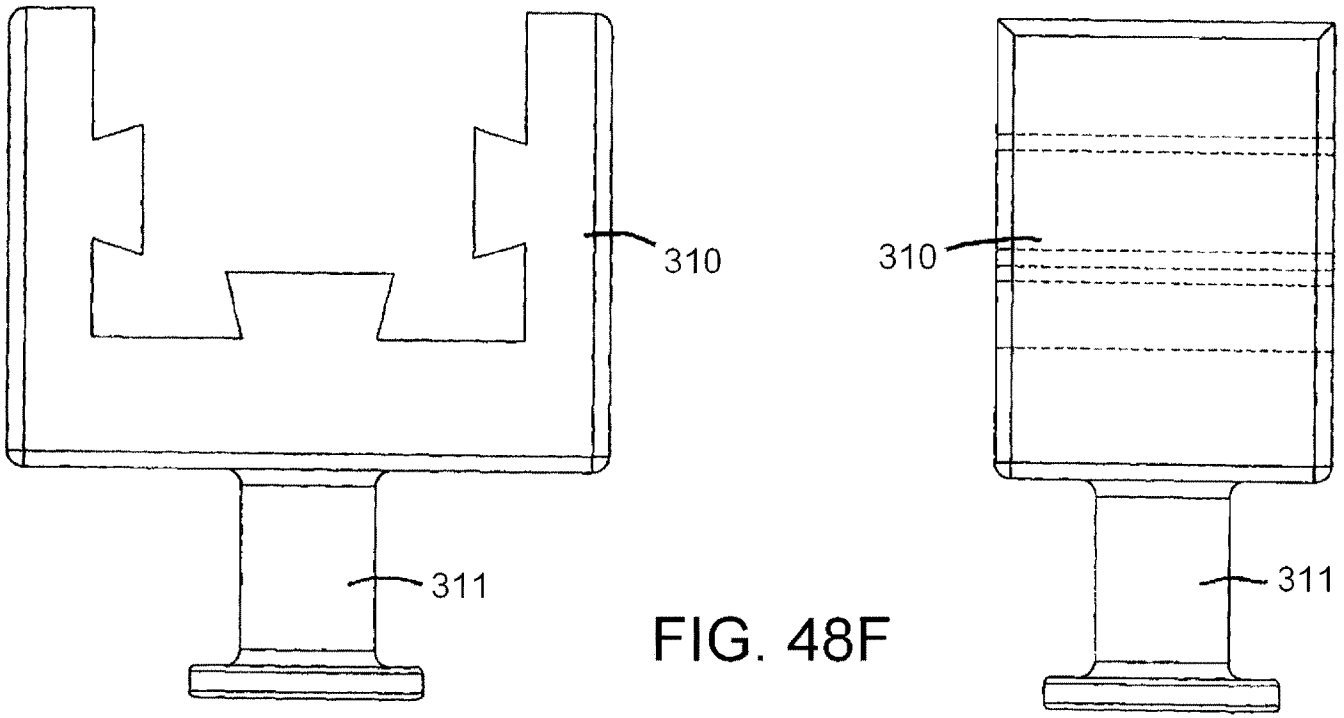
FIG. 48F shows a transport-aid with a pin.

FIG. 48F shows a transport-aid with a pin. The transport-aid serves to attach lifting means such as cables and hooks. But it can also be used to allow for carrying by hand. This additional transport-aid comprises a part 310 that is identical to the part that covers the packaging 175.1 in FIG. 31A, but in which a pin 311 has now been integrated. Like the other transport-aids, this transport-aid is made of plastic. However, the plastic is reinforced through formation of an outer coat or mantle, in the same way as described elsewhere for the reinforcement of foam-plastic. The spigots are pushed onto the sides that connect the top and bottom of the packaging.

Figure 51:
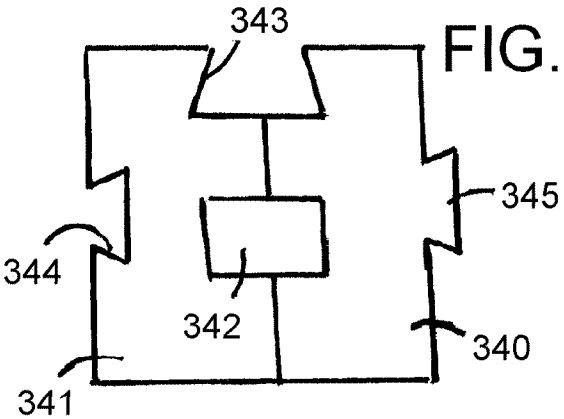
FIG. 51 shows two profile-halves.

FIG. 51 shows two profile-halves 340 and 341, which have a cavity 342 in which a wooden rod can be inserted as a reinforcement profile. The two profile-halves 340 and 341 are welded together. On the top, the profile has a recess 343 for an insert, which, in this version example, both holds the glass-sheet and protects the edge.

In addition, profile-half 341 has a groove for a tongue from a tongue and groove connection.

The profile-half 340 has a tongue 345 for a groove from a tongue and groove connection. The tongue and groove connection is dovetail shaped. Using two profile-halves and welding them together has possibilities for smaller quantities. It then becomes economical to cut the profile-halves out of foam boards.

Figure 52:
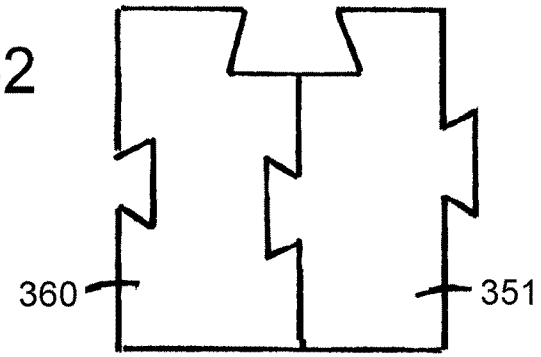
FIG. 52 shows two different profile-halves.

The profile in FIG. 52 differs from the profile in FIG. 51 in that it uses different profile-halves 351 and 352 as an edge-protection. The two profile-halves of FIG. 52 differ from the profile-halves of FIG. 51 in that they are held together by a tongue and groove connection, that allows them to be disconnected from one-another.

With multiple usage the possibility to disconnect the profile-halves from one another is possible, for example in the situation where damage has occurred to one of the profile-halves, which can then simply be replaced with an undamaged profile half. Furthermore, the ability to disconnect creates a significant possibility for the storage of profiles for different profile cross-sections.

If multiple sheets are to be packed simultaneously or substantially simultaneously side-by-side and small quantities per type of sheet are required or desired, it may be possible to select the profile halves 350 and 352 as side-profiles and to space them by means of center-profiles 353 and 354, in order to enlarge the space for inserting the glass-sheets.

Figure 53:
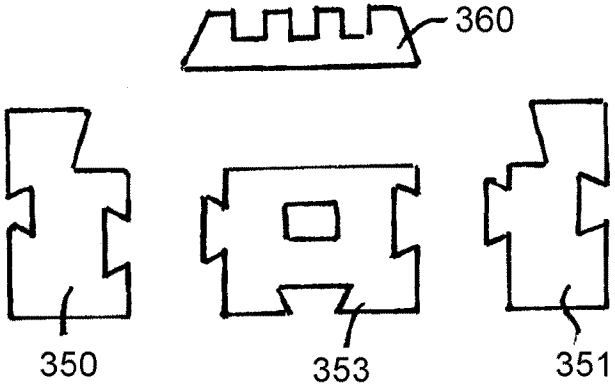
FIG. 53 shows a profile with a center-profile.

FIG. 53 shows a profile with a center-profile 353 between two side-profiles 350 and 351. The two side-profiles and the middle-profile can be connected with an insert 360 that can hold three glass-sheets.

Figure 54:
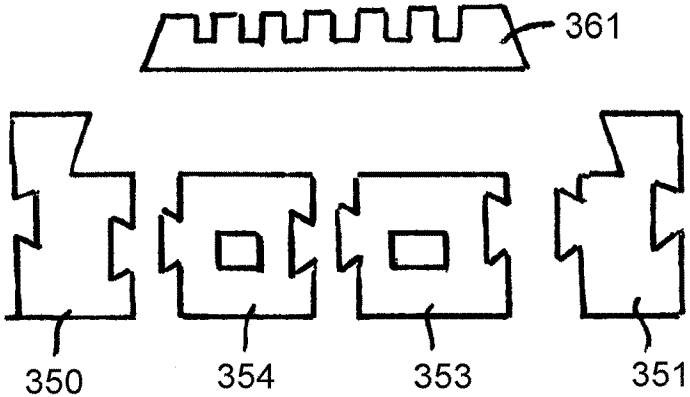
FIG. 54 shows a profile with two center-profiles.

FIG. 54 shows a profile with two center-profiles 353 and 354 between the side-profiles 350 and 351. These center-profiles can be connected to both the side-profiles and an insert 361, made to hold six glass-sheets.

The following patent publications are incorporated by reference as if set forth in their entirety herein: DE602004013008, having the title "LAMINATES AND METHODS OF MAKING SAME," published on May 14, 2009; DE202010008929, having the title "Abstandhalteranordnung und Verbund-System," published on Mar. 17, 2011; DE202010008532, having the title "Bauteil für die lnnenausstattung eines Fahrzeuges," published on Dec. 16, 2011; DE20200900339; DE20200900692; DE202008017621, having the title "Belt bar for use in belt integral seat in e.g. air vehicle, has set of sheet metal profiles partly slid into each other by latch-in connection such that bar is L-shaped and region of bend of L-form is strengthened with ribs," published on Aug. 19, 2010; DE2020080016r847; DE202008013755, having the title "Flächiges Verstärkungs-oder Stabilisierungselement und Befestigungsvorrichtung für ein Photovoltaikmodul," published on Mar. 5, 2009; DE202008012066, having the title "Quertragermodul für ein Kraftfahrzeug," published on Jan. 28, 2010; DE202008004965, having the title "Kühl-bzw. Thermoelement insbesondere für Solarmodule," published on Jul. 24, 2008; DE202007018064; DE202006017392, having the title "Bauteil aus naturfaserverstärktem Kunststoff, insbesondere Bewehrung," published on May 16, 2007; DE1020111199668; DE102011100025, having the title "Component useful e.g. as radial shaft sealing ring, toothed belt, conveyor belt, rotor blade or plastic component, comprises a surface, on which partially a film with wear protection and/or anti-adhesion effect is applied," published on Oct. 31, 2012; DE102010053740, having the title "Method for manufacturing e.g. metallic or non-metallic film cut or film insert with interruption structure, involves attaching interruption structure, distant and opened areas in metal foil, coated foil or sheet mold via punching," published on Jun. 14, 2012; DE102020050874; DE102010030310, having the title "Verbundprofil und Verfahren zur Herstellung eines Verstärkungselementes für ein Verbundprofil," published on Dec. 22, 2011; DE102009046413, having the title "Solidifying an adhesive during joining of components, useful in automotive industry, comprises forming first and second components as an overlapping joint with each other, and solidifying circulating adhesive by introducing heat at joint," published on May 5, 2011; DE1020090141574; DE19849149, having the title "Plastic foam stopper for containers, especially bottles," published on Sep. 16, 1999; DE19726959, having the title "Plastics granulator with planetary extruder," published on Nov. 26, 1998; DE19726415, having the title "Planet roller stuffing screw feeding recycled thermoplastic foam to re-granulating extruder," published on Dec. 3, 1998; DE19539511, having the title "Perimeter insulation in building area in contact with earth," published on Apr. 30, 1997; DE10315090, having the title "Foam insulation board, with a minimum thickness of 70 mm, is composed of two foam boards of alternative materials free of halogenated fluorocarbons, bonded together by a hot-melt and reaction adhesive," published on Oct. 21, 2004; DE10251505, having the title "Strengthened Packaging," published on May 19, 2004; DE10245470, having the title "Foamed heat insulation material, e.g. for tunnel lining, is built up of joined extruded sheets and contains aluminum flakes," published on Apr. 8, 2004; DE10151334, having the title "Process for manufacturing open celled plastic foam having retarded compression recovery," published on Apr. 30, 2003; DE10124061, having the title "Solvent welding of extruded foam panels to form very thick insulation panels involves removal of skin from extruded panels, coating with solvent and pressing together," published on Feb. 27, 2003; DE10106341, having the title "Kunststoffschaumplatten grosser Dicke," published on Jul. 18, 2002; DE10003808, having the title "Oberflächenpragung von Kunststoffschaumplatten," published on Aug. 9, 2001; DE2032243, having the title "Cellular styrene type copolymer articles," published on Jan. 5, 1972; DE102004050867, having the title "Computer controlled polystyrene cutter e.g. for advertising material, involves a cutting wire held in a bow carried on a vertical traversing column," published on May 4, 2006; DE19803915, having the title "Production of constructional board for ceilings, etc.," published on Jun. 10, 1999; DE19607897, having the title "Shuttering element used in construction," published on Oct. 17, 1996; DE19607896, having the title "Concrete lost shells," published on Sep. 11, 1997; DE9110930, having applicant KRAMIG, GEBHARD H, published on Dec. 19, 1991; DE6903524, having the title "GERAET ZUM ZERTRENNEN VON KUNSTSTOFF-SCHAEUMEN," published on Aug. 7, 1969; DE2741725, having the title "VERFAHREN ZUM HERSTELLEN VON PROFILLEISTEN AUS KUNSTSTOFF UND PLATTEN-FOERMIGES FORMTEIL ZUR DURCHFUEHRUNG DES VERFAHRENS," published on Mar. 29, 1979; DE1162064, having the title "Schneidvorrichtung zum Herstellen von Formstuecken aus nachgiebigem oder elastisch nachgiebigem Werkstoff, z.B. Kunststoffschaum," published on Jan. 30, 1964; DE10247190, having the title "Buoyant water toy and exercise device comprises plastic foam disc of limited buoyancy," published on Mar. 18, 2004; DE10226202, having the title "Polypropylene particle production and molding method involves extrusion with carbon dioxide blowing agent under specific conditions and molding with steam to create skins on particles and molded product," published on Feb. 27, 2003; DE3022017, having the title "FORMTEIL FUER DIE INNENAUSKLEIDUNG VON FAHRZEUGEN," published on Dec. 17, 1981; DE 1953181, having the title "SCHIENE AUS KUNSTSTOFF-HARTSCHAUM ZUR STOSSDAEMPFENDEN VERPACKUNG VON PLATTENFOERMIGEN GEGENSTAENDEN, INSBESONDERE GLASSCHEIBEN U. DGL.," published on Jan. 5, 1967; and DE 20204181, having the title "Transportfahrzeug für Flachglasladungen," published on Jul. 4, 2002.

According to the present application, edge-sensitive cargoes are provided with an edge-protection that comprises of at least one yieldable layer and at least one reinforcing layer.

One feature or aspect of an embodiment is believed at the time of the filing of this patent application to possibly reside broadly in a packaging for cargo, in one possible embodiment disc-shaped cargo, in which an edge-protection is provided for at least one outer edge, in which the edge-protection comprises at least partially yielding material and a reinforcing material, in which the yielding material is at least partially disposed between the edge of the cargo and the reinforcing material, in which the yielding material has a yieldability at least twenty percent greater than the yieldability of the reinforcing material, in another possible embodiment at least forty percent, in yet another possible embodiment at least sixty percent and in still another possible embodiment at least eighty percent greater than the yieldability of the reinforcing material.

Another feature or aspect of an embodiment is believed at the time of the filing of this patent application to possibly reside broadly in the packaging for cargo, in one possible embodiment disc-shaped cargo, in which an edge-protection is provided for at least one outer edge, in which the edge-protection comprises at least partially yielding material and a reinforcing material, in which the yielding material is at least partially provided on the outside with a reinforcing material, in which the yielding material has a yieldability which is at least twenty percent greater than the yieldability of the reinforcing material, in another possible embodiment at least forty percent, in yet another possible embodiment at least sixty percent and in still another possible embodiment at least eighty percent greater than the yieldability of the reinforcing material.

Yet another feature or aspect of an embodiment is believed at the time of the filing of this patent application to possibly reside broadly in the packaging for cargo, in one possible embodiment disc-shaped cargo, in which an edge-protection is provided for at least one outer edge, in which the edge-protection comprises a yielding material and a reinforcing material, wherein the fact that the yielding material at least partially encloses the reinforcing material and/or the reinforcing material at least partially encloses the yielding material, in which the yielding material and/or the reinforcing material is either a one-piece section or comprises multiple sections and/or has a one-piece cross-section or multiple-piece cross-section.

Still another feature or aspect of an embodiment is believed at the time of the filing of this patent application to possibly reside broadly in the packaging, wherein: a) Sections made of yielding material and connected together by the reinforcing material and/or further packaging parts, in which the further packaging parts are in one possible embodiment formed by unexpanded materials, which enclose the packaging including the cargo at least partly; b) or the sections are made of reinforcing material and are connected together by the yielding material and/or further packaging parts, in which the further packaging parts are in one possible embodiment formed by unexpanded materials, which enclose the packaging including the cargo at least partially; c) The one-piece packaging comprises yielding material, which is surrounded with the reinforcing material and/or other parts of the packaging and/or the sections in cross-profile comprise multiple profiles, in one possible embodiment side-profiles, combined with at least one middle-profile.

A further feature or aspect of an embodiment is believed at the time of the filing of this patent application to possibly reside broadly in the packaging, wherein: a) A multitude of sections that are held together by external strapping or by an external band, and/or by an external strap, and/or by an external foil, and/or by an external fabric, and/or an external profile, in which the foil and/or the fabric and/or the profile are pressed or tensioned against the sections; b) A multitude of sections held together by an inner lying strapping and/or by an inner lying strapping band and/or inner lying profiles; c) Packaging sections made of one-piece or composed of sections, reinforced by a foil and/or fabric, which encloses the outside of the packaging at least partially; and cc) in one possible embodiment being at least partially laminated onto the packaging, in another possible embodiment whilst put under tension or ccc) in one possible embodiment being embedded into the surface of the yielding material; d) Packaging sections made in one-piece or composed of sections, which are at least partially enclosed on the outside by a fabric, wherein the fabric is a mesh-fabric. Packaging sections made in one-piece or composed of sections which is at least partially provided with a coat or mantle as reinforcement.

Another feature or aspect of an embodiment is believed at the time of the filing of this patent application to possibly reside broadly in the packaging, comprising a section made from yielding material, wherein: a) In which profiles provided as a reinforcing material can be slid onto; and/or b) In which profiles provided as a reinforcing material can be inserted into the yielding material and/or; c) In which from two adjacent sections one section engages with a protrusion into a recess of the other section; and/or d) In which from two adjacent sections one section connects with or into the other section by a connecting means; and/or e) In which one or more sections are externally reinforced with a foil and/or a fabric, in one possible embodiment with a foil and/or fabric that covers at least two sections made of yieldable material and positioned side-by-side or behind one-another in the packaging, in which in another possible embodiment, the foil or the fabric is laminated onto the yielding material; and/or f) In which the mantle or coat is an extrusion skin, or a skin of a filament cut, or a skin that is the result of heat treatment.

Yet another feature or aspect of an embodiment is believed at the time of the filing of this patent application to possibly reside broadly in the packaging, wherein the yielding material is a foam-plastic with at least ninety-five percent closed cells, in one possible embodiment a foam-plastic with at least ten percent open cells, in another possible embodiment with at least twenty percent open cells and in yet another possible embodiment with at least thirty percent open cells.

Still another feature or aspect of an embodiment is believed at the time of the filing of this patent application to possibly reside broadly in the packaging, wherein the reinforcing material is of a metallic, an organic or an inorganic nature, or that it is made of plastic, or that it is made of a mixture of at least two different materials, and in one possible embodiment is produced on a layer-by-layer basis.

A further feature or aspect of an embodiment is believed at the time of the filing of this patent application to possibly reside broadly in the packaging, wherein sections used for a packaging are at least also partially useable for a packaging with other dimensions.

Another feature or aspect of an embodiment is believed at the time of the filing of this patent application to possibly reside broadly in the packaging, wherein the reinforcing material, in one possible embodiment for glass-sheets, is a wooden profile, in one possible embodiment a roof batten and in another possible embodiment a roof batten made according to DIN 4074-1.

Yet another feature or aspect of an embodiment is believed at the time of the filing of this patent application to possibly reside broadly in the packaging, wherein the reinforcing material, in one possible embodiment for natural stone plates, is a metal profile, in one possible embodiment a hollow aluminum profile or a hollow steel profile.

Still another feature or aspect of an embodiment is believed at the time of the filing of this patent application to possibly reside broadly in the packaging, which packaging comprises at least two layers of reinforcing material, positioned at different distances from the edge of the cargo needing protection, in which yielding material is not only provided between the edge requiring protection and the next layer of reinforcing material, but also in between both layers of reinforcing material and is in one possible embodiment also placed on the outside of the layer with reinforcement material, positioned furthest away from the edge requiring protection.

A further feature or aspect of an embodiment is believed at the time of the filing of this patent application to possibly reside broadly in the packaging, wherein the yielding material, as used on the outer surface of the cargo, protrudes beyond the cargo, in one possible embodiment encloses the edge that needs to or should be protected.

One feature or aspect of an embodiment is believed at the time of the filing of this patent application to possibly reside broadly in the packaging, wherein the reinforcing material extends into the region of the yielding material, which stands at a right angle to the outer surface of the cargo with respect to the cargo and in one possible embodiment extends into the region with which the yielding material encloses the edge that needs to or should be protected.

Another feature or aspect of an embodiment is believed at the time of the filing of this patent application to possibly reside broadly in the packaging, wherein the yielding material or the reinforcing material is composed of one piece or multiple pieces when viewed as a cross-section.

Yet another feature or aspect of an embodiment is believed at the time of the filing of this patent application to possibly reside broadly in the packaging, wherein the yielding material, together with the reinforcing material, forms a composite material.

Still another feature or aspect of an embodiment is believed at the time of the filing of this patent application to possibly reside broadly in the packaging, wherein the yielding material and/or the reinforcing material form a profile, made of several parts when viewed as a cross-section, in which at least one dividing-joint runs in the profile s longitudinal direction, in which the dividing-joint running in the profile's longitudinal direction in one possible embodiment runs through the opening provided for the reinforcing-profile.

A further feature or aspect of an embodiment is believed at the time of the filing of this patent application to possibly reside broadly in the packaging, wherein the various parts of the profile are glued together and/or welded together and/or mechanically held together.

Another feature or aspect of an embodiment is believed at the time of the filing of this patent application to possibly reside broadly in the packaging, in which a circumferential edge-protection of the cargo is provided and in which the edge-protection is composed of individual sections, held together by at least one strapping, or at least one tensioning-band, or at least one tensioning-strap, and/or at least a tensioned foil enveloping the cargo, and/or at least a tensioned fabric enveloping the cargo, in one possible embodiment using corner-protection in order to reduce the corner load and/or to improve the slip effect on the packaging corners for the strapping, the strap, the strapping band, the foil or the fabric.

Yet another feature or aspect of an embodiment is believed at the time of the filing of this patent application to possibly reside broadly in the packaging, wherein: a) At least two profile-sections of the edge-protection abut one another bluntly at a corner of the cargo; or b) At least two profile-sections of the edge-protection abut one another mitered at a corner of the cargo; or c) At least two profile-sections of the edge-protection abut a corner-section; in one possible embodiment bluntly abut a corner-section.

Still another feature or aspect of an embodiment is believed at the time of the filing of this patent application to possibly reside broadly in the packaging, wherein: a) For a disc-shaped cargo four corner-profiles are provided, in which each corner-section connects with two profile-sections; and b) For a cuboid-shaped cargo eight corner-profiles are provided, in which each corner- section connects with three profile-sections.

A further feature or aspect of an embodiment is believed at the time of the filing of this patent application to possibly reside broadly in the packaging, wherein: a) One single profile-section is provided between two adjacent corners of the cargo; or b) Several profile-sections are provided between two adjacent corners of the cargo, in one possible embodiment when at least one of the profile-sections serves as a section-module of the same length for different packagings, and where another profile-section serves as a fitting piece, which together with one or more section-modules, creates the required and/or desired profile length between two adjacent corners.

Another feature or aspect of an embodiment is believed at the time of the filing of this patent application to possibly reside broadly in the packaging, wherein an interchangeable use as edge-protection: a) That can hold and adjust to different thicknesses of the disc-shaped cargo; and/or b) That can hold a number of side-by-side positioned cargos; and/or c) That can adapt to different lengths and/or widths of the packaged product.

Yet another feature or aspect of an embodiment is believed at the time of the filing of this patent application to possibly reside broadly in the packaging, comprising: a) Stepped recesses in the edge-protection to accommodate inserts with different thicknesses and/or different thicknesses of cargo; and/or b) Stepped recesses in the inserts used in the edge-protection, to hold different thicknesses of cargo.

Still another feature or aspect of an embodiment is believed at the time of the filing of this patent application to possibly reside broadly in the packaging, which packaging comprises a permanently or detachably affixed thickening to the edge-protection, in which: a) The permanent or substantially permanent thickening is in one possible embodiment laminated; and/or b) The detachable thickening is in one possible embodiment provided with a tongue and groove connection between the edge-protection and the thickening.

A further feature or aspect of an embodiment is believed at the time of the filing of this patent application to possibly reside broadly in the packaging, wherein several packagings can be connected with one another, in one possible embodiment with a tongue and groove connection in which the tongue is undercut and the groove grips around the tongue, in another possible embodiment by a dovetail-fitting between tongue and groove.

One feature or aspect of an embodiment is believed at the time of the filing of this patent application to possibly reside broadly in the packaging, wherein the yielding material: a) Is made completely or partially of particle foam-plastic; or b) Is made completely or partially of extruded foam-plastic; or c) Is made completely or partially of injected foam-plastic.

Another feature or aspect of an embodiment is believed at the time of the filing of this patent application to possibly reside broadly in the packaging, wherein: a) For smaller quantities, the sections of the packaging are composed of various parts, in which: aa) The individual pieces are assembled to form a closed cavity when viewed as a cross-section and/or an open cavity when viewed as a cross-section, so that a machined deformation is at least partially expendable; b) For smaller quantities, the sections of the packaging are machine deformed to create open and/or closed cavities; c) Foam-plastic strands are at least used in part for the sections of the packaging with smaller quantities, which are cut from a sheet-type base-material, in one possible embodiment from a plate-shaped extruded material or a plate-shaped material made of particles; and/or d) For larger quantities, the use of extruded foam-plastic strands, and/or the use of molded parts made of particle foam and/or the use of injection moldings.

Yet another feature or aspect of an embodiment is believed at the time of the filing of this patent application to possibly reside broadly in the packaging, wherein the band or strap used to hold the sections of the packaging together, is guided through a recess in the packaging/edge-protection, in which at the same time, available grooves in one possible embodiment serve as guidance for the band or strap.

Still another feature or aspect of an embodiment is believed at the time of the filing of this patent application to possibly reside broadly in the packaging, wherein the hollow over the outer surface area of the cargo and enclosed by the edge-protection, is at least partially covered with further yielding material: a) In which the additional yielding material is made of the same or similar yielding material as the edge-protection; and b) In which the additional yielding material for the enclosed surface area differs from the provided yielding material used outside of the enclosed area, in one possible embodiment with a layer of cardboard or paperboard in the enclosed area, in another possible embodiment with a honeycomb structure in the cardboard or paperboard layer.

A further feature or aspect of an embodiment is believed at the time of the filing of this patent application to possibly reside broadly in the packaging, which packaging comprises a wrapping of the cargo and its edge-protection in a foil and/or a fabric, in which the foil and/or the fabric in one possible embodiment encloses the provided yielding material filling the hollow over the outer surface area of the cargo as well.

Another feature or aspect of an embodiment is believed at the time of the filing of this patent application to possibly reside broadly in the packaging, wherein: a) The foil or the fabric is made of a shrink-material that tensions due to shrinking with heat treatment; and/or b) The foil and/or the fabric is connected to the yielding material, in which the foil and/or fabric and/or the yielding material are under tension; and/or c) The foil and/or the fabric surrounds the yielding material loosely and the packaging is provided with a tensioning device.

Yet another feature or aspect of an embodiment is believed at the time of the filing of this patent application to possibly reside broadly in the package, wherein: a) The foil and/or the fabric is at least partially welded or glued to the yielding material; or b) That the fabric is embedded in the yielding material, in one possible embodiment a glass-fibre grid fabric is imprinted in the molten surface of the yielding material; c) That strips of foil and/or fabric are welded or glued to the yielding material.

Still another feature or aspect of an embodiment is believed at the time of the filing of this patent application to possibly reside broadly in the packaging for cargo, in one possible embodiment disc-shaped cargo, with an edge-protection for at least one outer edge, in which the edge-protection at least partially comprises yielding material, which packaging comprises transport-aids, in one possible embodiment: a) Handles; and/or b) Loops; and/or c) Hooks and/or pins; d) Eyelets; and/or e) Rollers; and/or f) Feet; and/or g) Fasteners; and/or h) Forklift feet; and/or i) Containers; and/or j) Connections for transport-securing.

A further feature or aspect of an embodiment is believed at the time of the filing of this patent application to possibly reside broadly in the packaging, wherein: a) The handles are attached permanently or detachably, in one possible embodiment with handles; aa) That are provided to attach to the yielding material or the reinforcing material, in one possible embodiment in recesses provided in the yielding material or the reinforcing material, and/or aaa) Are attachable to the tensioning band or tensioning strap used for strapping; b) The loops are attached permanently or detachably, in one possible embodiment with loops, bb) Which are attached to the yielding material or the reinforcing material, in one possible embodiment attached to the band or strap used for strapping; c) Rollers are housed in a separate casing and through the casing indirectly or detachably attached to the packaging, in one possible embodiment with roller casings, which are attached permanently or detachably to the packaging, in another possible embodiment with rollers which are integrated into packaging sections; d) The feet are attached permanently or detachably to the packaging; e) Hooks or spigots are attached permanently or detachably to the packaging, in one possible embodiment with hooks or spigots that can be attached to the yielding material or to the reinforcing material, in one possible embodiment to the band or strap used for strapping; f) Eyelets are attached permanently or detachably to the packaging, in one possible embodiment eyelets that are attached permanently or detachably to the yielding material or to the reinforcing material, in one possible embodiment attached permanently or detachably to the strapping, to the band or to the strap or that eyelets are formed by the reinforcing material, the strapping, the band or the strap itself; g) Connecting elements are provided that serve as a connection for abutting packaging sections and/or as a connection of packagings standing side-by-side and/or packagings that stand behind one another other; h) Forklift feet are attached permanently or detachably to the packaging, in one possible embodiment forklift feet that are attached permanently or detachably to the yielding material, to the reinforcing material, to the strapping, to the band, to the strap or integrated into the packaging sections; i) Containers are attached permanently or detachably to the packaging, in one possible embodiment containers that are attached permanently or detachably to the yielding material, to the reinforcing material, to the strapping, to the band, to the strap or integrated into the packaging sections; j) Transport-securing connections are attached permanently or detachably to the packaging, in one possible embodiment transport-securing connections that are attached to the yielding material, to the reinforcing material, to the strapping, to the band, to the strap or integrated into the packaging sections.

Another feature or aspect of an embodiment is believed at the time of the filing of this patent application to possibly reside broadly in the packaging, wherein the sections that form the edge-protection are profiled on their outer surfaces in a way that accessories and transport aids can be slid onto these profiles, in which the profiles are formed by elevations and/or indentations, in which in one possible embodiment a tongue/groove connection is provided between the transport-aids and the profiles, in another possible embodiment with tongue/groove connections with a dovetail-fitting, and in yet another possible embodiment with a tongue/groove connection that run in the longitudinal direction of the packaging-sections, or at right angles thereto.

Yet another feature or aspect of an embodiment is believed at the time of the filing of this patent application to possibly reside broadly in the packaging, wherein: a) The plastic foam that forms the yielding material is, at least at the corners and on one side, provided with a mantle or coat as a reinforcement, and/or is provided with a reinforcement foil and/or with a reinforcement fabric, where the mantle or coat or the reinforcing fabric provides at least the same reinforcement as a unexpanded foil with a thickness of 0.3 mm, in one possible embodiment with a thickness of 0.6 millimeters, in another possible embodiment with thickness of 0.9 millimeters, made of the same plastic as the foam-plastic composing the yielding material; and/or b) A corner-protection, attached permanently or detachably, is provided on at least the corners or the corner-parts, in one possible embodiment a corner-protection which is attached to or lies loosely against the corner-sections, held in place by the strapping.

Still another feature or aspect of an embodiment is believed at the time of the filing of this patent application to possibly reside broadly in the packaging, wherein the transport-aids are held by the packaging in a moveable way, and that they are held in the respective position by self-locking or by additional clamping.

A further feature or aspect of an embodiment is believed at the time of the filing of this patent application to possibly reside broadly in the packaging, wherein the edges of the yielding foam-plastic material, are rounded for creating a coat or mantle, in one possible embodiment the edges of the recesses in the case of an extrusion coat or mantle.

One feature or aspect of an embodiment is believed at the time of the filing of this patent application to possibly reside broadly in the packaging for cargo, in one possible embodiment disc-shaped cargo, with an edge-protection for at least one outer edge, in which the edge-protection comprises at least partially yielding material, wherein: a) The packaging is a one-way packaging; or b) The packaging is reusable packaging, from which the undamaged returned packaging can be used for the packaging of new cargo with the same dimensions; and/or c) Undamaged sections of returned packaging that is damaged can be used in combination with new sections for the packaging of new cargo; and/or d) Undamaged sections of returned, undamaged packaging can be used for the packaging of new cargo.

Another feature or aspect of an embodiment is believed at the time of the filing of this patent application to possibly reside broadly in the packaging for cargo, in one possible embodiment disc-shaped cargo, with an edge-protection for at least one outer edge, in which the edge-protection comprises at least partially yielding material, which packaging comprises a complete enveloping of the cargo with yielding material, in which: a) The covering comprises multiple pieces; or b) The covering comprises one piece and is made of particle foam.

Yet another feature or aspect of an embodiment is believed at the time of the filing of this patent application to possibly reside broadly in the packaging, which packaging is configured to be applied to: a) Glass, in one possible embodiment flat glass, for example for buildings or vehicles; and/or b) Natural stone slabs; and/or c) Counter tops; and/or d) Photovoltaic panels/solar cells.

Still another feature or aspect of an embodiment is believed at the time of the filing of this patent application to possibly reside broadly in the packaging, wherein flat glass, which has a tendency to show hairline cracks and even micro-fine hairline cracks during its manufacturing, is honed/sanded at least at the edges.

The components disclosed in the patents, patent applications, patent publications, and other documents disclosed or incorporated by reference herein, may possibly be used in possible embodiments of the present invention, as well as equivalents thereof.

The purpose of the statements about the technical field is generally to enable the Patent and Trademark Office and the public to determine quickly, from a cursory inspection, the nature of this patent application. The description of the technical field is believed, at the time of the filing of this patent application, to adequately describe the technical field of this patent application. However, the description of the technical field may not be completely applicable to the claims as originally filed in this patent application, as amended during prosecution of this patent application, and as ultimately allowed in any patent issuing from this patent application. Therefore, any statements made relating to the technical field are not intended to limit the claims in any manner and should not be interpreted as limiting the claims in any manner.

The appended drawings in their entirety, including all dimensions, proportions and/or shapes in at least one embodiment of the invention, are accurate and are hereby included by reference into this specification.

The background information is believed, at the time of the filing of this patent application, to adequately provide background information for this patent application. However, the background information may not be completely applicable to the claims as originally filed in this patent application, as amended during prosecution of this patent application, and as ultimately allowed in any patent issuing from this patent application. Therefore, any statements made relating to the background information are not intended to limit the claims in any manner and should not be interpreted as limiting the claims in any manner.

All, or substantially all, of the components and methods of the various embodiments may be used with at least one embodiment or all of the embodiments, if more than one embodiment is described herein.

The purpose of the statements about the object or objects is generally to enable the Patent and Trademark Office and the public to determine quickly, from a cursory inspection, the nature of this patent application. The description of the object or objects is believed, at the time of the filing of this patent application, to adequately describe the object or objects of this patent application. However, the description of the object or objects may not be completely applicable to the claims as originally filed in this patent application, as amended during prosecution of this patent application, and as ultimately allowed in any patent issuing from this patent application. Therefore, any statements made relating to the object or objects are not intended to limit the claims in any manner and should not be interpreted as limiting the claims in any manner.

All of the patents, patent applications, patent publications, and other documents cited herein, and in the Declaration attached hereto, are hereby incorporated by reference as if set forth in their entirety herein except for the exceptions indicated herein.

The summary is believed, at the time of the filing of this patent application, to adequately summarize this patent application. However, portions or all of the information contained in the summary may not be completely applicable to the claims as originally filed in this patent application, as amended during prosecution of this patent application, and as ultimately allowed in any patent issuing from this patent application. Therefore, any statements made relating to the summary are not intended to limit the claims in any manner and should not be interpreted as limiting the claims in any manner.

It will be understood that the examples of patents, patent applications, patent publications, and other documents which are included in this application and which are referred to in paragraphs which state "Some examples of . . . which may possibly be used in at least one possible embodiment of the present application . . . " may possibly not be used or useable in any one or more embodiments of the application.

The sentence immediately above relates to patents, patent applications, patent publications, and other documents either incorporated by reference or not incorporated by reference.

All of the patents, patent applications, patent publications, and other documents, except for the exceptions indicated herein, which were cited in the International Search Report dated Dec. 9, 2013, and/or cited elsewhere, as well as the International Search Report document itself, are hereby incorporated by reference as if set forth in their entirety herein except for the exceptions indicated herein, as follows: DE 10 2006 025912, having the title "Glasscheibe sowie Verfahren zur Herstellung der Glasscheibe," published on Dec. 6, 2007; WO 2008/087370, having the title "EDGE PROTECTOR," published on Jul. 24, 2008; EP 0 530 611, having the title "Stackable transport rack for glass sheets," published on Mar. 10, 1993; EP 0 216 690, having the title "Handling device for sheet-shaped articles," published on Apr. 1, 1987; FR 2 769 601, having the title "Protective polystyrene packing sections for boxed products, especially electrical goods," published on Apr. 16, 1999; DE 26 46 908, having the title "VERPACKUNG FUER STUECK-GUETER," published on Apr. 20, 1978; U.S. Pat. No. 4,989,415, having the title "Cooling holder for beverage container," published on Feb. 5, 1991; DE 33 44 120, having the title "Device for protecting corners or edges of articles, such as chipboards," published on Jun. 20, 1985; EP 0 502 347, having the title "Package for an appliance," published on Sep. 9, 1992; and DE 19 53 181, having the title "SCHIENE AUS KUNSTSTOFFHARTSCHAUM ZUR STOSSDAEMPFENDEN VERPACKUNG VON PLATTENFOERMIGEN GEGENSTAENDEN, INSBESONDERE GLASSCHEIBEN U. DGL.," published on Jan. 5, 1967.

The corresponding foreign and international patent publication applications, namely, Federal Republic of Germany Patent Application No. 10 2012 019 169.3, filed on Sep. 30, 2012, and DE-10 2012 019 169.3 and DE-PS 10 2012 019 169.3, Federal Republic of Germany Patent Application No. 10 2012 022 585.7, filed on Nov. 20, 2012, and DE-OS 10 2012 022 585.7 and DE-PS 10 2012 022 585.7, Federal Republic of Germany Patent Application No. 10 2012 025 523.3, filed on Dec. 29, 2012, and DE-OS 10 2012 025 523.3 and DE-PS 10 2012 025 523.3, Federal Republic of Germany Patent Application No. 10 2013 001 625.8, filed on Jan. 29, 2013, and DE-OS 10 2013 001 625.8 and DE-PS 10 2013 001 625.8, and International Application No. PCT/EP2013/002697, filed on Sep. 9, 2013, having WIPO Publication No. WO 2014/048544 and inventor Thomas GILLER, are hereby incorporated by reference as if set forth in their entirety herein, except for the exceptions indicated herein, for the purpose of correcting and explaining any possible misinterpretations of the English translation thereof. In addition, the published equivalents of the above corresponding foreign and international patent publication applications, and other equivalents or corresponding applications, if any, in corresponding cases in the Federal Republic of Germany and elsewhere, and the references and documents cited in any of the documents cited herein, such as the patents, patent applications, patent publications, and other documents, except for the exceptions indicated herein, are hereby incorporated by reference as if set forth in their entirety herein except for the exceptions indicated herein.

The purpose of incorporating the corresponding foreign equivalent patent application(s), that is, PCT/EP2013/002697, German Patent Application 10 2012 019 169.3, German Patent Application 10 2012 022 585.7, German Patent Application 10 2012 025 523.3, and Germany Patent Application 10 2013 001 625.8, is solely for the purposes of providing a basis of correction of any wording in the pages of the present application, which may have been mistranslated or misinterpreted by the translator, and to provide additional information relating to technical features of one or more embodiments, which information may not be completely disclosed in the wording in the pages of this application.

Statements made in the original foreign patent applications PCT/EP2013/002697, DE 10 2012 019 169.3, DE 10 2012 022 585.7, DE 10 2012 025 523.3, and DE 10 2013 001 625.8 from which this patent application claims priority which do not have to do with the correction of the translation in this patent application are not to be included in this patent application in the incorporation by reference.

Any statements about admissions of prior art in the original foreign patent applications PCT/EP2013/002697, DE 10 2012 019 169.3, DE 10 2012 022 585.7, DE 10 2012 025 523.3, and DE 10 2013 001 625.8 are not to be included in this patent application in the incorporation by reference, since the laws relating to prior art in non-U.S. Patent Offices and courts may be substantially different from the Patent Laws of the United States.

All of the references and documents cited in any of the patents, patent applications, patent publications, and other documents cited herein, except for the exceptions indicated herein, are hereby incorporated by reference as if set forth in their entirety herein except for the exceptions indicated herein. All of the patents, patent applications, patent publications, and other documents cited herein, referred to in the immediately preceding sentence, include all of the patents, patent applications, patent publications, and other documents cited anywhere in the present application.

Words relating to the opinions and judgments of the author of all patents, patent applications, patent publications, and other documents cited herein and not directly relating to the technical details of the description of the embodiments therein are not incorporated by reference.

The words all, always, absolutely, consistently, preferably, guarantee, particularly, constantly, ensure, necessarily, immediately, endlessly, avoid, exactly, continually, expediently, ideal, need, must, only, perpetual, precise, perfect, require, requisite, simultaneous, total, unavoidable, and unnecessary, or words substantially equivalent to the above-mentioned words in this sentence, when not used to describe technical features of one or more embodiments of the patents, patent applications, patent publications, and other documents, are not considered to be incorporated by reference herein for any of the patents, patent applications, patent publications, and other documents cited herein.

The description of the embodiment or embodiments is believed, at the time of the filing of this patent application, to adequately describe the embodiment or embodiments of this patent application. However, portions of the description of the embodiment or embodiments may not be completely applicable to the claims as originally filed in this patent application, as amended during prosecution of this patent application, and as ultimately allowed in any patent issuing from this patent application. Therefore, any statements made relating to the embodiment or embodiments are not intended to limit the claims in any manner and should not be interpreted as limiting the claims in any manner.

The details in the patents, patent applications, patent publications, and other documents cited herein may be considered to be incorporable, at applicant's option, into the claims during prosecution as further limitations in the claims to patentably distinguish any amended claims from any applied prior art.

The purpose of the title of this patent application is generally to enable the Patent and Trademark Office and the public to determine quickly, from a cursory inspection, the nature of this patent application. The title is believed, at the time of the filing of this patent application, to adequately reflect the general nature of this patent application. However, the title may not be completely applicable to the technical field, the object or objects, the summary, the description of the embodiment or embodiments, and the claims as originally filed in this patent application, as amended during prosecution of this patent application, and as ultimately allowed in any patent issuing from this patent application. Therefore, the title is not intended to limit the claims in any manner and should not be interpreted as limiting the claims in any manner.

The abstract of the disclosure is submitted herewith as required by 37 C.F.R. §1.72(b). As stated in 37 C.F.R. §1.72(b):

> A brief abstract of the technical disclosure in the specification must commence on a separate sheet, preferably following the claims, under the heading "Abstract of the Disclosure." The purpose of the abstract is to enable the Patent and Trademark Office and the public generally to determine quickly from a cursory inspection the nature and gist of the technical disclosure. The abstract shall not be used for interpreting the scope of the claims.

Therefore, any statements made relating to the abstract are not intended to limit the claims in any manner and should not be interpreted as limiting the claims in any manner.

The embodiments of the invention described herein above in the context of the preferred embodiments are not to be taken as limiting the embodiments of the invention to all of the provided details thereof, since modifications and variations thereof may be made without departing from the spirit and scope of the embodiments of the invention.

What is claimed is:

1. A protective packaging to protect panes of glass or other plate-shaped objects from damage during transport, handling, or storage, said packaging comprising:

an edge protector being configured to cover perimeter edges of a pane of glass or other plate-shaped object;

said edge protector comprising a yielding material and a reinforcing material disposed within said yielding material;

said yielding material comprising plastic foam;

said reinforcing material comprising elongated pieces of wood;

said yielding material being divided into separate sections;

each of said sections of yielding material comprising an opening therein configured to permit said sections of yielding material to be slid onto one of said elongated pieces of wood, or to permit one of said elongated pieces of wood to be slid into said sections of yielding material, upon installation of said edge protector on the pane of glass or other plate-shaped object;

each of said sections of yielding material comprising a recess configured to receive therein an edge portion of the pane of glass or other plate-shaped object upon installation of said edge protector on the pane of glass or other plate-shaped object; and said sections of yielding material comprising side pieces configured to cover side edges of the pane of glass or other plate-shaped object, and corner pieces configured to cover corner edges of the pane of glass or other plate-shaped object.

2. The protective packaging according to claim 1, wherein:

each of said sections of yielding material comprises first, second, third, and fourth side surfaces;

said first side surface is configured to face the pane of glass or other plate-shaped object upon installation;

said recess is disposed at said first side surface and to run the length thereof; and at least one of said second, third, and fourth side surfaces comprises a groove, which groove is disposed to run the length of its side surface.

3. The protective packaging according to claim 2, wherein the packaging further comprises at least one of (A) and (B):

(A) a strap or belt configured to be wrapped around said sections of yielding material, within said groove in each of said sections of yielding material, to hold said sections of yielding material in place upon installation of said edge protector on the pane of glass or other plate-shaped object; and (B) a shrinkable material configured to be wrapped and shrunk around said sections of yielding material to hold said sections of yielding material in place upon installation of said edge protector on the pane of glass or other plate-shaped object.

4. The protective packaging according to claim 3, wherein the packaging is configured to hold one or more panes of glass or other plate-shaped objects.

5. The protective packaging according to claim 4, wherein the packaging further comprises an insert configured to be inserted into said recess of one or more of said sections of yielding material to adapt each said recess to receive and hold the glass or other plate-shaped object to be protected.

6. The protective packaging according to claim 5, wherein:

each of said second, third, and fourth side surfaces comprises a groove; and each of said grooves has a substantially dovetail-shaped cross section.

7. The protective packaging according to claim 6, wherein:

the packaging further comprises a handle structure configured to permit carrying of the packaging and a. glass pane or other plate-shaped object therein, and said handle structure comprises at least one dovetail-shaped projection configured to be inserted in an interlocking manner into at least one of said grooves to connect said handle structure to said edge protector.

8. The protective packaging according to claim 7, wherein:

the packaging further comprises a roller structure configured to permit rolling of, the packaging and a glass pane or other plate-shaped object therein along a ground, floor, or other support surface; and said roller structure comprises at least one dovetail-shaped projection configured to be inserted in an interlocking manner into at least one of said grooves to connect said roller structure to said edge protector.

9. The protective packaging according to claim 8, wherein:

the packaging further comprises an additional edge protector, of the same design as said edge protector, and at least one connecting structure configured to connect said edge protector to said additional edge protector to permit protection, transport, and handling of more than one pane of glass or other plate-shaped object in a single packaging; and said at least one connecting structure comprises two dovetail-shaped projections configured to be inserted in an interlocking manner into adjacent grooves of said edge protectors.

10. The protective packaging according to claim 9, wherein:

the packaging further comprises a foot structure configured to support and hold said edge protectors and a glass pane or other plate-shaped object therein in a vertical orientation essentially perpendicular to a ground, floor, or other support surface; and said foot structure comprises at least one dovetail-shaped projection configured to be inserted in an interlocking manner into at least one of said grooves to connect said foot structure to said edge protectors.

11. A method of installing a protective packaging and thereby protecting panes of glass or other plate-shaped objects from damage during transport, handling, or storage, said protective packaging comprising:

an edge protector being configured to cover perimeter edges of a pane of glass or other plate-shaped object;

said edge protector comprising a yielding material and a reinforcing material disposed within said yielding material;

said yielding material comprising plastic foam;

said reinforcing material comprising elongated pie of wood;

said yielding material being divided into separate sections;

each of said sections of yielding material comprising an opening therein configured to permit said sections of yielding material to be slid onto one of said elongated pieces of wood, or to permit one of said elongated pieces of wood to be slid into said sections of yielding material, upon installation of said edge protector on the pane of glass or other plate-shaped object;

each of said sections of yielding material comprising a recess configured to receive an edge portion of the pane of glass or other plate-shaped object therein upon installation of said edge protector on the pane of glass or other plate-shaped object; and said sections of yielding material comprising side pieces configured to cover side edges of the pane of glass or other plate-shaped object, and corner pieces configured to cover corner edges of the pane of glass or other plate-shaped object; and said method comprising:

connecting sections of said yielding material to said reinforcing material by at least one of (A) and (B):

(A) sliding each of said sections of yielding material, via said opening therein, onto one of said elongated pieces of wood; and (B) sliding one of said elongated piece of wood into said openings in each of said sections of yielding material;

placing said side pieces and said corner pieces of said sections of yielding material onto side edges and corners of a pane of glass other plate-shaped object, such that an edge portion of said pane of glass or other plate-shaped object is disposed in said recess of each of said sections of yielding material, and thereby forming an edge protector which covers all perimeter edge portions of said pane of glass or other plate-shaped object.

12. A protective packaging to protect panes of glass or other plate-shaped objects from damage during transport, handling, or storage, said packaging comprising:

an edge protector configured to cover perimeter edges of a pane of glass or a plate-shaped object;

said edge protector comprising a yielding material and a reinforcing material;

said reinforcing material being disposed within said yielding material;

said yielding material comprising a plastic foam having a yieldability that is one of:

(A) at least 20% greater than the yieldability of said reinforcing material, (B) at least 40% greater than the yieldability of said reinforcing material, (C) at least 60% greater than the yieldability of said reinforcing material, and (D) at least 80% greater than the yieldability of said reinforcing material;

said yielding material being divided into separate sections; and a holding arrangement being configured to hold at least two of said sections of yielding material in place upon installation, said holding arrangement comprising either:

(E) at least one strap or band; or (F) a covering comprising a shrinkable material or fabric.

13. The protective packaging according to claim 12, wherein at least one of (G), (H), and (I):

(G) the shrinkable material or the fabric is at least partially laminated onto the packaging;

(H) said reinforcing material comprises profiles, and either the yielding material is slid onto the profiles, or the profiles are slid into the yielding material; and (I) said yielding material comprises a mantle or coat formed from an extrusion skin, or skin of a filament cut, or a skin that is the result of heat treatment.

14. The protective packaging according to claim 13, wherein at least one of (J) and (K):

(J) said plastic foam comprises at least 10% open cells, or at least 20% open cells, or at least 30% open cells; and (K) said reinforcing material comprises at least one of:

wood or other organic material;

metal, plastic, or other inorganic material; and a mixture of at least two different materials; said reinforcing material is formed in one piece or in layers.

* * * * *